US010174995B2

(12) United States Patent
Lauchnor

(10) Patent No.: US 10,174,995 B2
(45) Date of Patent: Jan. 8, 2019

(54) MODULAR RETROFIT QUENCH UNIT

(71) Applicant: Blue Quench LLC, Miramar Beach, FL (US)

(72) Inventor: John Lauchnor, Miramar Beach, FL (US)

(73) Assignee: Blue Quench LLC, Miramar Beach, FL (US)

( * ) Notice: Subject to any disclaimer, the term of this patent is extended or adjusted under 35 U.S.C. 154(b) by 0 days.

(21) Appl. No.: 15/800,709

(22) Filed: Nov. 1, 2017

(65) Prior Publication Data

US 2018/0106533 A1 Apr. 19, 2018

Related U.S. Application Data

(63) Continuation of application No. PCT/US2017/037446, filed on Jun. 14, 2017, which (Continued)

(51) Int. Cl.
*F25D 3/08* (2006.01)
*F25D 31/00* (2006.01)
(Continued)

(52) U.S. Cl.
CPC ..... *F25D 31/006* (2013.01); *F25C 1/00* (2013.01); *F25D 29/005* (2013.01);
(Continued)

(58) Field of Classification Search
CPC ..... F25D 17/02; F25D 31/006; F25D 31/007; F25D 2331/00; F25D 2331/803; F25D 2331/805; F25D 2400/28; F25D 2400/30
See application file for complete search history.

(56) References Cited

U.S. PATENT DOCUMENTS 2,470,551 A 5/1949 Fish
3,357,200 A 12/1967 Connors
(Continued)

FOREIGN PATENT DOCUMENTS

EP 174170 3/1986
JP 2002168546 6/2002
(Continued)

OTHER PUBLICATIONS

Federal Institute of Industrial Property, ISA/RU. International Search Report dated Oct. 12, 2017, for related PCT Patent Application No. US/2017/037446, 1 sheet.

*Primary Examiner* — Jonathan Bradford
(74) *Attorney, Agent, or Firm* — Crawford Maunu PLLC

(57) ABSTRACT

The disclosure features various embodiments and aspects of a chest for quenching beverages. The chest can include a tank for holding a chilled mixture of ice and water, an ice maker adapted for making ice having an output for ejecting ice into a conduit in fluid communication with the tank, and a plurality of quench trays disposed above the tank for holding containers of beverages located in first and second positions. The trays can be filled with cold water by way of a conduit in fluid communication with the tank. The quench trays can include a compartment defined by a bottom and a plurality of walls, and defining therein a plurality of rows for aligning and containing a plurality of beverage containers. The drawers can further include at least one drain orifice configured to guide water out of the quench tray.

23 Claims, 41 Drawing Sheets

Related U.S. Application Data is a continuation-in-part of application No. 15/272,131, filed on Sep. 21, 2016, now Pat. No. 9,810,473, which is a continuation-in-part of application No. 15/272,131, filed on Sep. 21, 2016, now Pat. No. 9,810,473, which is a continuation-in-part of application No. 14/877,143, filed on Oct. 7, 2015, which is a continuation-in-part of application No. 13/789,679, filed on Mar. 8, 2013, now Pat. No. 9,200,831.

(60) Provisional application No. 62/350,062, filed on Jun. 14, 2016, provisional application No. 62/060,664, filed on Oct. 7, 2014, provisional application No. 61/745,033, filed on Dec. 21, 2012.

(51) Int. Cl.
*F25C 1/00* (2006.01)
*F25D 29/00* (2006.01)

(52) U.S. Cl.
CPC ..... *F25D 31/007* (2013.01); *F25B 2600/07* (2013.01); *F25D 2331/803* (2013.01); *F25D 2331/805* (2013.01); *F25D 2400/28* (2013.01); *F25D 2700/16* (2013.01)

(56) References Cited

U.S. PATENT DOCUMENTS

| | | | | |
|---|---|---|---|---|
| 3,888,092 | A | 6/1975 | Fisher | |
| 4,358,932 | A | 11/1982 | Helfrich, Jr. | |
| 4,725,492 | A | 2/1988 | Yazaki et al. | |
| 4,920,763 | A | 5/1990 | Provest et al. | |
| 5,237,835 | A | 8/1993 | Brochier | |
| 5,265,440 | A | 11/1993 | Baker | |
| 5,423,191 | A | 6/1995 | Bennett | |
| 5,442,932 | A | 8/1995 | O'Hearne | |
| 5,466,229 | A | 11/1995 | Elson et al. | |
| 5,584,187 | A | 12/1996 | Whaley | |
| 6,039,202 | A | 3/2000 | Olstad et al. | |
| 6,050,663 | A | 4/2000 | Schoellmann | |
| 6,058,718 | A | 5/2000 | Forsberg et al. | |
| 7,165,415 | B2 | 1/2007 | Nam et al. | |
| 7,246,784 | B1 | 7/2007 | Lopez | |
| 7,654,097 | B2 | 2/2010 | Hawkes | |
| 7,669,429 | B2 | 3/2010 | Bassler, Sr. | |
| 7,703,301 | B2 | 4/2010 | Loibl et al. | |
| 7,780,034 | B1 * | 8/2010 | Richardson | F25D 3/08 206/199 |
| 7,886,547 | B2 | 2/2011 | Sullivan | |
| 8,157,338 | B2 | 4/2012 | Seo et al. | |
| 8,161,769 | B2 | 4/2012 | Lauchnor | |
| 8,549,871 | B1 | 10/2013 | Lauchnor et al. | |
| 9,200,831 | B2 | 12/2015 | Lauchnor et al. | |
| 2006/0016211 | A1 | 1/2006 | Lyvers et al. | |
| 2006/0219858 | A1 | 10/2006 | Iacovino | |
| 2008/0156031 | A1 | 7/2008 | Cur et al. | |
| 2009/0277187 | A1 | 11/2009 | McGann | |
| 2009/0314011 | A1 | 12/2009 | Simmons | |
| 2009/0320517 | A1 * | 12/2009 | Lavallee | F25D 3/08 62/457.2 |
| 2010/0251730 | A1 | 10/2010 | Whillock, Sr. | |
| 2010/0251755 | A1 | 10/2010 | Lauchnor | |
| 2012/0060544 | A1 | 3/2012 | Lee et al. | |
| 2012/0198871 | A1 | 8/2012 | Lauchnor et al. | |
| 2013/0160987 | A1 | 6/2013 | Grigorian | |
| 2016/0097577 | A1 | 4/2016 | Lauchnor et al. | |

FOREIGN PATENT DOCUMENTS

| | | | |
|---|---|---|---|
| WO | 9735155 | A1 | 9/1997 |
| WO | 2009090162 | A1 | 7/2009 |

* cited by examiner

Cooler Chest – Isometric View Illustrating top and side doors

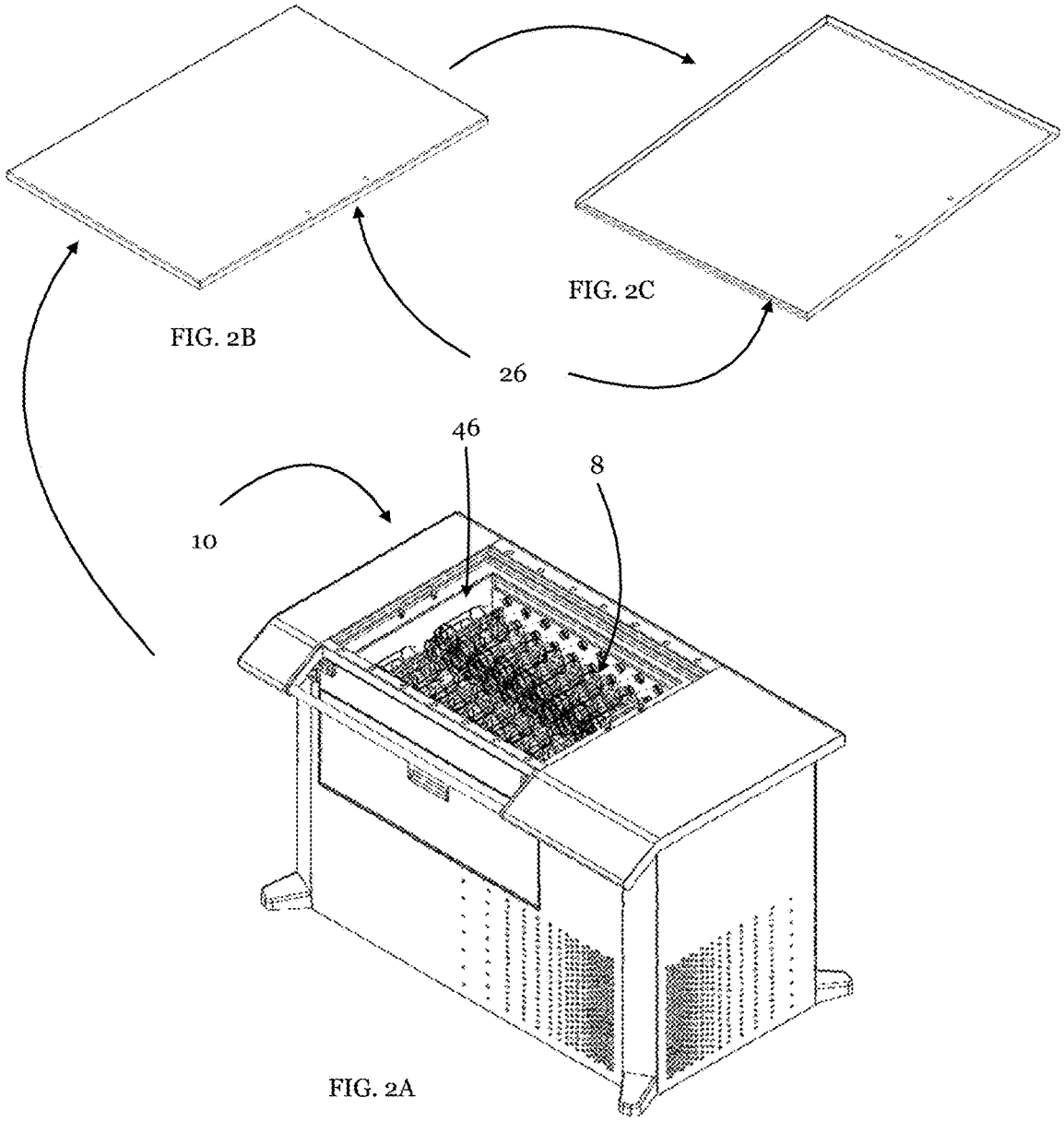
Cooler Chest – Isometric View Illustrating top doors removed

Top Tray with and without interior components

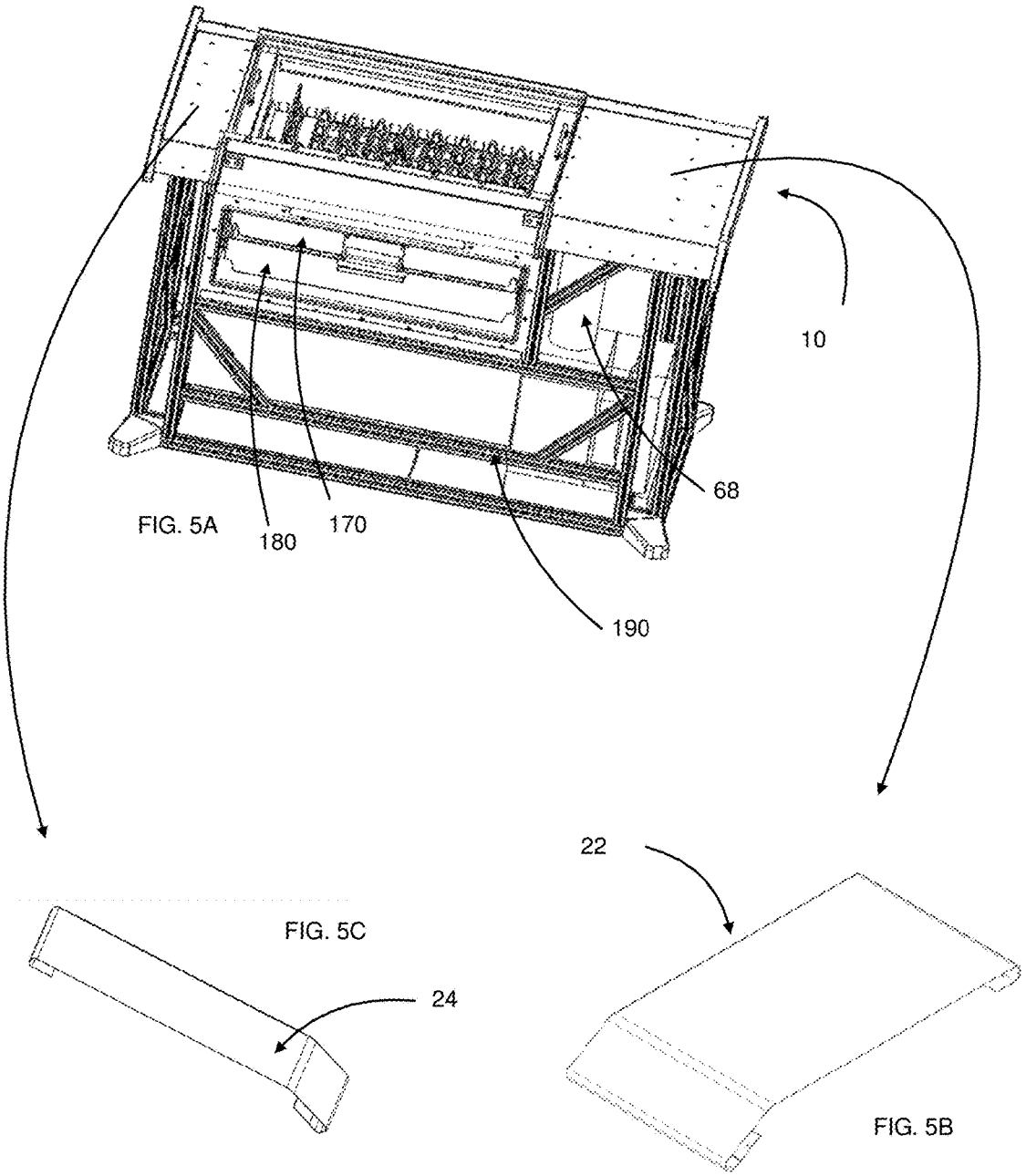
Cooler Chest – Illustrating Interior Components and Counter Portions

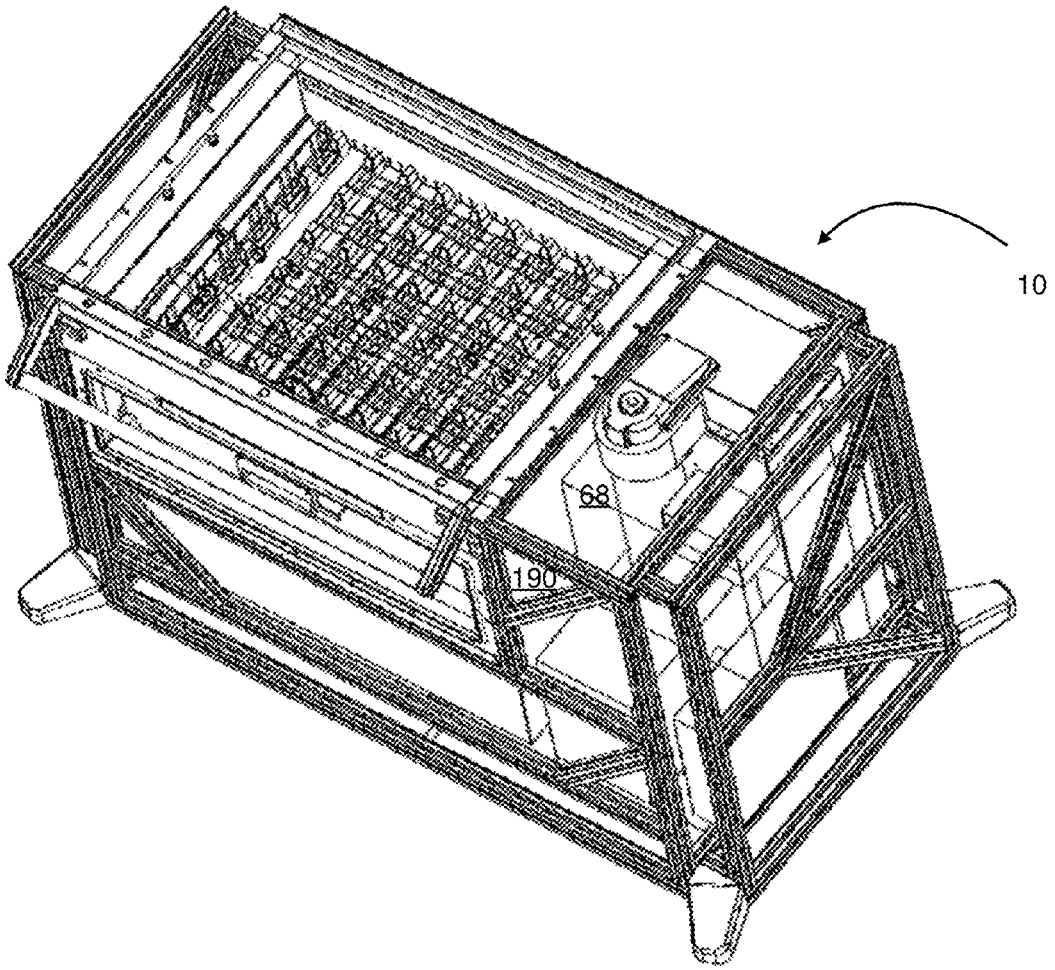
FIGURE 6 Cooler Chest – Illustrating Interior Components

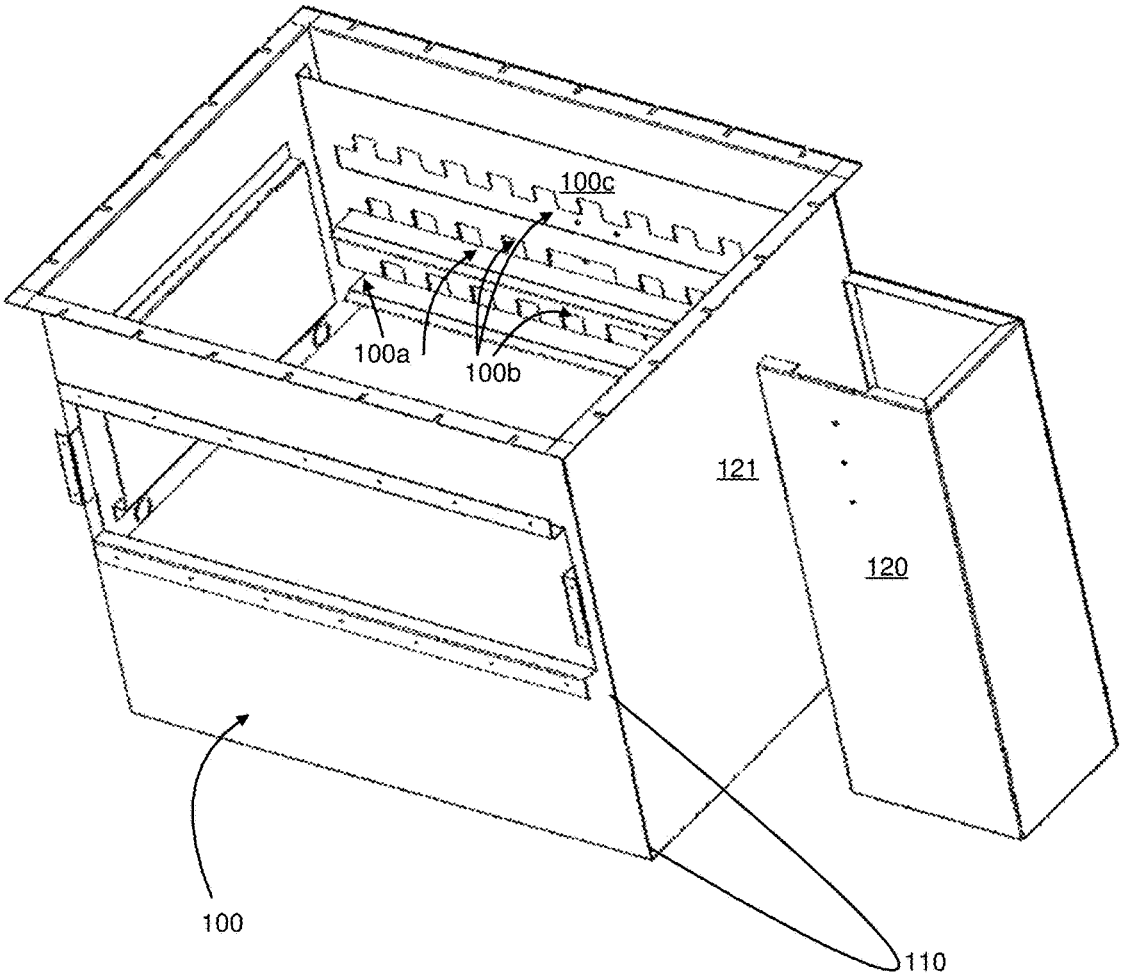
FIGURE 7A Tank – Front Isometric View

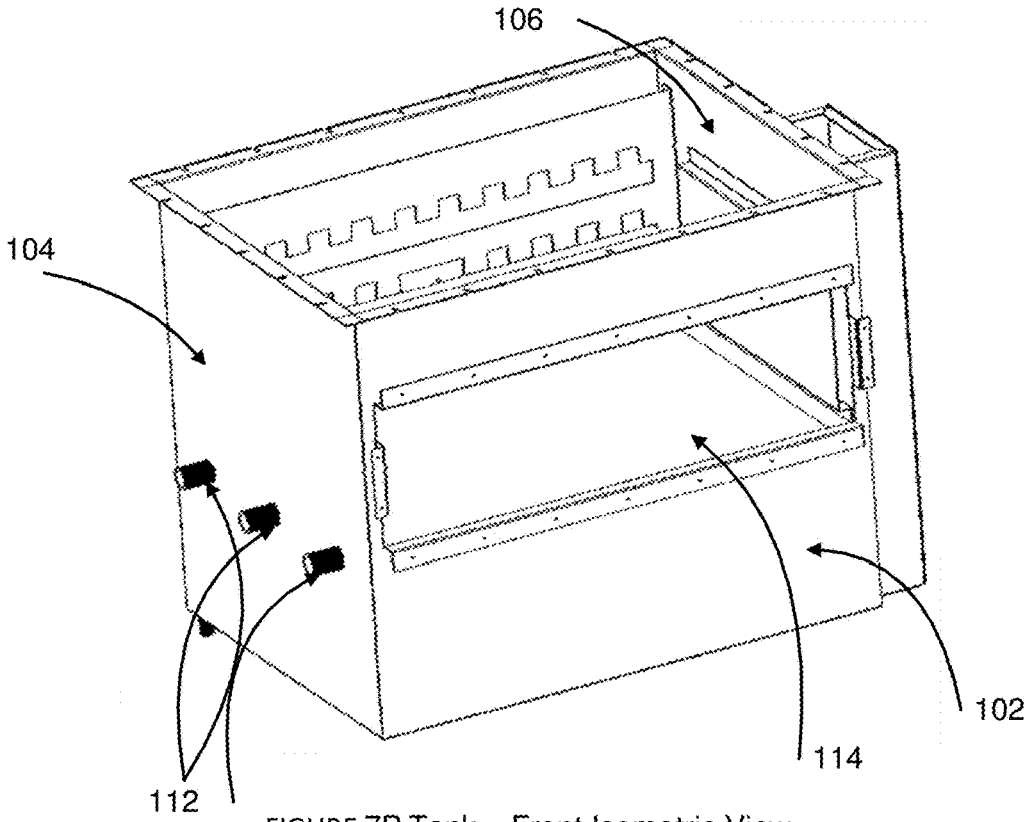
FIGURE 7B Tank – Front Isometric View
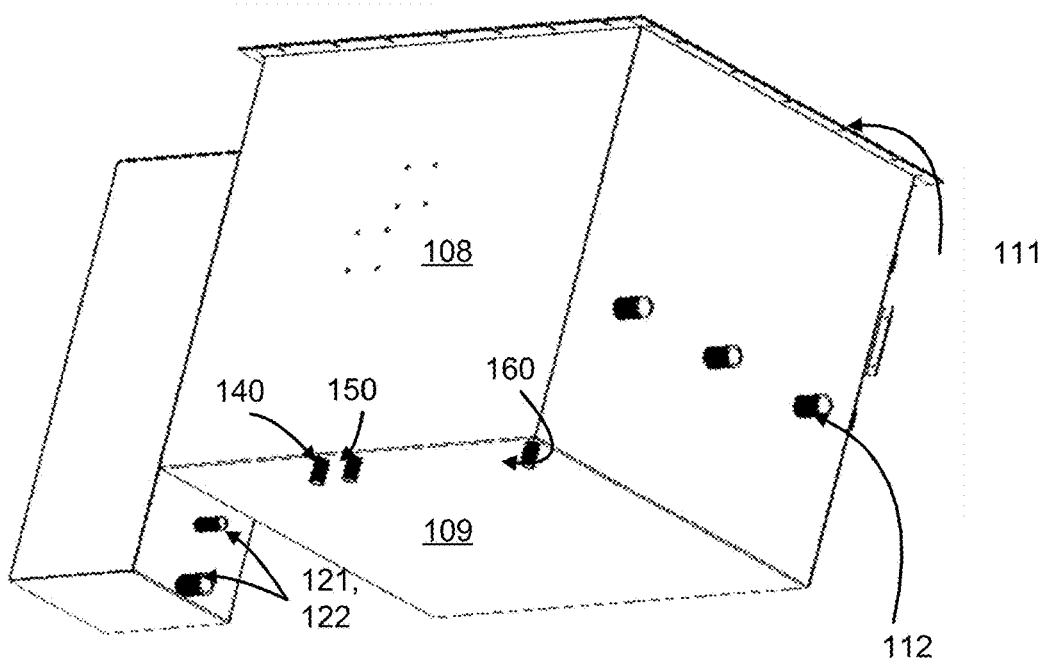
FIGURE 7C Tank – Rear Isometric View

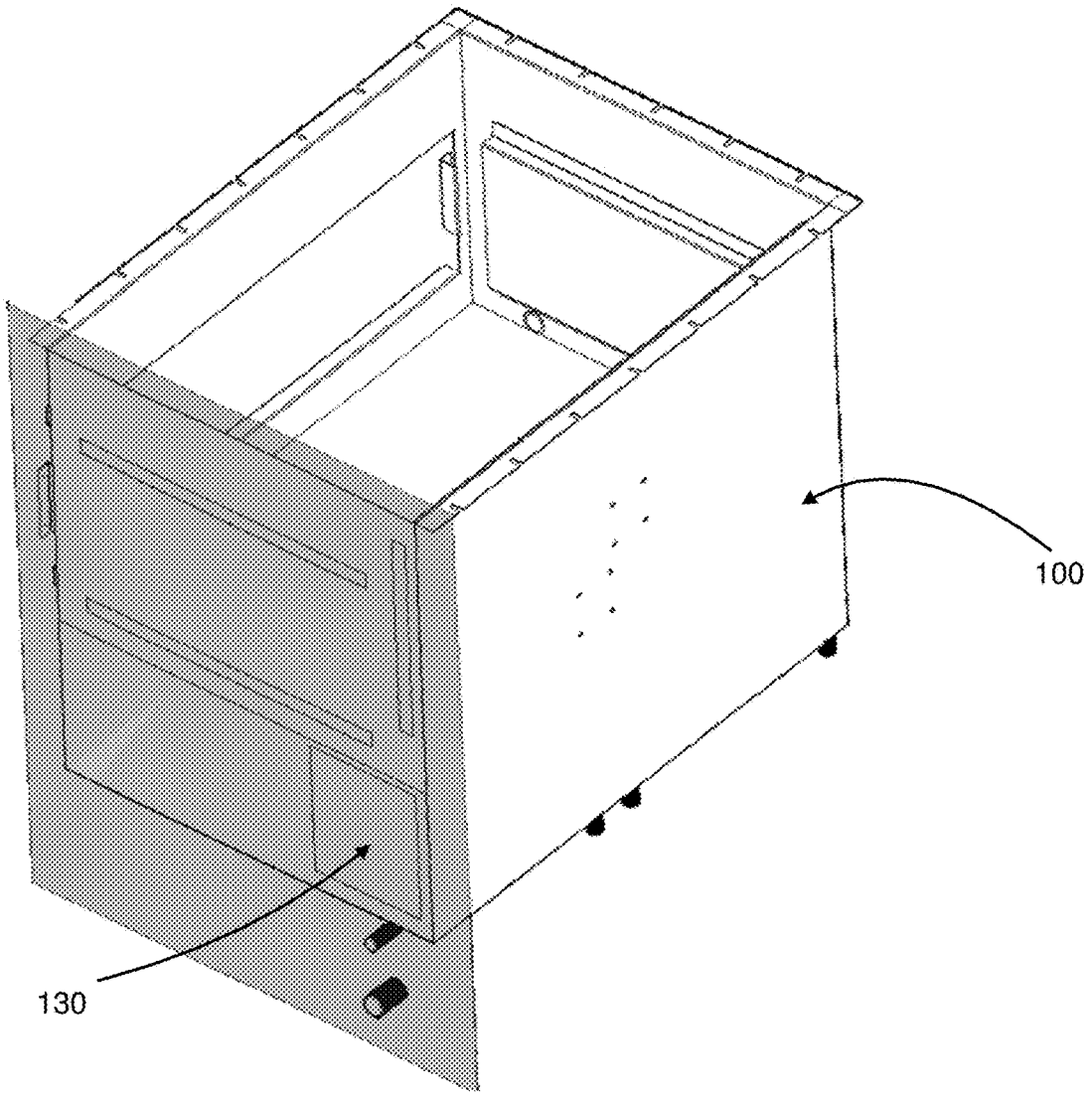
FIGURE 7D Tank – Section Isometric View Illustrating Coolant Passage

Drawers – Top and Bottom Views

Icemaker Assembly

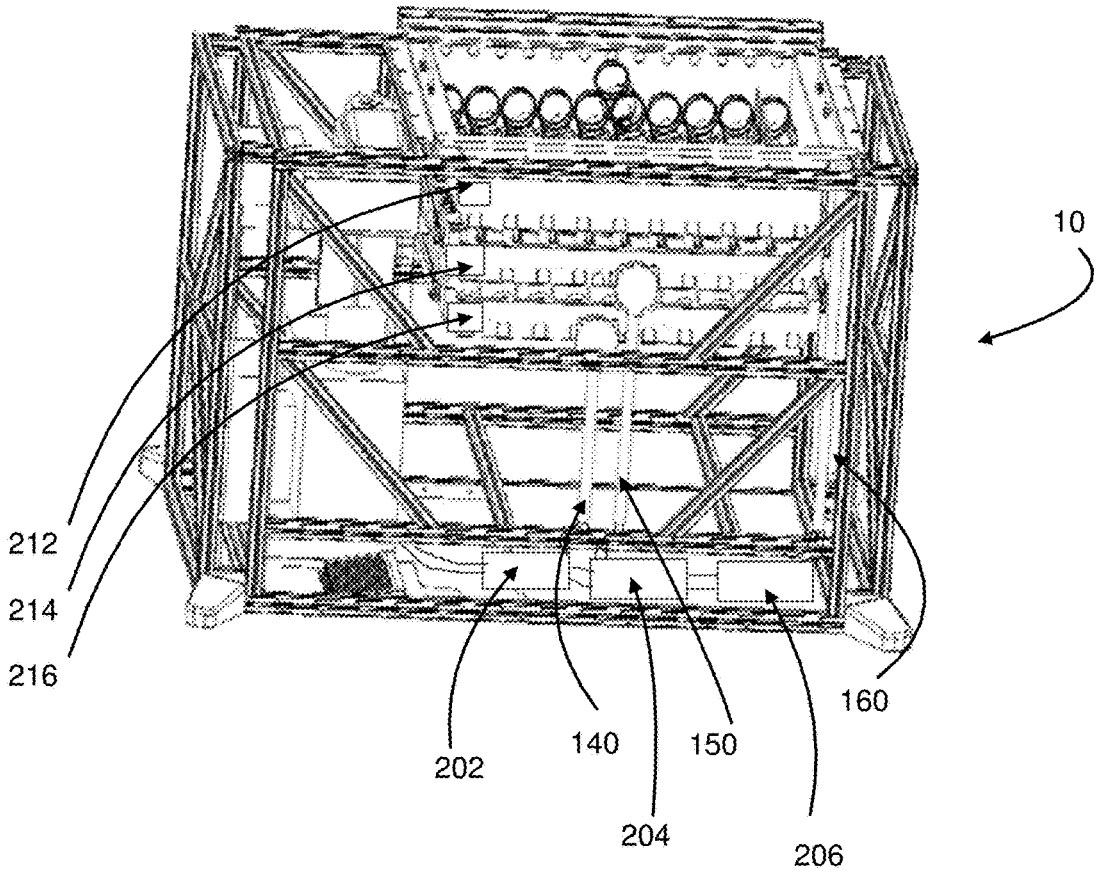
FIGURE 10 Rear View Showing Coolant Flow Conduits and Drawers

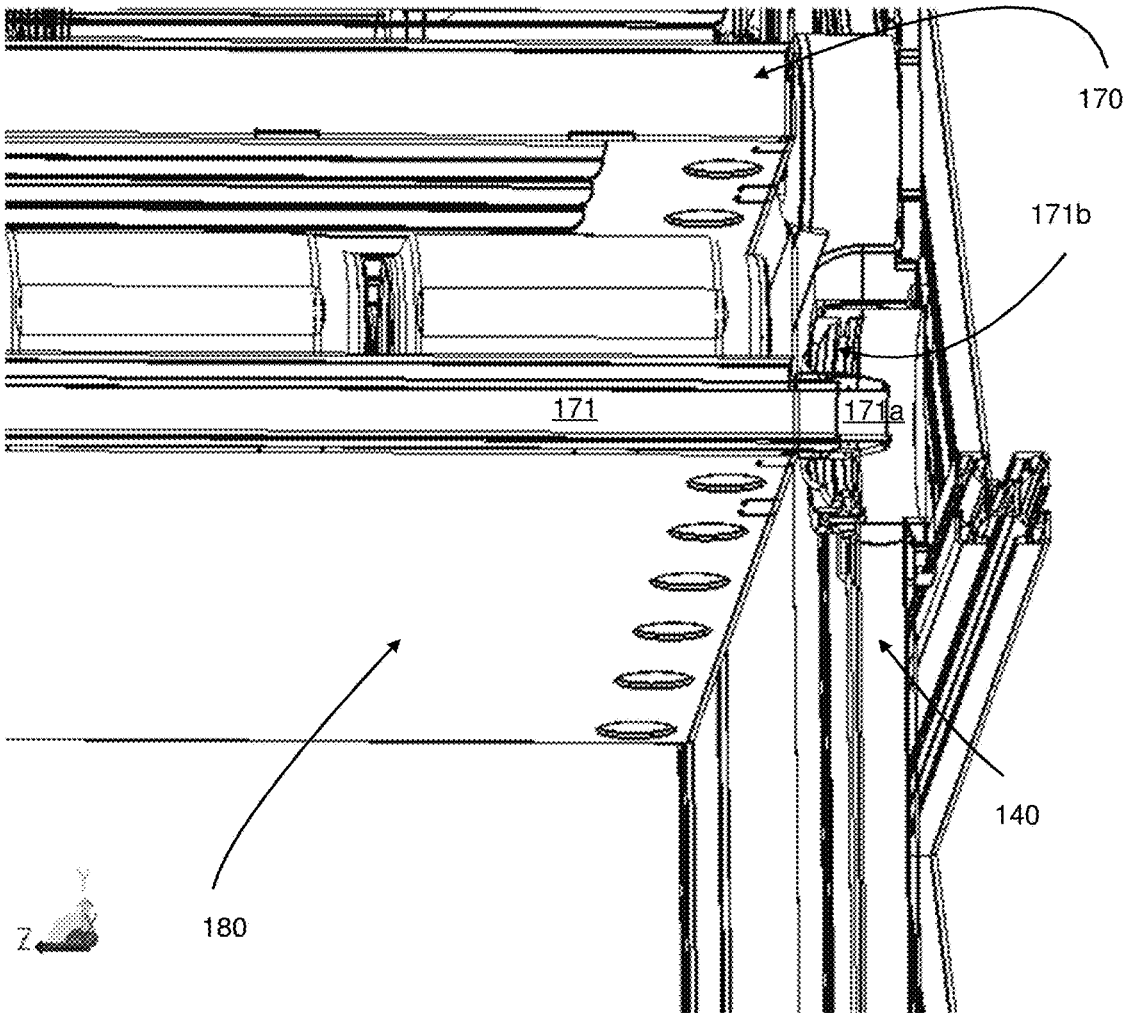
FIGURE 11 Section – Drawer Fluid Connection

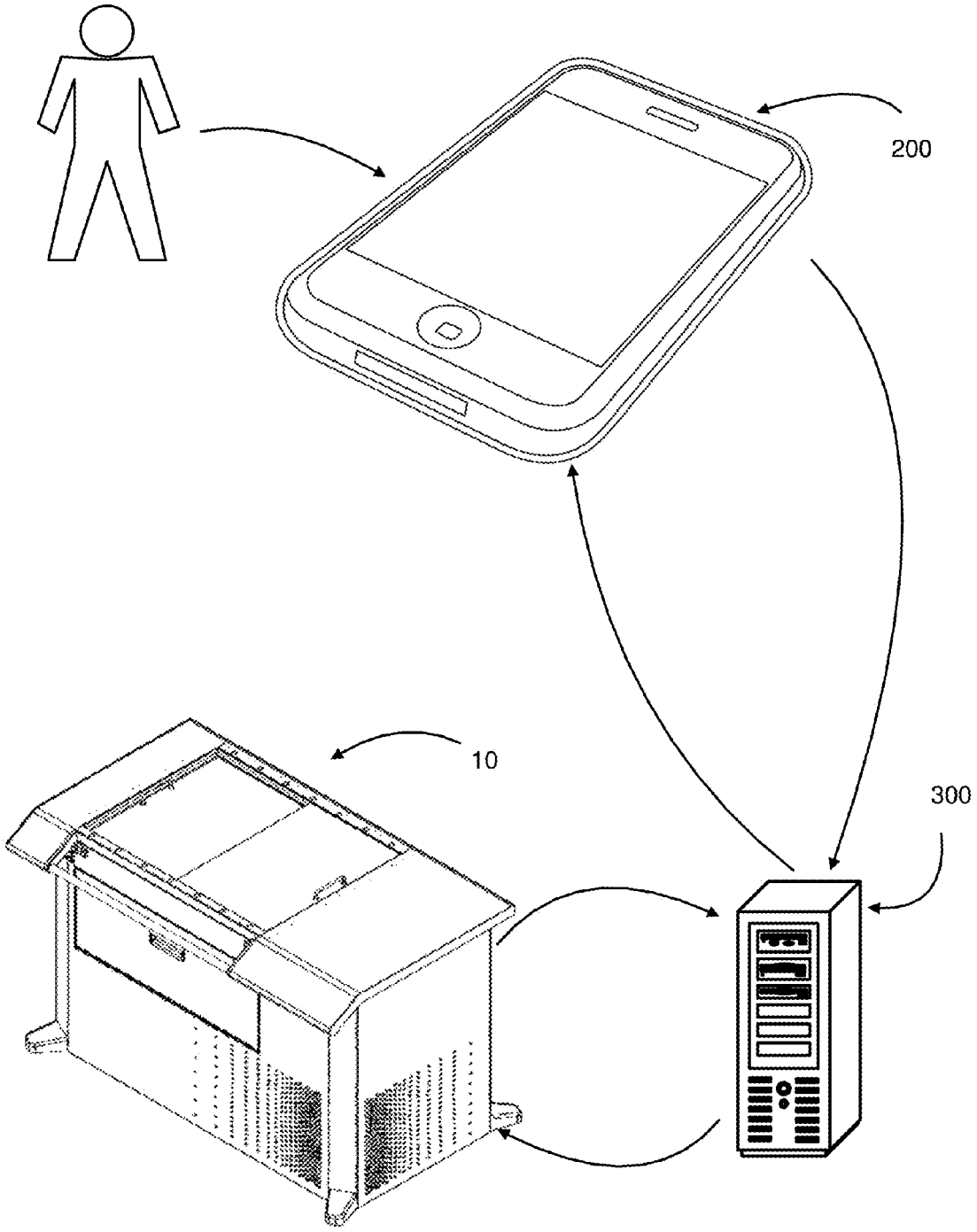
FIGURE 12 Data Flow Diagram

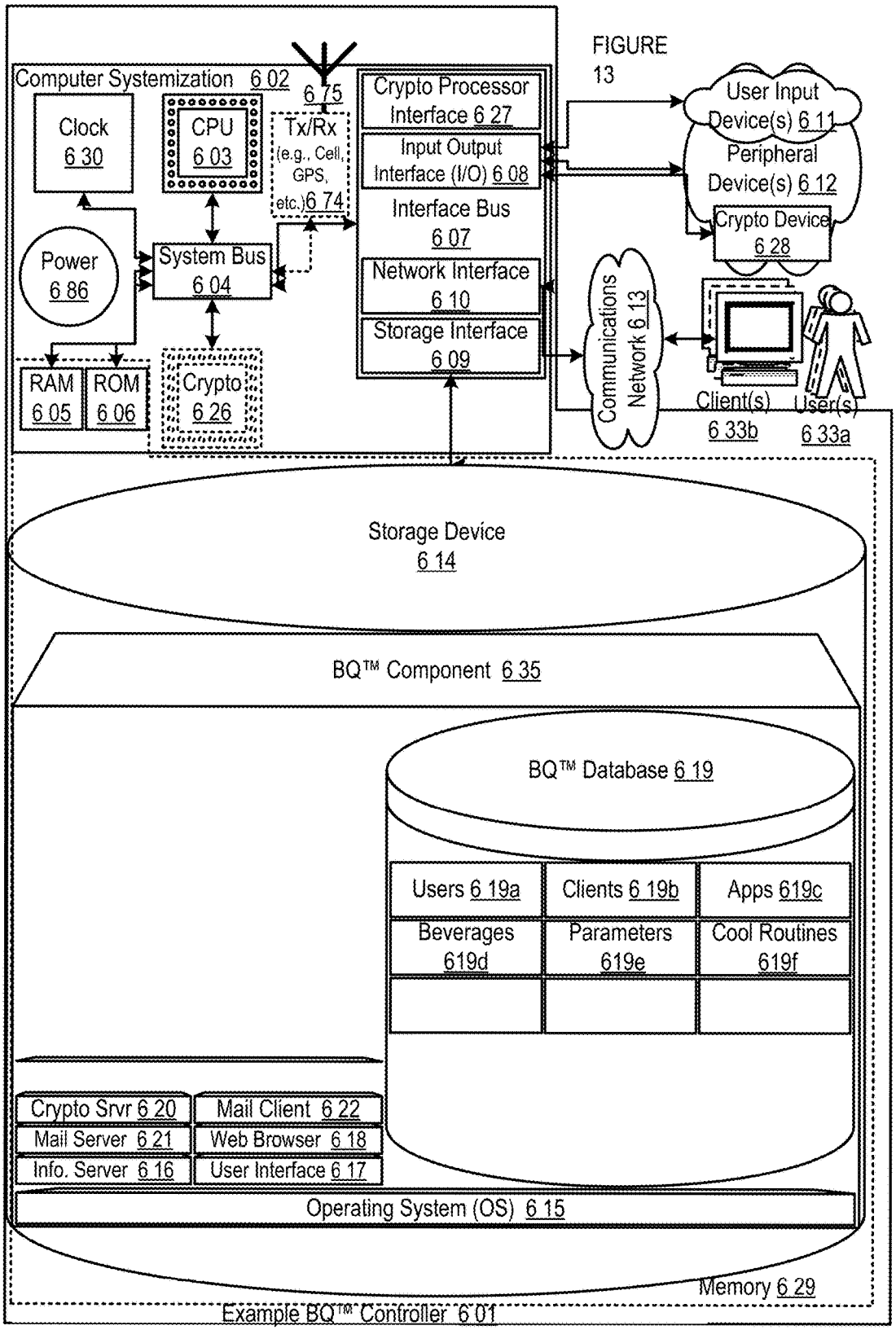
FIGURE 13
Computer Systemization 6 02
Clock 6 30
CPU 6 03
6 75
Tx/Rx (e.g., Cell, GPS, etc.) 6 74
Crypto Processor Interface 6 27
Input Output Interface (I/O) 6 08
Interface Bus 6 07
Network Interface 6 10
Storage Interface 6 09
User Input Device(s) 6 11
Peripheral Device(s) 6 12
Crypto Device 6 28
Power 6 86
System Bus 6 04
RAM 6 05
ROM 6 06
Crypto 6 26
Communications Network 6 13
Client(s) 6 33b
User(s) 6 33a
Storage Device 6 14
BQ™ Component 6 35
BQ™ Database 6 19
Users 6 19a
Clients 6 19b
Apps 619c
Beverages 619d
Parameters 619e
Cool Routines 619f
Crypto Srvr 6 20
Mail Client 6 22
Mail Server 6 21
Web Browser 6 18
Info. Server 6 16
User Interface 6 17
Operating System (OS) 6 15
Memory 6 29
Example BQ™ Controller 6 01

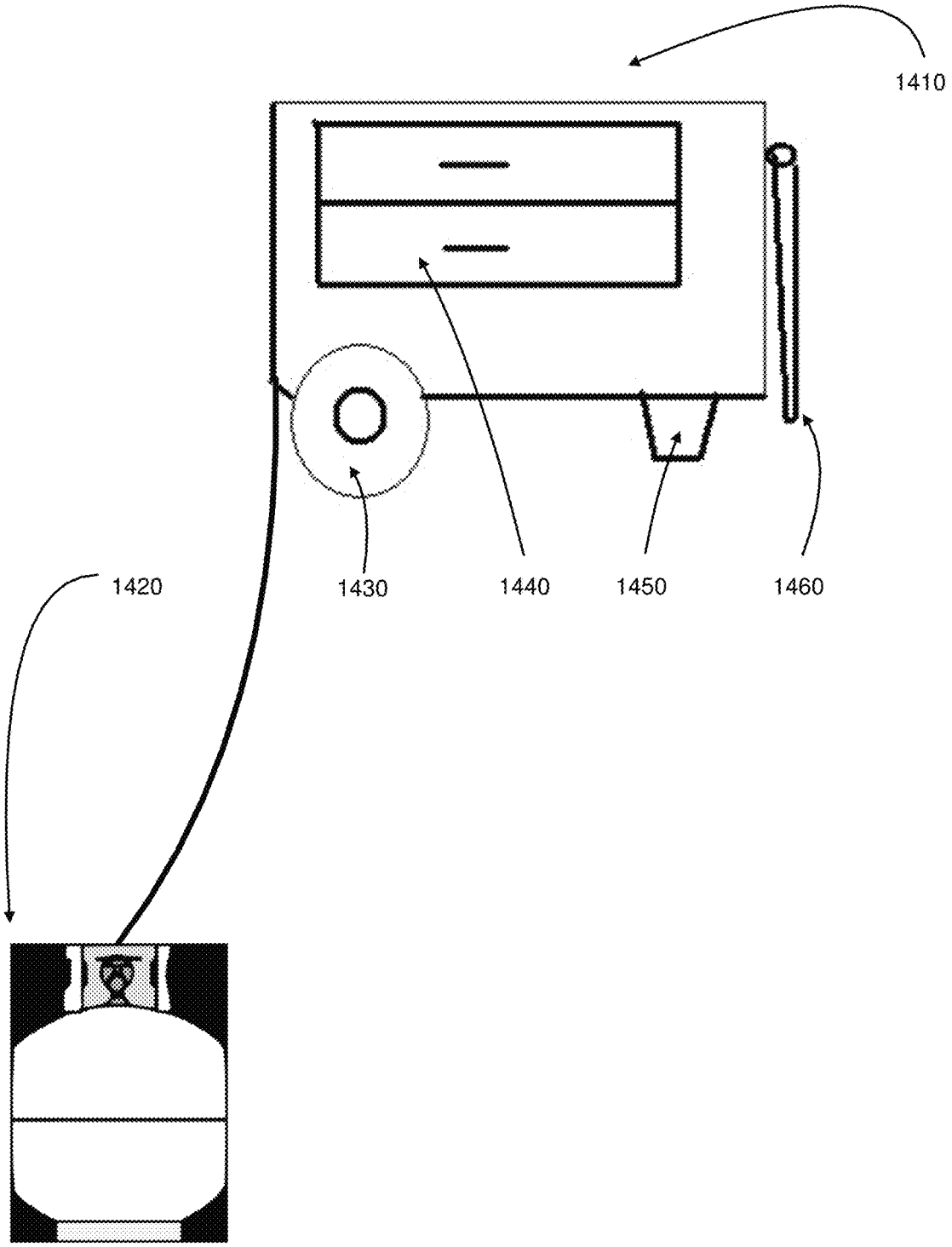
FIGURE 14 Portable Cooling Chest

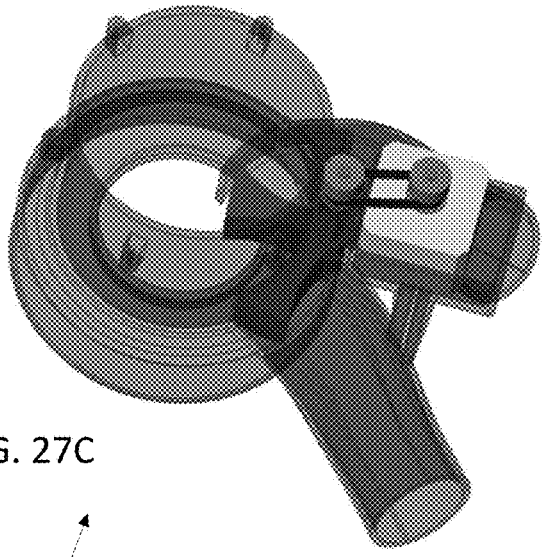
FIG. 27C
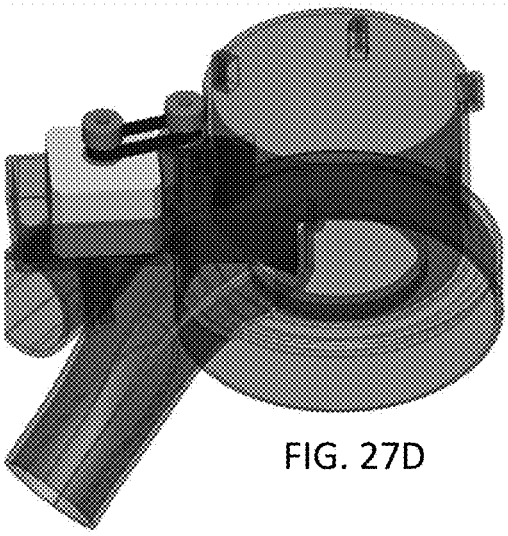
FIG. 27D
2700
FIG. 27E
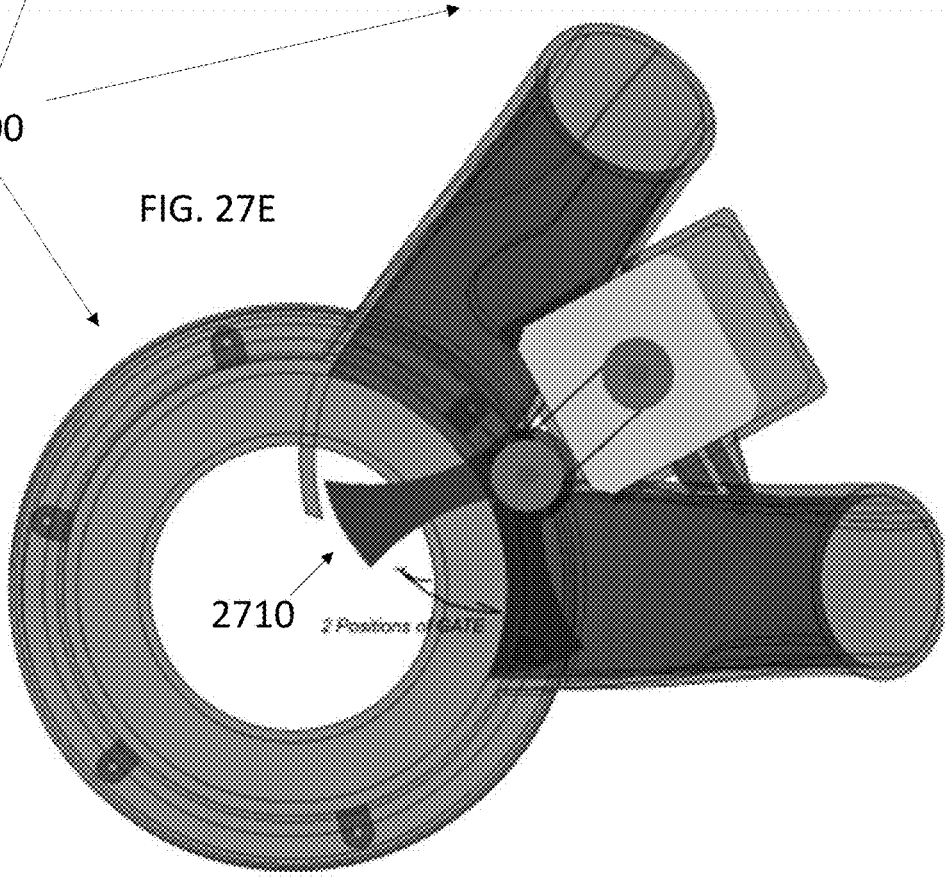

MODULAR RETROFIT QUENCH UNIT

CROSS-REFERENCE TO RELATED APPLICATIONS

This patent application claims the benefit of priority to and is a continuation of International Application No. PCT/US2017/037446, filed Jun. 14, 2017, which claims the benefit of priority to and is a continuation-in-part of U.S. patent application Ser. No. 15/272,131, filed Sep. 21, 2016 (U.S. Pat. No. 9,810,473), which in turn claims the benefit of priority to U.S. Provisional Patent Application Ser. No. 62/350,062, filed Jun. 14, 2016.

This patent application claims the benefit of priority to and is a continuation-in-part of U.S. patent application Ser. No. 15/272,131, filed Sep. 21, 2016 (U.S. Pat. No. 9,810,473), which in turn is a continuation in part of and claims the benefit of priority to U.S. patent application Ser. No. 14/877,143, filed Oct. 7, 2015 (abandoned), which in turn is a continuation-in-part of U.S. patent application Ser. No. 13/789,679, filed Mar. 8, 2013 (U.S. Pat. No. 9,200,831), which in turn claims the benefit of priority to U.S. Provisional Patent Application Ser. No. 61/745,033, filed Dec. 21, 2012.

This patent application claims the benefit of priority to and is a continuation-in-part of U.S. patent application Ser. No. 15/272,131, filed Sep. 21, 2016 (U.S. Pat. No. 9,810,473), which in turn is a continuation in part of and claims the benefit of priority to U.S. patent application Ser. No. 14/877,143, filed Oct. 7, 2015 (abandoned), which Claims Priority from Provisional Application No. 62/060,664, filed Oct. 7, 2014.

The subject matter of this patent application is also related to U.S. patent application Ser. No. 13/854,739, filed Apr. 1, 2013 (U.S. Pat. No. 8,549,871), U.S. Provisional Patent Application Ser. No. 61/798,394, filed Mar. 15, 2013, and U.S. Pat. No. 8,161,769, issued Apr. 24, 2012. The foregoing patent and patent applications are incorporated by reference herein in their entireties for any purpose whatsoever.

BACKGROUND

Field

The present disclosure relates to a refrigerated chest and related methods and machine readable programs for the quenching of beverages or other comestible items, particularly the rapid quenching of beverages to a pre-selected temperature and visual or other notification of when beverages are quenched to a certain temperature (i.e., ready to consume). The present disclosure also relates to mobile applications and other implementations for controlling such devices.

Description of Related Art

The use of traditional ice chests for cooling of beverages and maintaining the cooled temperature is well known in the prior art. However, the simple use of ice and water for these purposes has been problematic in that it can take thirty to sixty minutes to cool the beverages and the user has no way of visually determining when the drinks are cooled to the ideal temperature. In short, it has been difficult to determine if the beverages were sufficiently cooled or even overcooled, and further difficult to maintain the optimum temperature for prolonged periods after the optimum temperature has been achieved. Traditional ice chests have typically not provided the level of elegance and luxury sought by many of today's consumers, particularly those who pride themselves with extravagant outdoor grills and patios.

Moreover, users of ice chests have had to carry their own very heavy ice bags to such chests known in the art and fill those chests with ice. This ice melts to a point where the water becomes warm and turns once cool beverages to warm beverages. The present disclosure provides solutions for this and other problems, as described herein.

SUMMARY OF THE DISCLOSURE

In general, in a first aspect, the disclosure features a chest for quenching beverages. The chest includes a tank for holding a chilled mixture of ice and water and an ice maker adapted for making ice and having an output for ejecting ice into a conduit in fluid communication with the tank. The chest further includes at least one quench tray disposed proximate the tank for holding containers of beverages. The tray can be filled with cold water by way of a conduit in fluid communication with the tank. The at least one quench tray can include a compartment defined by a bottom and a plurality of walls. The at least one quench tray can similarly define therein a plurality of rows for aligning and containing a plurality of beverage containers. The at least one quench tray can further include at least one drain orifice configured to guide water out of the at least one quench tray.

In accordance with a further aspect, the at least one quench tray can include a pull out drawer mounted on a track. The pull out drawer can be adapted and configured to evacuate cooling water contained therein when the drawer is pulled outwardly from a retracted position. The at least one quench tray can define a plurality of openings therethrough for guiding water out of the quench tray. The at least one quench tray can defines the plurality of rows therein by way of a plurality of dividers including raised nodes configured for the placement of a plurality of containers of beverages therebetween. The dividers can include a grate that is configured to be received by a longitudinal groove formed along the base of the divider. The grate can be lifted out of the groove and rotated from an upwardly extending position to a horizontal resting position. The at least one quench tray can be accessible by way of an opening defined through a top surface of the chest. In some implementations, the at least one quench tray can be stationary. The chest can include a further (e.g., second, and so on) quench tray that is slidably mounted and configured to be pulled out through a side of the chest.

In accordance with a further aspect, the chest can further include a control system for controlling the cooling of the chest. If desired, the control system can be controlled manually via a control panel mounted on the chest. Additionally or alternatively, the control system can be adapted and configured to communicate with a control device over a computer network to facilitate control of the chest. The control device can be a smart phone, among other things. The flow of cold water to the at least one quench tray can be controlled by the control system in response to temperature data received from the at least one quench tray or due to a time based algorithm to periodically quench a drawer if it has not been quenched for some determinant period of time. If desired, the flow of cold water to the at least one quench tray can be controlled by the control system in response to accessing the at least one quench tray. The flow of cold water to the at least one quench tray can be controlled by the control system in response to data received from the at least one quench tray indicating that the contents of the at least one quench tray has changed.

In further accordance with the disclosure the at least one quench tray can include a plurality of temperature sensors in different locations across the at least one quench tray. The temperature sensors can be configured to provide temperature data to the controller. The controller can be configured to adjust the amount of cooling water directed to the at least one quench tray in response to temperature data received from the temperature sensors. In some implementations, sufficient sensors can be present in the at least one quench tray to indicate the temperature proximate each of a plurality of beverages.

In accordance with further aspects, cooling can be effectuated by directing a flow of chilled water over the beverage containers. In some embodiments, the flow of cooling water can cause the beverage containers to rotate in place to enhance heat transfer from the beverage containers to the cooling water. In accordance with some embodiments, the at least one quench tray can be disconnected from its source of cooling water when it is pulled outwardly from the retracted position. The source of cooling water for the at least one quench tray can include a fitment proximate the back of the at least one quench tray that is received by a cooling water supply line when the drawer is closed. In some embodiments, the chest can be configured to be powered by a gas tank. For example, the chest can be powered by a gas from the gas tank. The gas can include at least one of: propane, natural gas and ethanol. In some embodiments, the chest can be adapted to recapture chilled water for circulation of the chilled water into the ice maker. If desired, the chest can further include a plurality of wheels attached to the bottom wall of the cooling chest and/or a deployable handle for moving the cooling chest on the plurality of wheels.

In further implementations, the at least one quench tray can include at least one dump orifice located proximate a rear portion of the at least one quench tray that is adapted to slide over and be obstructed by a flange when the at least one quench tray is disposed in a retracted position to reduce the amount of cooling water passing out of the at least one quench tray through the at least one dump orifice. The at least one quench tray can include at least one tab defined by at least one perimetric groove disposed proximate a back face of the at least one quench tray, the at least one perimetric groove defining a perimeter of a flow orifice for evacuating cooling water from the at least one quench tray. If desired, the at least one tab can be bendable about a hinge portion to vary the area of the flow orifice. In some implementations, the at least one tab can be aligned with at least one opening in a backing plate that contacts the drawer to control the flow of cooling water through the at least one quench tray.

The disclosure further provides a chest for quenching beverages, including a tank for holding a chilled mixture of ice and water, and at least one quench tray disposed proximate the tank for holding containers of beverages filled with cold water by way of a conduit in fluid communication with the tank, the at least one quench tray including a compartment defined by a bottom and a plurality of walls, and defining therein a plurality of rows for aligning and containing a plurality of beverage containers, the at least one quench tray further including at least one drain orifice configured to guide water out of the at least one quench tray. If desired, the chest can include one or more of an introduction port for introducing ice into the tank to chill the water, and a cooling coil for removing heat from the chilled mixture of ice and water.

The disclosure further provides a modular retrofit device for quenching at least one beverage. The device includes a quench container adapted and configured to be removably positioned at least partially within a thermally insulated cooler having a cooled water bath. The quench container includes at least one space configured for holding at least one beverage container. The device further includes a pump coupled to and removable with the quench container, and a conduit coupled so as to be in fluid communication with the quench container, the pump, and the cooled water bath of the thermally insulated cooler. The conduit is preferably removable with the pump and the quench container as a single unit. Activation of the pump is operative to draw water from the water level of the cooled water bath of the thermally insulated cooler into the quench container and direct the cooled water over the at least one beverage container disposed in the quench container.

In some implementations, the device further includes a lighting device operative to emit a color corresponding to a state of a quench cycle determined by how much time has elapsed during device operation. The quench container can include a weir operative to set a predetermined water level in the quench container, the weir defining at least one opening therethrough to promote continuous water flow through the quench container during a quench cycle. The pump can be operably coupled to an electronics assembly module that includes a removable battery. The electronics assembly module can also be removable with the quench container and pump as the single unit. The electronics assembly module can include an electric motor drive that is coupled to at least one drive axle for causing the at least one beverage to rotate. The at least one drive axle can include a plurality of wheels for engaging the at least one beverage to cause the at least one beverage to rotate while being cooled with cooling water from the bath. The at least one drive axle can include a helical member for causing rotation of the at least one beverage that is placed parallel or perpendicular to the at least one drive axle. The device can further include at least one support that can be selectively adjusted to alter the overall dimensions of the device to fit thermally insulated coolers of different dimensions. The cooling container can be defined by a generally vertical peripheral wall with a sloped base plate, the sloped base plate having a drain orifice in a lower portion thereof. The quench container can be configured to hold a plurality of beverages. The device can further include at least one level sensor operably coupled to the pump. The device can be configured to shut off the pump in response to an input from the at least one level sensor. The device can include at least one photodetector configured and arranged to be selectively exposed to light originating from outside the thermally insulated cooler, and a controller operably coupled to the pump and to the photodetector, the controller being configured to shut off the pump in response to receiving a signal from the at least one photodetector.

The disclosure also provides a thermally insulated cooler that includes a thermally insulated exterior housing defining a reservoir therein configured to contain a cooled water bath, at least one liquid pump, at least one liquid conduit, and at least one quench container disposed at least partially within the thermally insulated exterior housing, the at least one quench container being configured and arranged to be in fluid communication with the liquid pump and the at least one conduit, the at least one quench container being disposed above the reservoir, the at least one quench container defining at least one beverage container space therein for holding and cooling at least one beverage container, wherein activation of the pump causes water to be drawn from the cooled water bath of the reservoir and directed through the at least one conduit into the at least one quench container, the at least one quench container being further configured and arranged to direct the water from the cooled water bath via the pump over the at least one beverage container in the at least one beverage container space to enhance cooling of a beverage in the at least one beverage container.

If desired, the quench container can include at least one driven drive axle including a plurality of wheels disposed thereon for engaging the at least one beverage container to cause the at least one beverage container to rotate while being cooled with water from the cooled water bath. The thermally insulated cooler can include at least one level sensor configured and arranged to detect the physical orientation of the thermally insulated cooler. The thermally insulated cooler can include a controller operably coupled to the pump and to the level sensor, the controller being configured to shut off the pump in response to a signal from the at least one level sensor. The at least one quench container can be disposed in a lid, or other portion of the thermally insulated cooler. In some implementations, the at least one beverage container space can include at least one of said drive wheels for causing rotation of the at least one beverage container about a central axis of the at least one beverage container while cooling water is being directed over the at least one beverage container.

The at least one beverage container space can be configured to permit the at least one beverage container to lay horizontally while it is being rotated and cooled. The at least one quench container can be defined by a generally vertical peripheral wall with a sloped base plate, the sloped base plate having a drain orifice in a lower portion thereof. The pump can be operably coupled to an electronics assembly that includes a removable battery. The electronics assembly can include an electric motor drive that is coupled to the at least one drive axle for causing the at least one drive wheel to rotate. If desired, the quench container can be configured to hold a plurality of beverage containers at the same time.

The above advantages and features are of representative embodiments only, and are presented only to assist in understanding the disclosure. It should be understood that these are not to be considered limitations on the disclosure as defined by the claims. Additional features and advantages of embodiments of the disclosure will become apparent in the following description, from the drawings, and from the claims.

DESCRIPTION OF THE DRAWINGS

Further objects and advantages of the disclosure will become apparent from the following description and from the accompanying drawings, wherein:

FIGS. 2A-2C are perspective views of the cooling chest of an embodiment of the present disclosure, shown with the top access doors removed, as well as illustrating upper and lower views of the top access doors.

FIGS. 5A-5C illustrate the cooling chest of FIG. 1 with side panels removed, revealing inner components of the cooling chest, as well as top countertop components of the cooling chest.

FIG. 6 is an isometric view of the cooling chest of FIG. 1 with all external paneling removed to illustrate interior portions of the cooling chest.

FIGS. 7A-7D are isometric views of an inner tank portion of the cooling chest of FIG. 1.

FIG. 10 is a rear view of the cooling chest of FIG. 1, illustrating cooling water delivery tubes that feed into and cool the trays of the cooling chest.

FIG. 11 is a cross-sectional view of the drawer of FIG. 8, showing details of a fluid connector to direct cooling water into the drawer.

FIG. 12 is a data flow diagram illustrating a system for controlling a cooling chest by way of a remote or mobile device in accordance with the present disclosure.

FIG. 13 is a schematic view illustrating aspects of an exemplary system in accordance with the present disclosure.

FIG. 14 is a schematic view illustrating a portable embodiment of a cooling chest in accordance with the disclosure.

FIGS. 27A-27E present various views of an illustrative ice diverter in accordance with the present disclosure.

DETAILED DESCRIPTION OF THE PREFERRED EMBODIMENTS

Figures 1A, 1B, 1C:
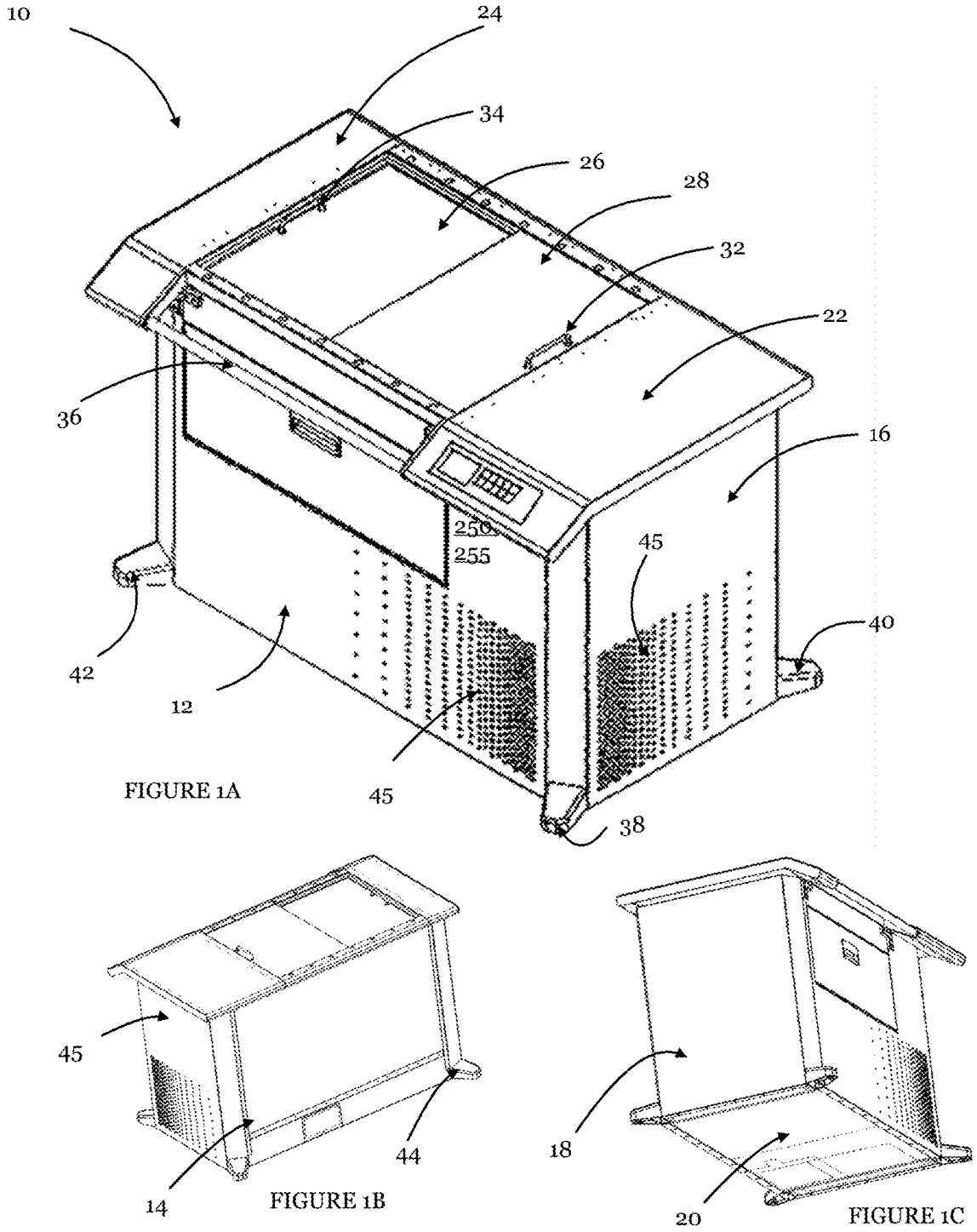
FIGS. 1A-1C are perspective views of an illustrative embodiment of a cooling chest in accordance with the present disclosure, shown with top and side access doors closed.

Referring now to the drawings in detail wherein like numerals indicate like elements throughout the several views, one sees from the various drawings that the cooling chest 10 includes a front wall 12, a rear wall 14, side walls 16, 18 and a bottom wall, 20, all in relatively fixed locations thereby forming an interior cooling volume 8. The cooling chest 10 also includes a right side counter 22 (as shown in FIGS. 2B, 2C and 5B) and a left side counter 24 on the top surface of the cooling chest 10 (as shown in FIGS. 1A and 5C). The top surface of the chest also includes dual top lids or access doors, 26, 28 which can be in the closed position as shown in FIG. 1 or in an open position wherein one door slides along the top or bottom of the other, respectively. The perimeter of the opening containing the doors includes a suitable gasket to prevent heat inflow. Similarly, a generally linear gasket is located along an edge of one of the doors 26, 28 for abutting against an edge of the other door, thus providing a cooling gasket at the junction of the two doors 26, 28 when the chest is closed.

The dual top lids or access doors, 26, 28 each includes its own handle 32, 34 which allow for the access doors to be lifted up and/or slid, as desired so that the doors can overlap. In one embodiment, the doors can be hinged at the sides and opened from center mounted handles. In another embodiment, the handles, 32, 34 can be used to slide each access door 26, 28 on corresponding tracks (not shown) located on the interior of the lateral edges of the rear wall 14. Preferably, a linear gasket is used at the edge of one of the doors 26, 28 to provide sealing against the adjacent door when the doors are closed, and a perimeter seal is provided around the opening in which the doors are situated in order to reduce heat transfer in that location.

A handle 36 connects the right side counter 22 and the left side counter 24 of the cooling chest 10. If desired, handle 36 can merely serve the function of providing a means to move the cooling chest 10. In another embodiment, the entire top assembly of cooling chest 10 can be hinged at the back of the top of the cooling chest, and the handle can be lifted to access beverages and to examine and maintain the interior portion of the cooling chest. The front wall 12 as illustrated in FIG. 1 contains a front access door 30 with a latch 36 which when pulled, can be opened downward. As illustrated, the bottom wall 20 of the cooling chest 10 includes protrusions or pegs, 38, 40, 42, 44 that extend from each corner, and that may include castors or wheels, as desired (not shown). Pegs 38, 40, 42, 44 act to enhance stability of the cooling chest 10 (such as during movement and transport), and also act to prevent the cooling chest 10 from being moved too closely to a wall to permit ventilation clearance for the cooling chest 10. Ventilation perforation sections 45 or screening, as desired, are provided in each side panel to permit air circulation to facilitate cooling of the icemaker and the refrigeration process. As illustrated, perforation sections 45 include perforations in a pattern of varying density from left to right. It will be appreciated though that any suitable types of perforations, louvers, screens or the like are suitable.

The walls 12-20 and access doors 26-30 can be formed from a variety of materials, such as aluminum, stainless steel, painted sheet metal, injection molded plastic or composite materials, fiber reinforced resin materials and the like in order to provide a sleek, elegant appearance, while maintaining the desired temperature insulating capabilities. Those skilled in the art will recognize that these materials are merely illustrative and not intended to be exhaustive.

As further shown in FIG. 2A, the cooling chest 10 may contain a plurality of beverage containers in its interior cooling volume 8. In FIG. 2, beverage containers are neatly packed and located in the upper quench tray 46 and may be similarly situated in two lower trays, as illustrated and as discussed in further detail below. Such beverage containers can be accessible by the opening or removal of the dual top lids or access doors, 26, 28. Likewise, beverage containers can be loaded into the upper quench tray 46 when the dual top lids or access doors, 26, 28 are slid open or removed as is illustrated in FIG. 2. FIG. 2B illustrates the top view of the dual top lids or access doors 26, 28. FIG. 2*c* illustrates the bottom view of the dual top lids or access doors 26, 28.

Figure 3A:
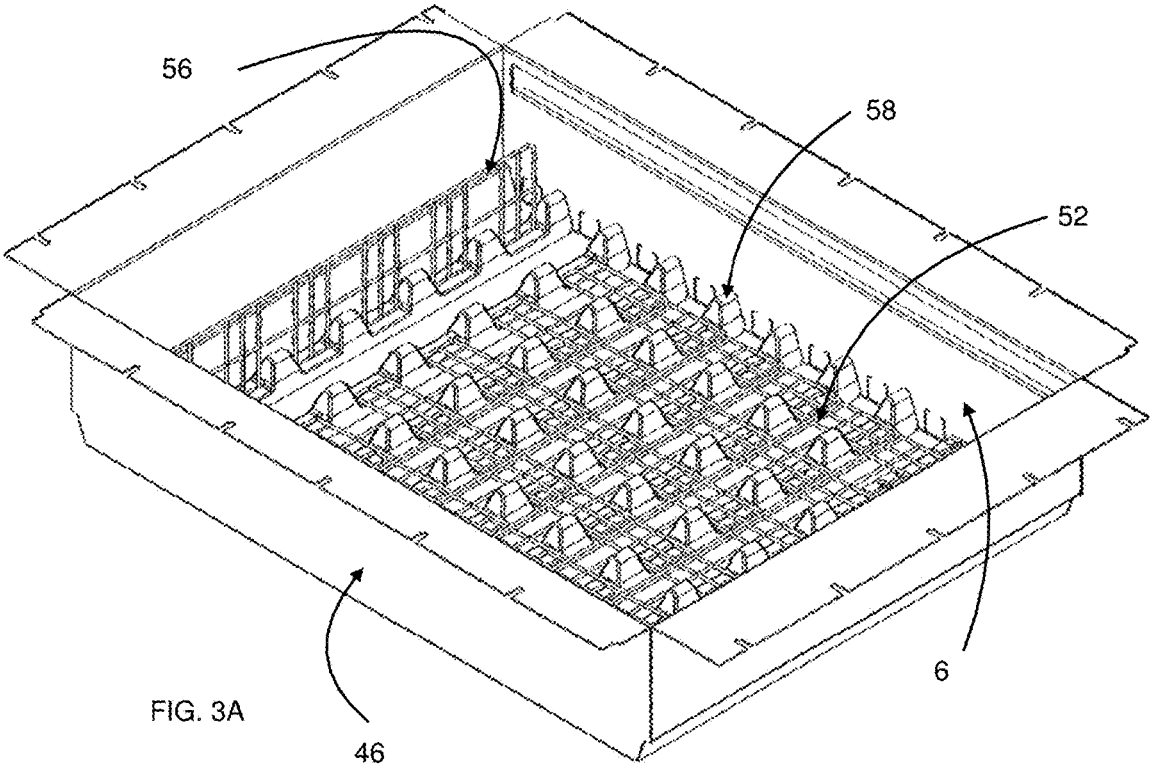
FIGS. 3A-3B include perspective views of a top tray of the cooling chest of FIG. 1 illustrating aspects of beverage separators in the top tray and the top tray with the aforementioned structures removed.
Figure 3B:
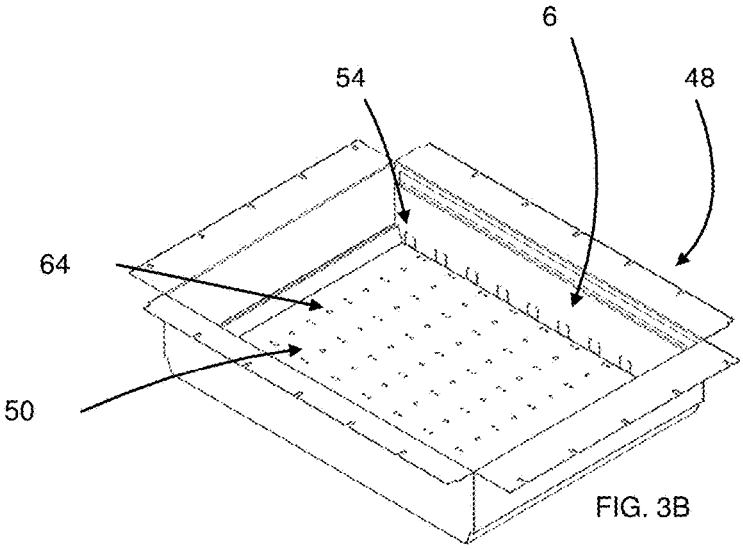

As illustrated in FIG. 3, the upper quench tray 46 includes an empty rectangular bin 48 with a hollow interior designed to hold a generous quantity of beverage containers. The bottom surface 50 of the upper quench tray 46 can include a plurality of pairs of rows that in turn include pairs of openings 64 which allow for tray dividers 52 to be attached to the upper quench tray 46. Each row culminates into openings 54 defined by a parametric slit located on the rear interior wall 6 of the upper quench tray 46 which allows for water be guided out of the quench tray. The upper quench tray 46 can be made from a plastic, metal and/or composite materials, as desired.

FIG. 3A shows the upper quench tray 46 fitted with a plurality of tray dividers 52, which are further illustrated in FIGS. 4A-4D. Each tray divider 52 can be provided with an adjustable grate 56 that may be disposed in an upright position is shown, or lifted slightly and rotated and dropped to one side, if desired, to make room for larger beverage containers. Beverage containers loaded into the upper quench tray 46 are laid against the grate 56 when the grate 56 is in the upright position as shown in FIG. 3A. The grate 56 in the upright position as shown in FIG. 3A allows for the beverage containers to also be removed from the cooling chest 10. The design of the grate 56 allows for the fitting of the grate 56 in between the raised nodes 58 of the tray dividers 52. The fitting of the grate 56 allows for the adjustability and raising of the grate 56 from a flat position to an upright position. As the upper quench tray 46 is continuously filled with cooling water by the cooling chest (as discussed below), the beverage containers are allowed to lie flat and ultimately submerged in the cooling water of the upper quench tray 46. The grates 56 can be made from plastic, metal and/or composite materials, as desired.

Figure 4A:
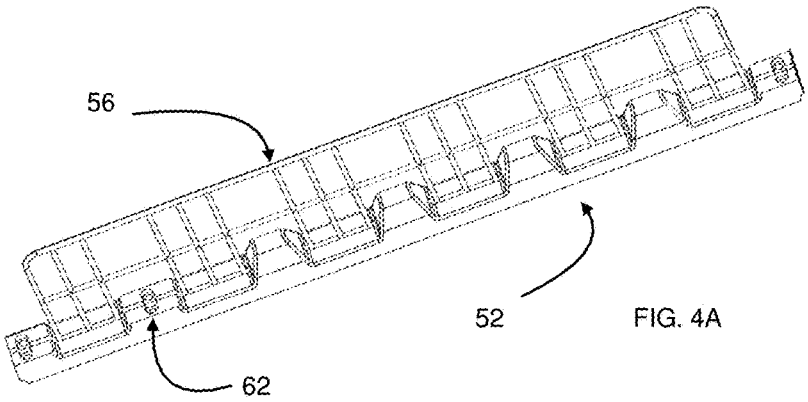
FIGS. 4A-4D illustrate views of aspects of a tray divider in accordance with the present disclosure.
Figure 4B:
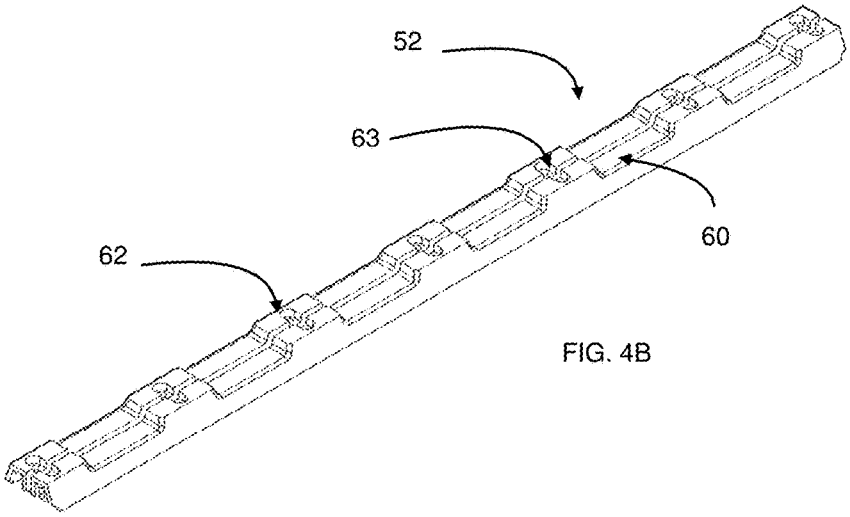
Figure 4C:
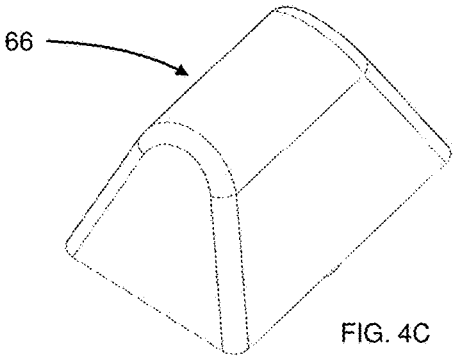
Figure 4D:
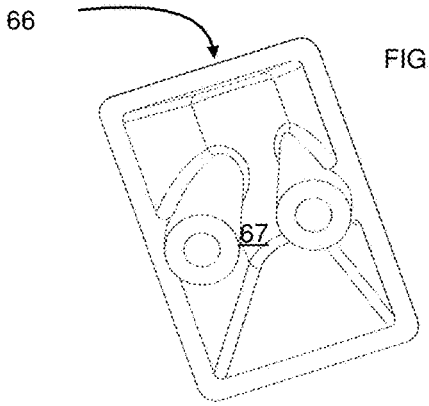

As mentioned above, FIGS. 4A-4D illustrate a single tray divider 52, or components thereof before it is fitted into the upper quench tray 46. Tray dividers contain a linear center groove 60 spanning the length of the tray divider 52. The groove 60 is designed to receive the grate 56 in a generally vertical orientation. Tray dividers 52 also contain a plurality of raised divider portions, or bosses, 62 which contain a pair of recesses 63 on either side of center groove 60 that correspond to pair of bosses 67 located on the bottom surface of the raised nodes 66. FIG. 4B illustrates a bottom rail portion of the tray divider 52. FIGS. 4C-4D illustrate upper and lower views of the raised nodes 66 which attach to the lower portion of the tray divider 52 via bosses 67 in the bottom of the nodes interfitting with recesses 63 such as by interference fit, adhesive or welding, for example. The raised nodes help retain the grate 56 in place and to permit rotation of the grate 56 to permit the grate 56 to be rotated and pulled up into its upright position as well as flat position. Tray dividers 52 and the raised nodes 66 can be made from plastic, metal and/or composite materials, as desired.

FIG. 5A illustrates the cooling chest 10 with all of it side panels removed exposing, for example, pull out drawers 170, 180 and ice maker assembly 68. FIG. 6 illustrates the cooling chest and its interior components. The interior of the cooling chest, as illustrated, includes a chassis 190 for housing various components not shown including pipes, pumps and/or tubes for the delivery cold water from the tank 100 (as illustrated in FIGS. 7A-7D) to each of the three illustrated quench trays discussed elsewhere herein. Chassis 190 also provides a support for the exterior paneling of the cooling chest. While a particular chassis 190 is illustrated, it will be appreciated by those of skill in the art that a variety of structures can be used in place of chassis 190. For example, a stamped metal or blow molded composite chassis 190 can be provided for housing system components as typically with appliances.

As illustrated in FIGS. 7A-7D the tank 100 is generally rectangular in shape, and includes a front wall 102, a left wall 104, a right wall 106, a back wall 108 and a bottom 109, which cooperate in part to define a lower tank portion 110 extending from the bottom 108 of the tank to three water conduits 112 on the left side of the tank 100 as illustrated in FIG. 7B. Tank 100 defines an upper peripheral flange 111 at its upper extremity at the top of each of the front, back, left and right walls, and thus defines a horizontally oriented rectangular opening at the top of the tank. As illustrated, upper peripheral flange 111 of tank 100 is adapted and configured to rest on crossmembers forming the chassis 190.

Tank 100 contains therein a backing plate 100*c* including two horizontally oriented flanges or shelves 100*a* and a plurality of openings 100*b* of different shapes and sizes. The backing plate 100*c* acts as a rear stop for drawers 170, 180, and each shelf 100*a* is adapted to snugly fit with the rear lower surface of each drawer 170, 180.

The front wall 102 of tank 100 similarly defines a generally rectangular opening 114 in the front thereof for permitting the passage of two pull-out quench drawers 170, 180 therethrough. As illustrated in FIG. 7A, the right side of tank 100 includes an extension 120 having a J-shaped cross section (taken in a horizontal plane) defining an elongate vertical gap 121 between an edge of the extension 120 and the right wall 106 of the tank 100 for receiving and mating with the ice maker 68, discussed below. Tank further defines a rectangular opening 130 in its right side for aligning with the icemaker assembly 68 as illustrated in FIG. 7D.

In accordance with one aspect of the present disclosure, the cooling chest 10 includes an ice maker assembly 68 that allows for the continuous production of ice which in turn allows for the continuous production and flow of cold water over the ice situated in the vertical hopper 68*a*, discussed in detail below. A suitable icemaker assembly should be able to produce between about 10 and 100 pounds of ice per hour, for example. The ice maker is adapted to interfit with the J-shaped extension 120 on the tank 100 to define a vertical hopper 68*a* with a generally rectangular cross section for receiving ice made by the ice maker.

The continuous flow of cold water over the ice in the hopper 68*a* allows for the continuous cooling of beverage containers located in the plurality of quenching trays. The continuous flow may be interrupted at any point by turning off pump(s) (not shown) located underneath the tank 100 and above the bottom of the cooler 10 that are used to circulate cooling water through the cooler, which may be thermally insulated. Turning off the pumps can be achieved manually through a switch, such as by a switch that is activated when a drawer is pulled out, or when one of the top doors 26, 28 is opened.

The ice maker 68 is adapted to make ice, filling up the hopper 68*a* until reaching an upper limit switch (not shown). The limit switch can be a mechanical arm and switch as known in the art that deactivates the ice maker 68 when a predetermined ice level is reached, or may alternatively include an electric eye that deactivates the ice maker when the desired level is reached. The bottom of the hopper 68*a* is in fluid communication with the bottom of the tank by way of rectangular opening 130 in the bottom of the tank 100. Water in the bottom of the tank 100 can flow into the bottom of the hopper 68*a* and is cooled by the column of ice. Ice can similarly migrate into the lower portion 110 of tank by way of opening 130, if desired. Water can be circulated, for example, by directing cold water out of one of the conduits 121, 122 at the bottom of the hopper 68*a*, through one or more pumps (not shown), and up into conduits 140, 150, 160 for feeding the lower, middle, and upper trays of the thermally insulated cooler, respectively and/or back into the tank 100 by way of conduits 112 on the left side 104 of the tank 100. Conduits 112 can similarly be used to regulate the level of water in tank 100 by causing overflow that reaches the conduits to be directed to a drain and/or reservoir, as desired.

Figure 8A:
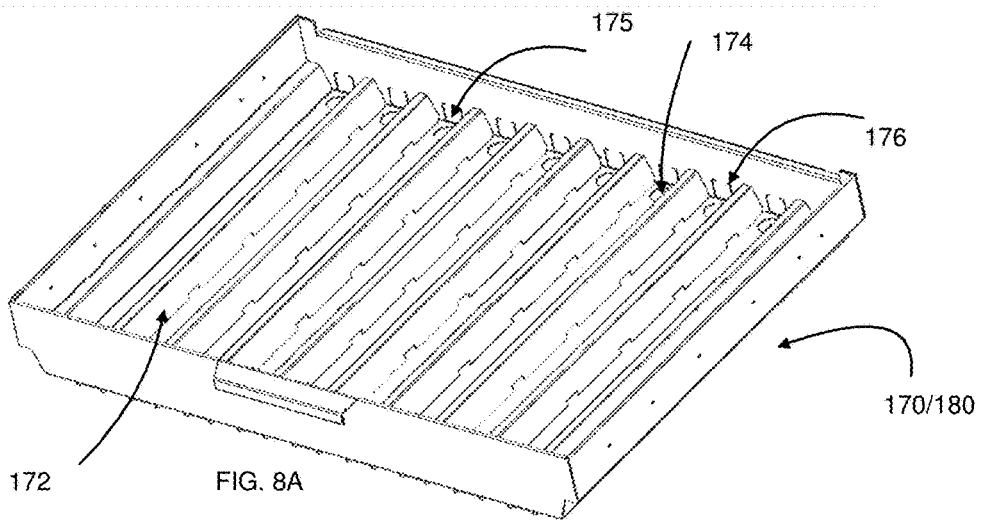
FIGS. 8A-8B are views of an exemplary displaceable drawer for use within the cooling chest of FIG. 1, illustrating tray dividers and openings for guiding cooling water.
Figure 8B:
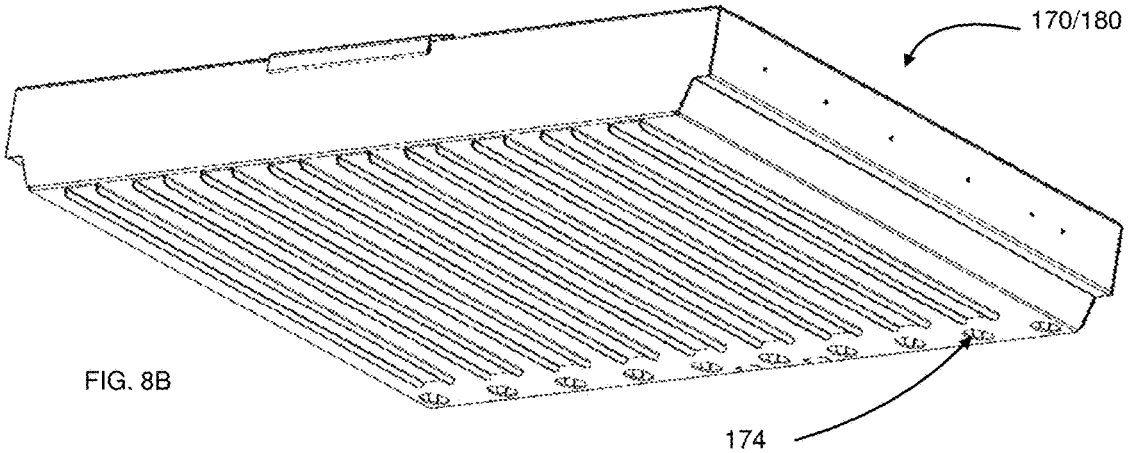
Figure 9A:
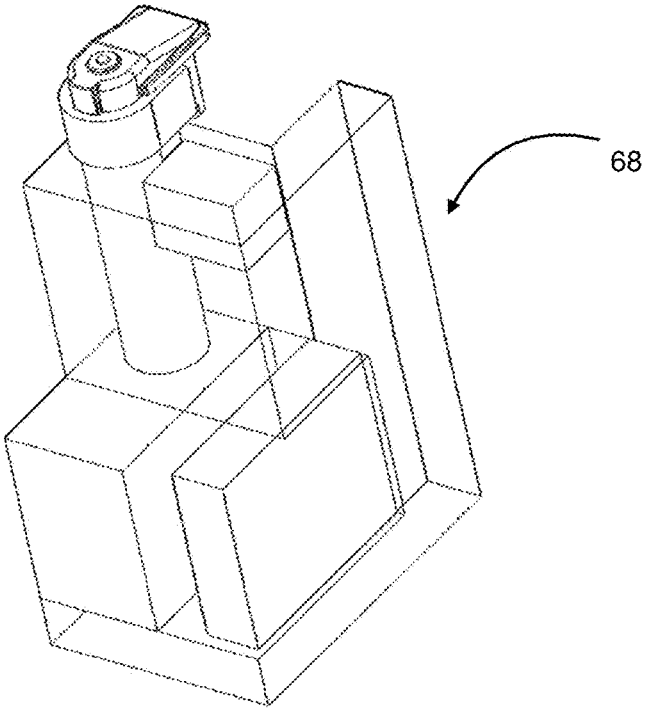
FIGS. 9A-9B are isometric views of an icemaker assembly component of the cooling chest of FIG. 1.
Figure 9B:
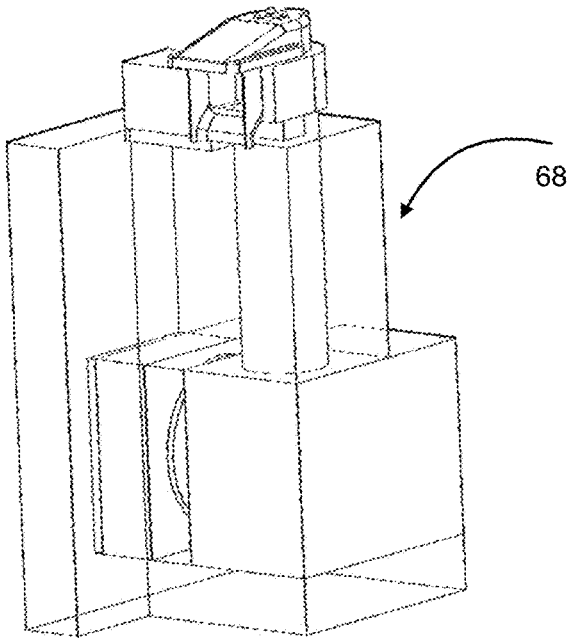

Top and bottom views of the middle and lower quench trays or drawers 170, 180 are illustrated in FIG. 8. The drawers can be essentially identical or may differ as desired. Each drawer 170, 180 can have dividers similar to the upper quench tray 46 with collapsible gratings, as desired. As illustrated, longitudinal dividers 172 run from the back of the drawer to the front of the drawer inside of the drawer, and longitudinally oriented C-channels are attached to the bottom of the drawers for additional support. A conduit 171 can be provided within one of the dividers 172 (as illustrated in FIG. 11) for directing cooling water from an input at the back of the drawer up to the front of the drawer. Alternatively, water may simply enter the drawer from the back of the drawer. The cooling water thus can be directed into the front of the drawer and flow backward over the beverage containers. The rate of cooling can thus be controlled by controlling the flow of chilled water over the beverage containers to enhance the rate of heat transfer to a desired extent. It will be appreciated by those of skill in the art that directing a flow of cold water over the beverage containers will cause greater heat transfer than merely submerging beverages in cold water. It will be further appreciated that the level of water in each quench tray can be controlled by adjusting the volume flow rate of water into the drawer as well as the size of the drain orifice or orifices in the drawer. In some embodiments, cooling water is directed through the drawer at a level that does not cause the beverage containers to move. In such an embodiment, the heat transfer from the beverages to the cooling water is driven principally by the temperature differential between the beverage container and the cooling water, as well as the material from which the beverage container is made. In other implementations, the cooling water is permitted to rise to a level to permit the beverage containers to float slightly and rotate in place. In such implementations, the rate of heat transfer can be enhanced as a result of a larger surface area of the container being contacted by water, as well as the fluid within the container mixing while it is rotating causing the fluid in the container to come down to temperature more quickly. In some instances, where the containers are oriented perpendicularly with respect to the flow, this effect can be enhanced. If desired, each drawer can be slanted from front to back to facilitate the flow of water toward the back of each drawer. Drawers 170, 180 also can each include a handle that is integral, as illustrated, or that may be separately attached. In the illustrated embodiment, drawers 170, 180 are made from sheet metal and the handles are integrally formed with the drawers.

Each drawer, as illustrated, includes dump orifices 174 along the rear portion of the bottom of the drawer that are positioned over horizontal flanges 100*a* on the bottom of the tank 100 when the drawer is pushed in. Similarly, tabs 175 defined by perimetric grooves 176 are disposed in the back face of each drawer, which can be aligned with or staggered with openings 100*b* in backing plate 100*c*. Both dump orifices 174 and grooves 176 are intended to facilitate rapid evacuation of water from either drawer 170, 180 at the moment the drawer is slid forward so that the dump orifices are no longer aligned with and top of the horizontal flange and when grooves 176 are no longer abutting backing plate 100*c*. At this moment, the conduit 171 also disconnects from the feed line (e.g., 140 as illustrated in FIG. 11). The net effect of these actions is that water may flow freely through the dump orifices and grooves, causing the quench drawer to empty in a matter of a few seconds. If faster evacuation is desired, tabs 175 may be bend upwardly or removed to increase the outflow area for the cooling water. When the drawer is pushed back into the chest all the way, the water connection o-ring 171*b* reconnects to tapered end 171*a* of conduit to place conduit 171 into fluid communication with feed line (e.g., 140), and the leaking through dump holes is substantially eliminated or at least substantially decreased by effectively blocking the dump holes and grooves by way of shelves 100*a* and backing plate 100*c*.

As referenced above, the drawers are fed with cold water by way of interconnecting with a fitment/o-ring 171*b* at the back of the cooler 10 (such as between backing plate 100*c* and back wall 108 of tank 100 that is fed by vertically oriented feed lines 140, 150, wherein feed line 140 feeds lower drawer 180, and upper feed line 150 feeds upper drawer 170. Similarly, feed line 160 feeds upper tray 46. As alluded to above, FIG. 11 is a cross sectional view of lower slidable drawer 180 showing a cooling conduit 171 in the drawer being received by an output of one of the feed tubes 140. When fully pushed into the chest, drawer 180 abuts against the backing plate 100*c* of the tank 100 and fluid communication is established between the feed and the drawer 180, permitting the drawer 180 to fill with water to quench the beverages. Thus, when the middle and lower quench trays 170, 180 are pulled out and/or removed through the front access door 30, water that was contained in the quench trays is drained as described above. This allows for a beverage to be removed from the middle and lower quench tray 170, 180 without water substantially being spilled or leaked outside of the cooling chest 10, thereby also helping to prevent a slippery surface (e.g., patio).

Thus, in certain aspects, the present disclosure allows for the continuous production of ice which is then delivered into the cooling chest. The ice acts as a continuous coolant for water that is guided into the cooling chest though a plurality of pipe fittings. This uninterrupted and, if desired, continuous, flow of cold water is guided through a series of pipes and feeding tubes into the plurality of quench trays which contain beverage containers of various sizes and shapes. Beverages containers are kept submerged in a continuous flow of cold water. Beverages can be loaded and locked into place via an adjustable grate or divider. Beverages can be removed from the upper quench tray from the top access door. Beverages can also be removed by withdrawing the middle and lower quench trays from the front access door as you would pull out a dresser drawer. As the middle or lower quench tray is removed thought the front access door, the water contained in the submerged quench trays is drained out through a plurality of openings located on the quench trays that lead to exit feeding tubes to allow for beverages to be removed without the spillage of water.

In another embodiment of the disclosure and as illustrated in FIG. 14, the cooling chest may be a relatively, smaller, portable unit adapted to be movable on wheels, with the assistance of a rotatable lift bar, and the like. The particular schematic illustrated shows a cooling chest 1410 that has portability features similar to a portable electric generator including a pair of wheels 1430, a resting post 1450 for the opposite end of the unit, and a pivoting handle 1460 or lift bar at one end that may be pivoted upwardly to lift the end of the cooling chest 1410 and roll it on the wheels 1430. Such a portable version of the chest 1410 can be powered by a portable power source, such a hydrocarbon gas, propane, an electrochemical fuel cell, solar power, a generator, and the like 1420. The gas can be propane, ethanol, natural gas, a mixture thereof, and the like. The source of the gas can be an individualized gas tank such as a propane tank used for an outdoor barbecue or the gas can originate from a different stationary or portable source. Advantageously, this can permit the cooling chest to be untethered to an electrical source and be portable for use in a variety of remote locations where electricity may not be available. A chest with these functionalities can be suitable for military operations, disaster relief and recovery locations; RV parks; tailgating events at stadiums and food trucks. In this embodiment of the invention, the cooling chest is portable, and is preferably filled with a quantity of water that can be recycled with minimal losses so that melted ice can be recycled and turned back into ice. The ice cools the beverages held in the chest and once the ice is melted, the chilled water is circulated back into the ice maker for further production of ice. It will be appreciated that such a portable chest can have any or all of the features of the chest that is specifically illustrated, but may have any subset of those features, such as a plurality of drawers 1440 and counter 1460 as illustrated in FIG. 14. Preferably, the portable cooling chest flows chilled water over containers therein.

If desired, the cooling chest, whether portable or not, can be configured to operate in a "closed-loop" mode, wherein an initial volume of water is loaded into the unit. Once the water is loaded, the system will convert the water to ice, utilize the ice-water bin to cool beverages, and then return the cooling water to the quench tank. When operating in closed-loop mode, the circulating water is preferably filtered. Similarly, while in closed loop mode, water overflow from the ice-melt in the quench tank can be supplied back into the ice-maker as "water-in" supply fluid. In an open loop mode, water overflow can be drained outside system into existing "p-trap" drain.

In a further embodiment, the chest for quenching beverages may be provided without an onboard icemaker. Preferably, the chest still includes a tank for holding a chilled mixture of ice and water, and at least one quench tray disposed proximate the tank for holding containers of beverages filled with cold water by way of a conduit in fluid communication with the tank. The at least one quench tray can include a compartment defined by a bottom and a plurality of walls, and defining therein a plurality of rows for aligning and containing a plurality of beverage containers. The at least one quench tray can further include at least one drain orifice configured to guide water out of the at least one quench tray. If desired, the chest can include one or more of an introduction port for introducing ice into the tank to chill the water, and a cooling coil (such as a Peltier-thermoelectric-type cooler module) for removing heat from the chilled mixture of ice and water. The chest can further be provided with an electric or manual (e.g., hand operated) pump for circulating the chilled water over the beverage containers. The version of the chest without an onboard icemaker can be particularly advantageous in portable applications where space and/or electrical supply is limited. The device can be provided with a power cord, solar panels or other power source for powering the pump and/or cooling coil.

Figure 15A:
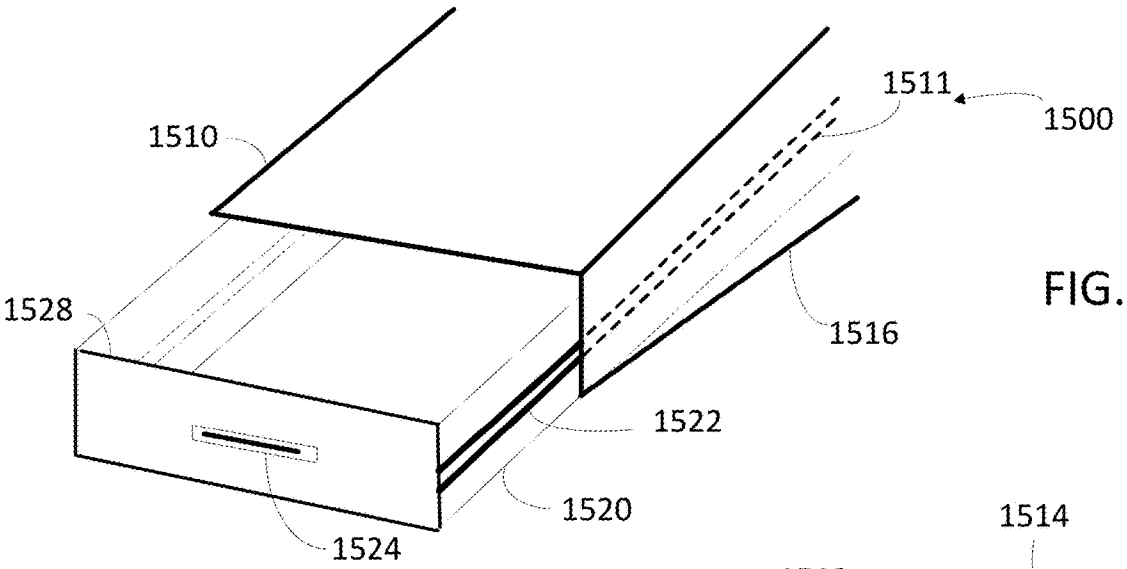
FIG. 15A is a perspective view of a Pull Out Drawer (POD) subassembly according to an embodiment of the present invention.
Figure 15B:
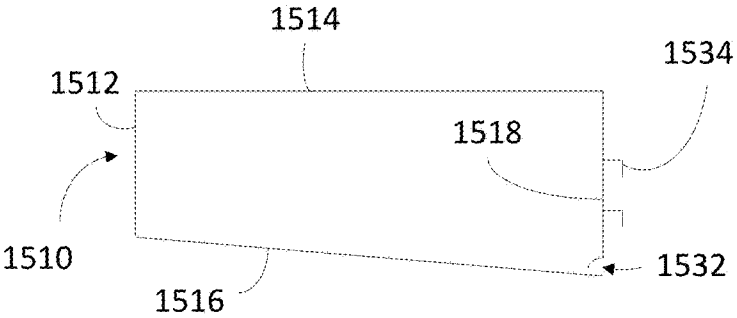
FIG. 15B is a side plan view of a POD according to an embodiment of the present invention.
Figure 15C:
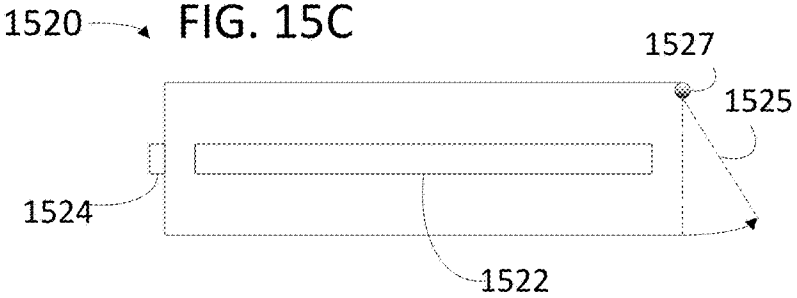
FIG. 15C is a side plan view of a drawer of a POD according to an embodiment of the present invention.

In accordance with further aspects of the disclosure, modular beverage cooling systems are provided including one or more stacked cooling pods, each pod including the capability of cooling beverage containers with actively flowing water. Each pod may include a drawer, and/or a top access hatch. For purposes of illustration, and not limitation, aspects of such a modular beverage cooling system are illustrated in FIG. 15A-C. Such modular components are referred to herein as a "POD" (Pull-Out Drawer) subassembly.

As shown in FIG. 15A, the POD 1500 can include a housing 1510, which may include a track or rail 1511 (shown in dashed line) for receiving and mounting a drawer 1520. The POD also includes water flush conduits and lighting (neither shown in FIG. 15A). Specifically, the POD housing 1510 can taper from front to back (e.g., 3°-6°) along its bottom edge 1516 to facilitate drainage so that when the drawer is pulled out, the fluid preferably dumps out of the bottom of the back region of the drawer where it is directed to a drain, and into a quench tank. The Drawer 1520 includes flanges 1522 on its sides adapted to be inserted into the track of the housing 1510, allowing the drawer to slide inwardly and outwardly, and a handle 1524 on its front face. Via these features, the drawer 1520 may be inserted and pulled out from the POD housing 1510 when the drawer is not in a locked position, as will be described more fully below. The drawer 1520 may include inserts (e.g., the inserts shown in FIG. 4A-D) for dividing and aligning beverages. Inserts can similarly be provided with a rotating mechanism for rotating the beverages, such as drive rollers oriented at the bottom of the drawer or in a lower portion of the divider. The rotation can be induced by an electric motor powered by a sealed battery and/or by electrical contacts that engage when the drawer is closed. By way of further example, a low voltage (e.g., 12V) can be driven through the drawer rails to drive the rotation motor. The drawers are preferably removable for cleaning. By way of further example, the drawer can engage with a gear drive in the housing when closed, thereby driving the container rotation mechanism. Successive rows of drinks can be configured to rotate in the same or opposing directions to help drive fluid circulation within the drawer. A gasket 1528 can be provided around a perimeter of the drawer front to facilitate sealing with the housing 1510.

Figure 16:
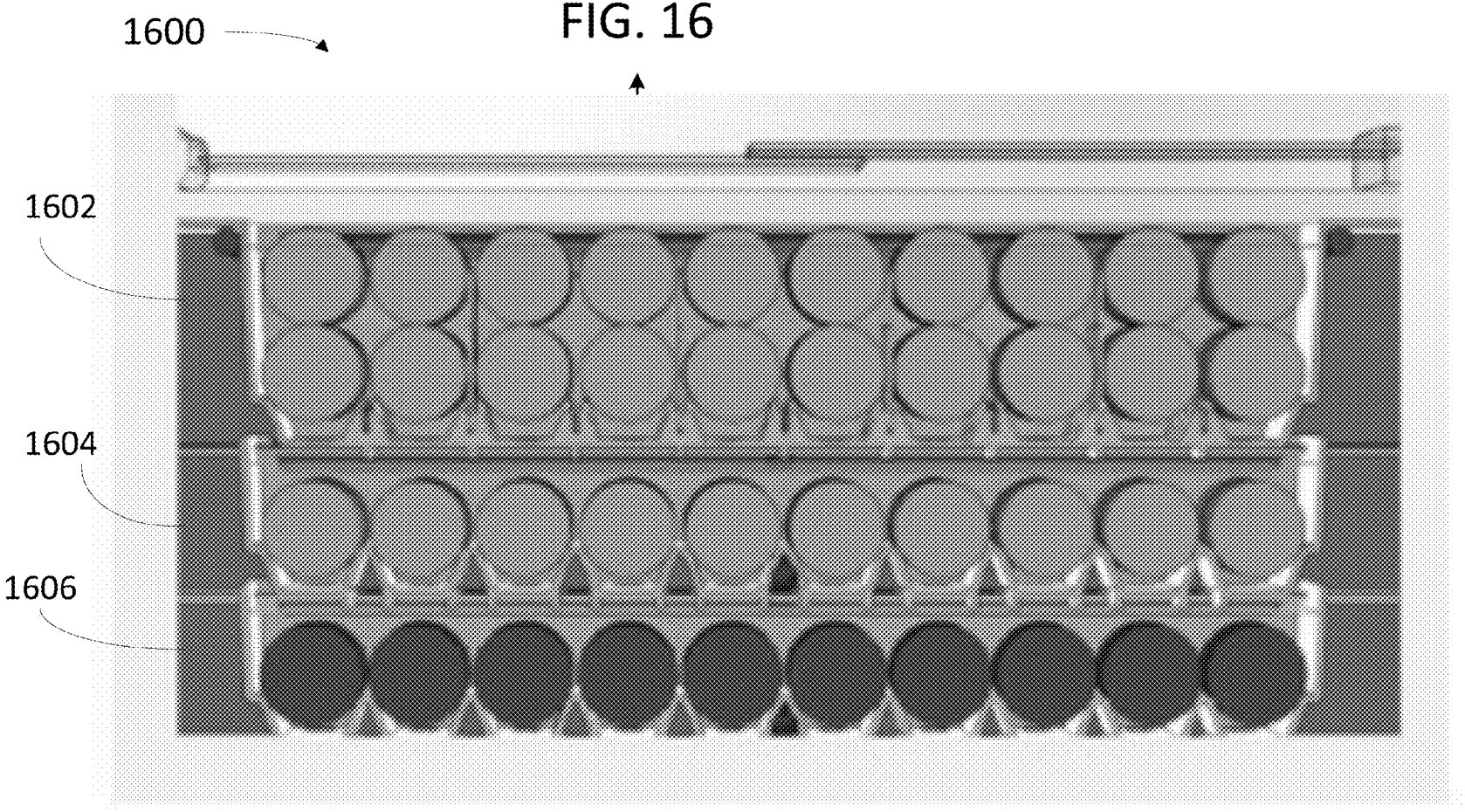
FIG. 16 is a front view of a cooling chest containing three PODs according to an embodiment of the present invention.

FIG. 15B shows a side view of the housing 1510 according to an embodiment of the present invention. The housing 1510 includes a front face 1512 through which a drawer is received and removed, a top 1514, a bottom 1516 which may have a slight downward slope from front to back, which may be approximately 3-6 degrees. The PODs can be of any desired dimensions. In one embodiment, the POD has a depth of less than 21 inches, wherein the chassis is preferably less than about 22 inches deep and about 34 inches in height for fitting beneath a kitchen counter. The height of the PODs may be set to allow for one or two stacked layers of drinks of various sizes and may be for example between 4 and 10 inches. As an example, FIG. 16 shows a chest 1600 containing three PODS, 1602, 1604, 1606. The top POD 1602 is configured to store a drawer for holding two stacked layers of beverages, while the middle 1604 and bottom 1606 PODS are configured to store drawers holding a single layer of beverages. In some embodiments, the top of a POD may be open to allow for top access. At the back 1518 of the POD is a water outlet 1532 and flanges, brackets or other fixtures 1534 for coupling the POD to the chassis. The water outlet 1532 may comprise an opening and have a width and height suitable for draining fluid relatively while being easily blocked during quenching to prevent draining (e.g., about 2-3 inches wide and about 1-2 inches high). The components of the POD can be made from one or more of metal, plastics, and composite materials, among others. Indicator lights operably associated with temperature sensors and a power source and a processor and a wireless communications network (if desired) can also be provided. The housing of the POD is preferably thermally insulated using any desired technique.

FIG. 15C shows a side view of a drawer 1520 according to an embodiment of the present invention. In some embodiments, the back of the drawer 1525 is adapted to open either automatically when the drawer is pulled out from a POD or electrically via an actuator to allow water within the drawer to drain. For example, in a first embodiment, the back 1525 may comprise a rear flap and may include a hinge 1527 at the top and may be biased to spring open when the drawer is pulled out, and then may be returned to a closed position using a solenoid or similar actuator attached to otherwise operative to secure the back of the drawer. In another embodiment, the drawer back 1525 may be in a normally closed position, and an actuator may be operated to open or unlock the back for full drainage at a particular rate during a particular cycle of the quenching process.

Figure 17:
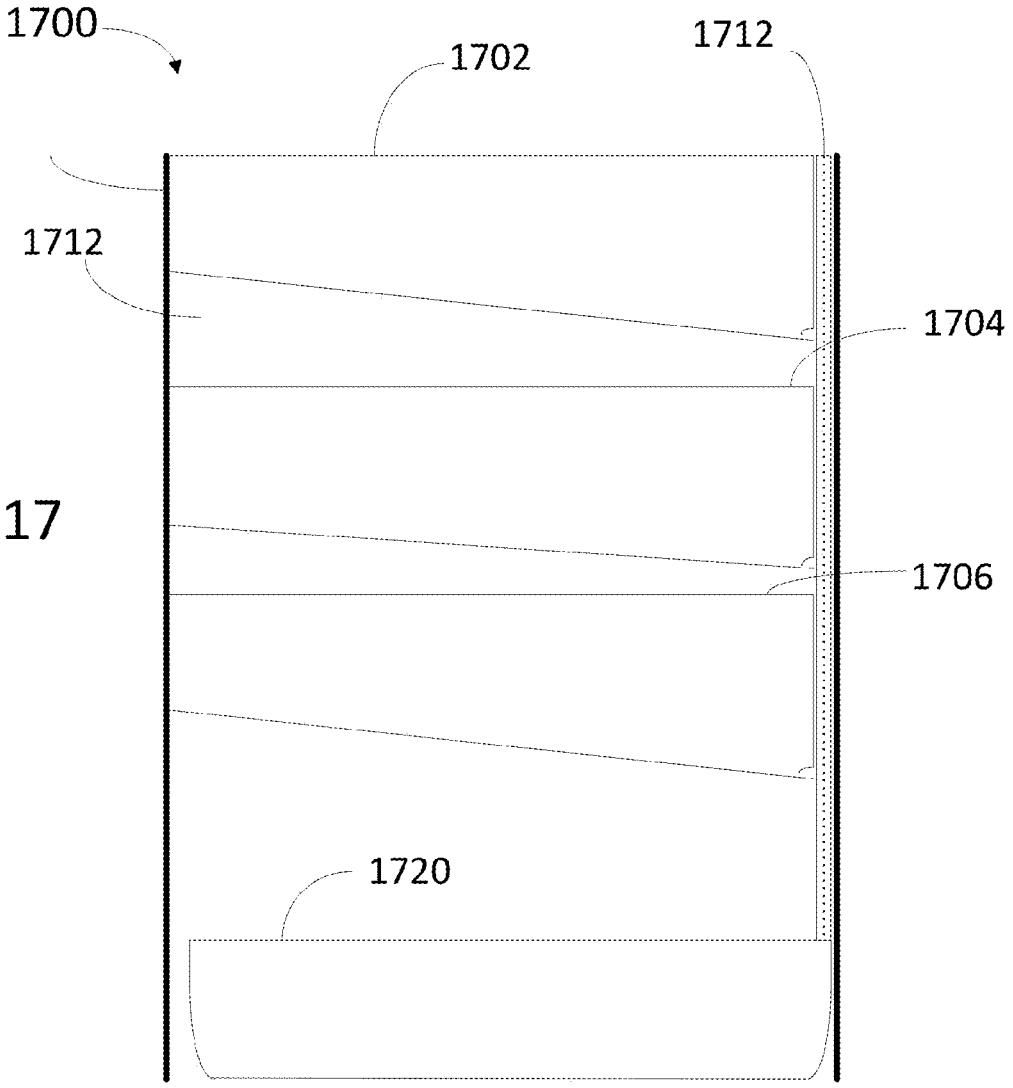
FIG. 17 is a side cross-sectional view of a cooling chest according to an embodiment of the present invention.

FIG. 17 shows a side cross-section of an exemplary cooling chest 1700 according to an embodiment of the present invention which includes three POD subassemblies 1702, 1704, 1706 which are mounted on a chassis 1710. As shown the PODs slope downwards from the front toward the back of the chassis 1710. Regions in the chest 1700 between the PODS, e.g., 1712, may be filled with insulating material to enable the cooling rates of the various PODs 1702, 1704, 1706 to proceed separately. Water outlets of the respective PODs 1702, 1704, 1706, preferably located near the bottom of the back of the PODs, lead to a drain channel 1715 through which water drains from the PODs into a quench tank 1720 located at the bottom of the chest. While a front-loading embodiment has been shown, it is also possible to mount and access PODs from the back of a cooling chest. Front-loading and removal can be of particular advantage when permanently installing the pods, for example, in a kitchen. This configuration also facilitates flush mounting of the drawer with the edges of the chassis for an aesthetically pleasing appearance.

During operation of a cooling chest according to the present invention, it is important to ensure that the drawers of the POD are locked in position and cannot be pulled open while water is either being pumped through the POD or has not had time to drain out. The locking mechanism can also ensure that no more than one drawer is opened at a time. In some embodiments, the pump mechanism and locking mechanism are controlled electronically using distinct actuators. The drawer locking mechanism can be controlled such that cannot unlock while the pump is running or while water has not yet drained from the POD. Alternatively, in other embodiments, a single actuator can be used to simultaneously actuate both the pump and locking mechanisms. An embodiment of a drawer locking mechanism for a cooling chest according to the present invention is shown in FIGS. 18A-E.

Figure 18A:
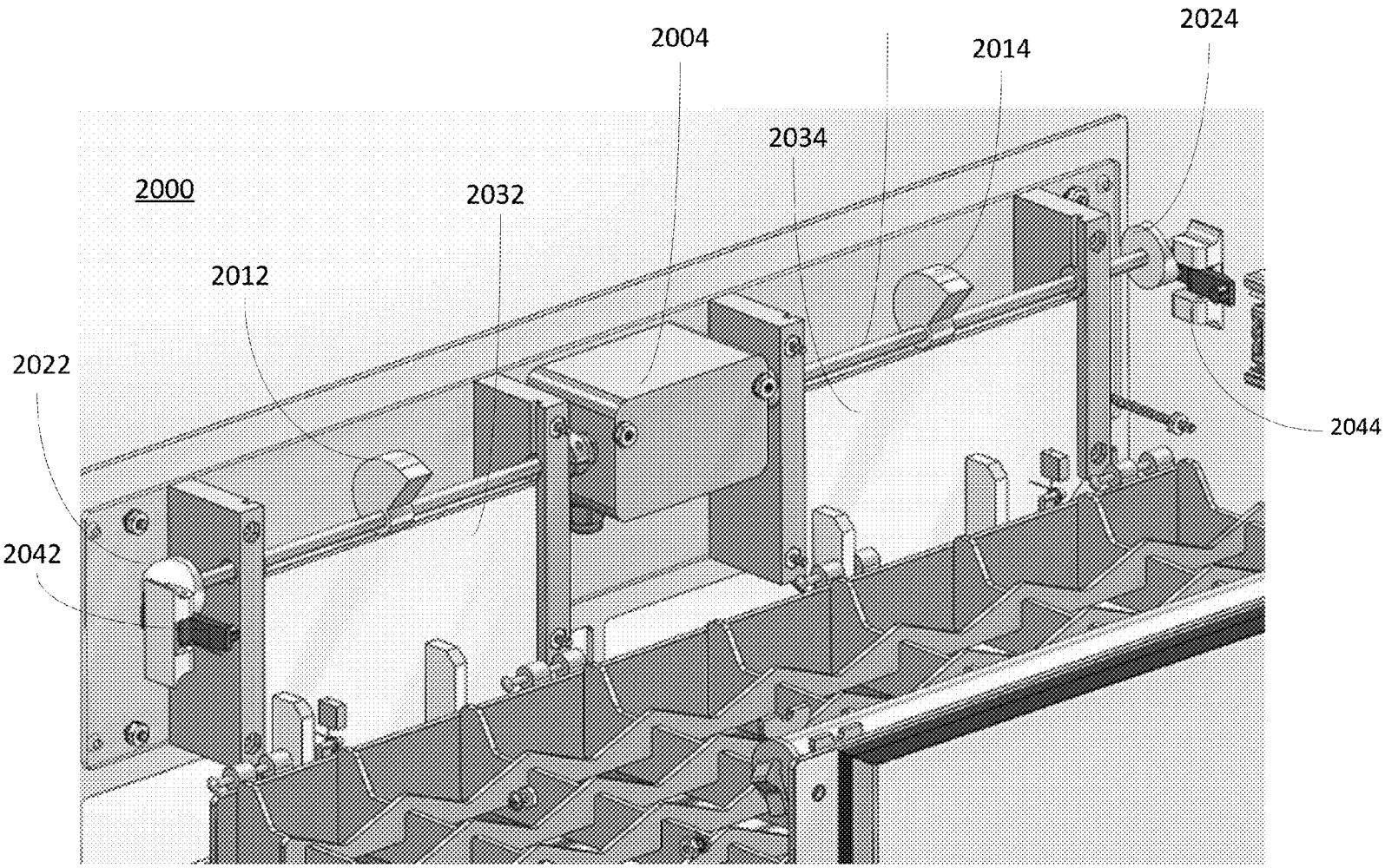
FIG. 18A is a perspective view of a drawer lock according to an embodiment of the present invention.

Referring to FIG. 18A, the lock mechanism is located at the back of a POD 2000 and designed to simultaneously lock or unlock a drawer (not shown in FIG. 21A) and lower or raise slides which allow water to fill (when lowered) or drain (when raised) from the POD. As shown, the mechanism includes a shaft 2002 (rotatable by a motor 2004 which is electronically controlled) which is aligned horizontally toward the back of the POD. Coupled to the shaft 2002 are a set of two inner cams 2012, 2014 relatively proximal to the center of the shaft and two outer cams 2022, 2024 positioned on the respective ends of the shaft. The extended portion of the lobes of the inner cams 2012, 2014, when rotated, are adapted to abut and press upon the edges of slides 2032, 2034. The slides 2032, 2034 may be set in grooves or otherwise constrained to move only in a vertical direction, and may be biased toward a relative upward (unlocked) position by a spring. When the slides 2032, 2034 are shifted downwards in a locked position, they are positioned to cover the drain openings in the POD. In operation, sufficient rotation of the inner cams 2012, 2014 via shaft 2002 forces the slides 2032, 2034 downwards into the locked position. The outer cams 2022, 2024 are each coupled to respective pin mechanisms 2042, 2044. The pin mechanisms 2042, 2044 may include a lever configured to pivot in the horizontal plane. A first, rearward, side 2045 of the lever may engage with the outer cams 2022, 2024, while a second, forward, side 2047 of the lever may include a pin 2048 on its end. The outer cams (e.g., 2022) may have a complex profile such that when the shaft 2002 is rotated sufficiently, the outer cam impinges on the second side 2047 of the pin mechanism, forcing it to pivot outwardly (away from the center of the POD), which simultaneously forces the first side 2045 of the lever which includes the pin, to pivot inwardly. The pin 2048 may engage with a respective corresponding hole in a drawer inserted into the POD, locking the drawers in place. In operation, a single rotational movement of the shaft can, via two sets of cams 2022/2024 and 2042/2044, thereby actuate both a drain blocking/unblocking mechanism, and a drawer locking/unlocking mechanism.

Figure 18B:
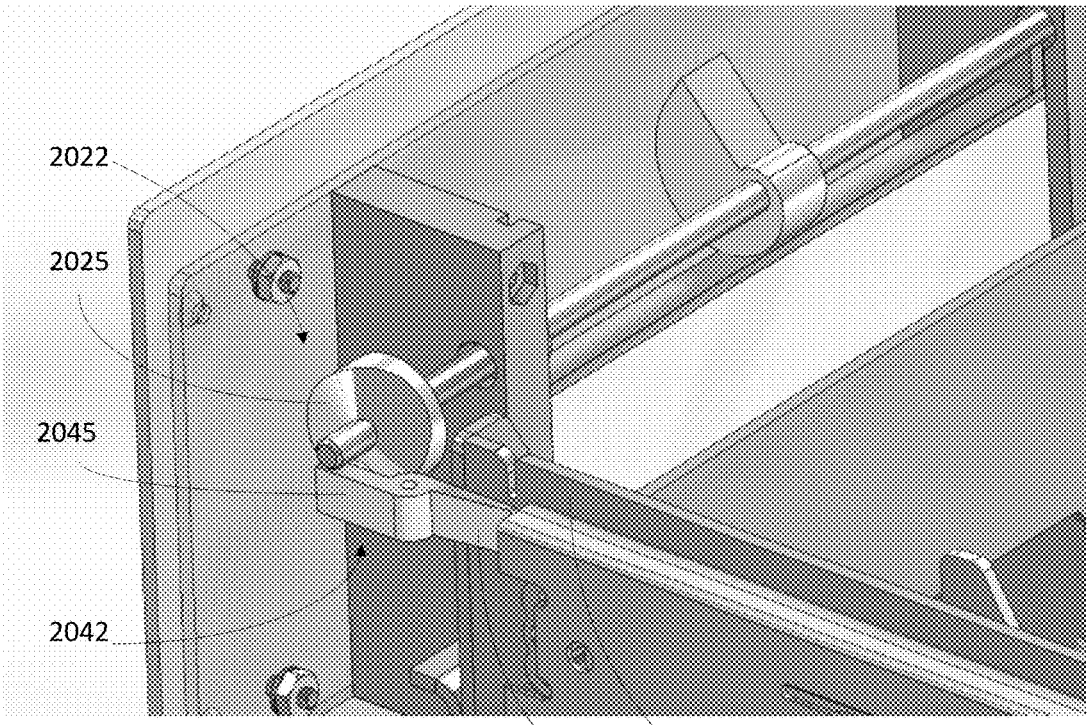
FIG. 18B is a perspective view from the outside of the POD showing an enlarged section of the lock mechanism shown in FIG. 18A.
Figure 18C:
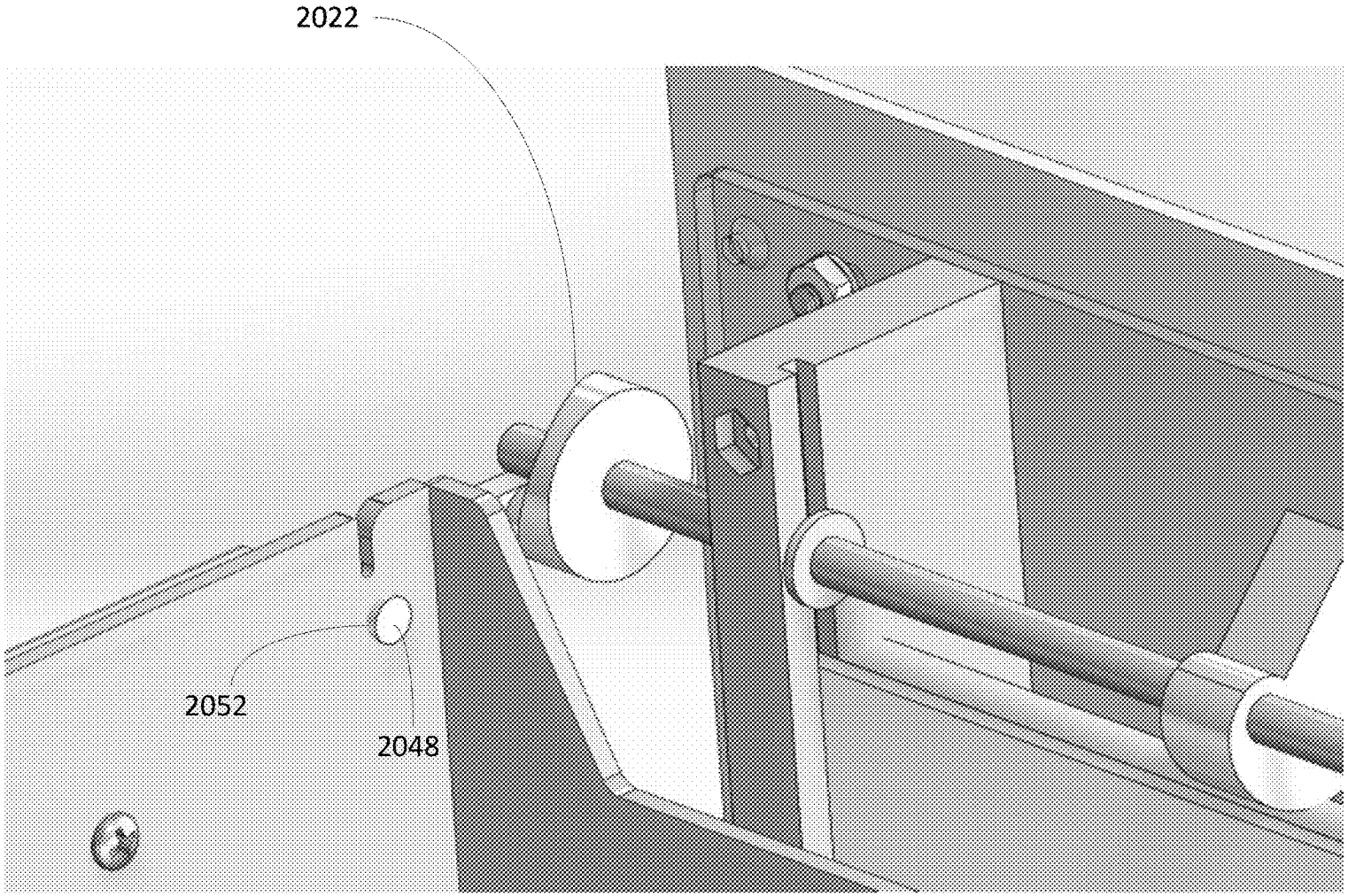
FIG. 18C is a perspective view of the section shown in FIG. 18B as viewed from the inside of the POD.

FIG. 18B shows an outer cam 2022 and pin mechanism 2042 according to an embodiment of the present invention in greater detail, as viewed from the outside of a POD. As shown a lobe 2025 of the cam 2022 is configured to engage with the first rearward side 2045 of the pin mechanism to pivot outwardly. When the cam 2022 forces the first rearward side 2045 outwardly, the second side 2047 of the pin mechanism pivot inwardly towards a drawer 2050. Conversely, rotation of the shaft in a contrary direction releases the first side 2045 of the pin mechanism, causing the second side 2047 to pivot backwards, unlocking the drawer. FIG. 18C shows the outer cam 2022 and pin mechanism 2042 as viewed from inside the POD, showing the pin 2048 of the mechanism inserted through hole 2052 in drawer 2050 (positioned above the water line), in a locked position.

Figure 18D:
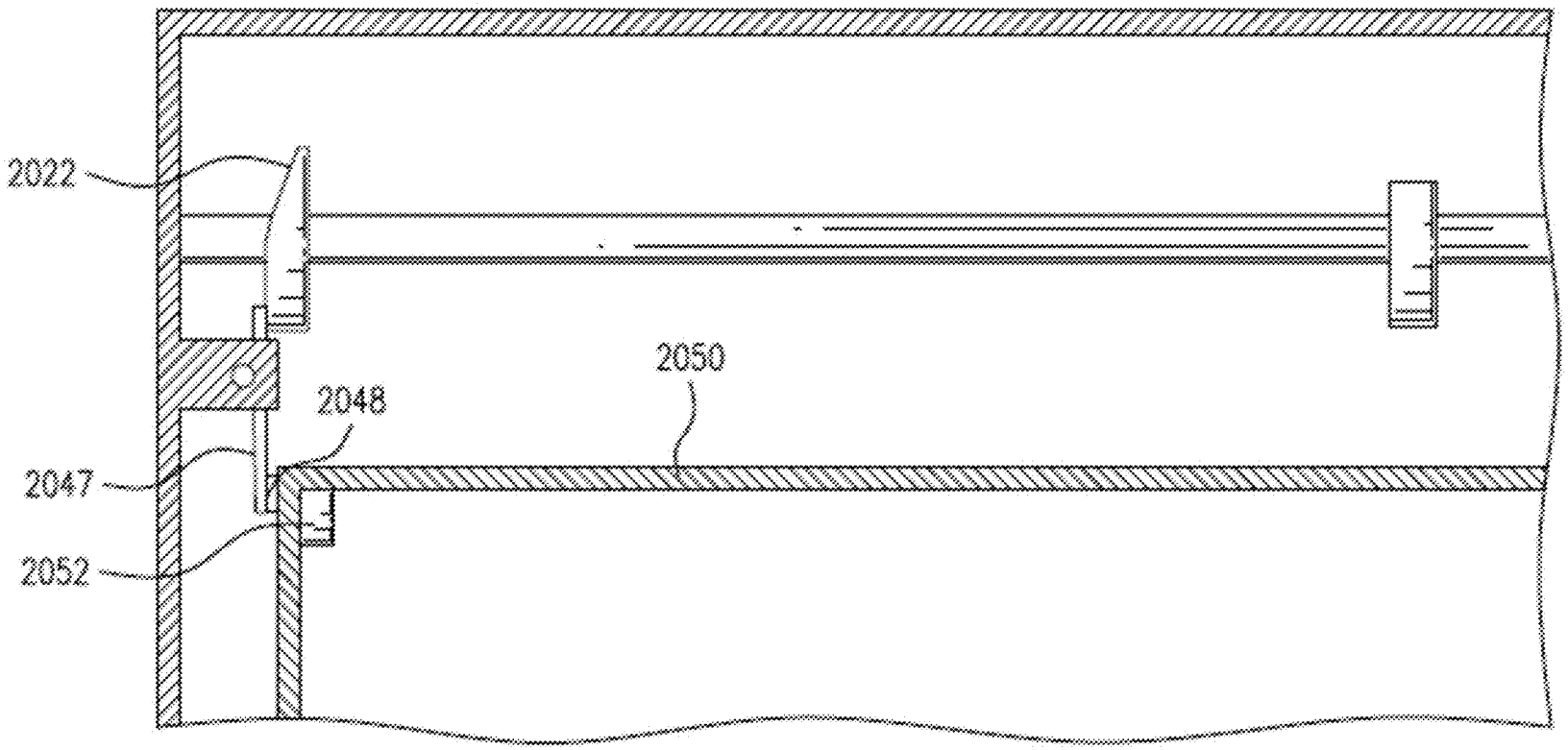
FIG. 18D is a plan view of showing a drawer locked in a POD using the mechanism shown in FIGS. 18A-C.
Figure 18E:
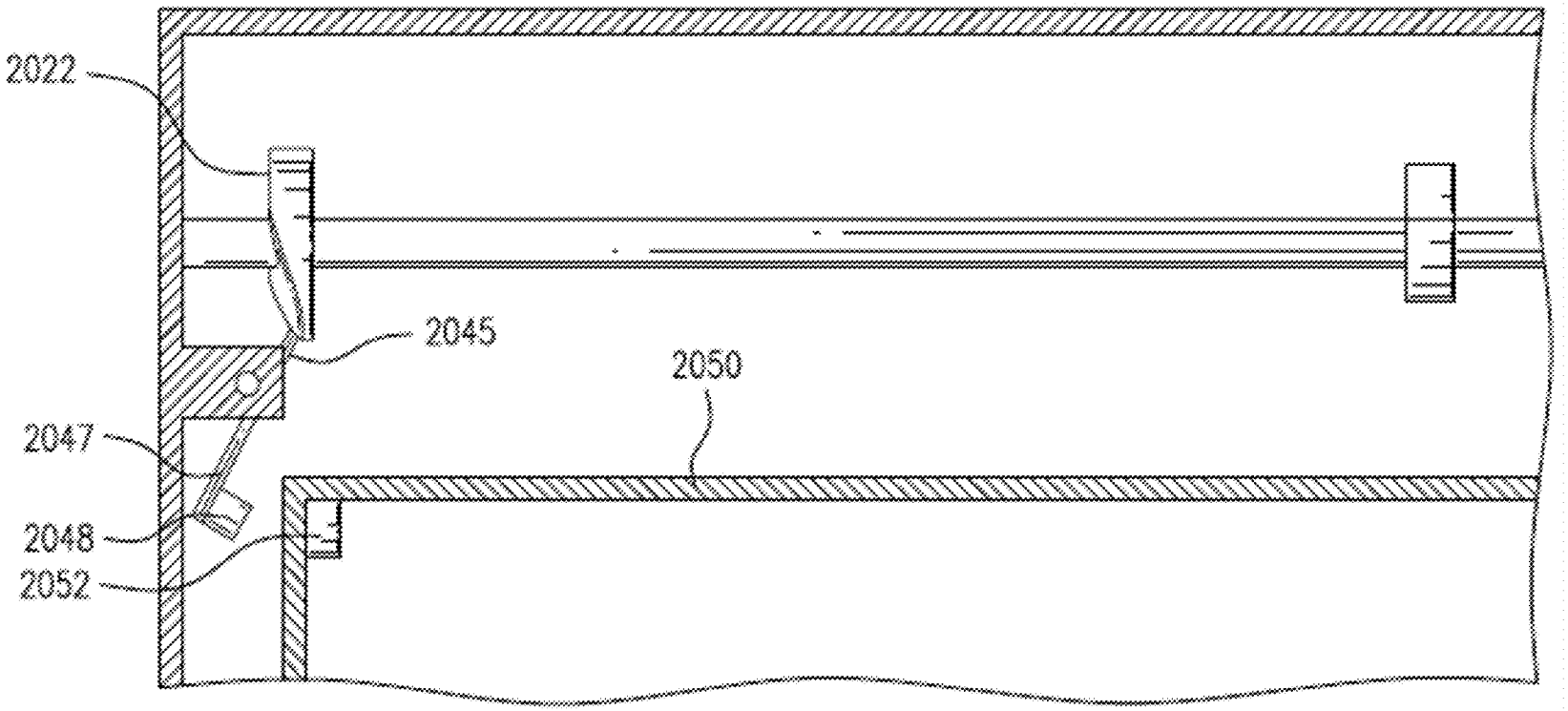
FIG. 18E is a plan view of showing a drawer unlocked from the mechanism shown in FIGS. 18A-C.

FIGS. 18D and 18E are plan views showing the locking mechanism in locked and unlocked positions. As shown in FIG. 18D, with the cam 2022 in a first position, the forward side 2047 of the lever is pivoted inwardly and the pin 2048 engages the hole 2052 of the drawer. In FIG. 18E, the cam is in a second position in which it catches the rearward side 2045 of the lever which pivots inwardly, in turn causing the forward side 2047 to pivot outwardly, disengaging the pin 2048 from the hole 2052 and unlocking drawer 2050.

It is noted that the locking mechanism depicted in FIGS. 18A-18E is exemplary and that other designs and mechanisms can be used to lock drawers in position in a POD.

Figure 19A:
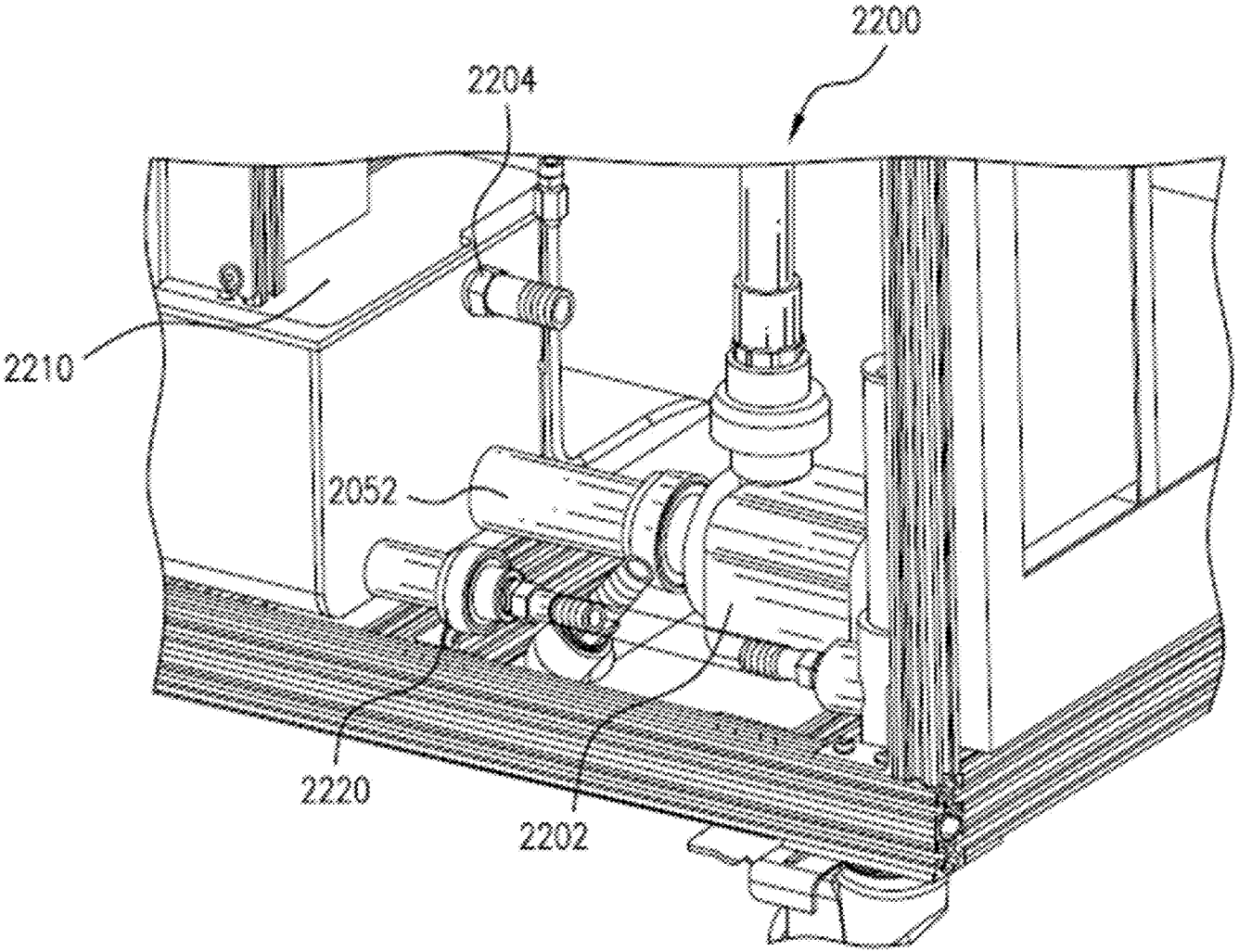
FIG. 19A is a side perspective view of a chassis for a cooling chest according to an embodiment of the present invention.
Figure 19B:
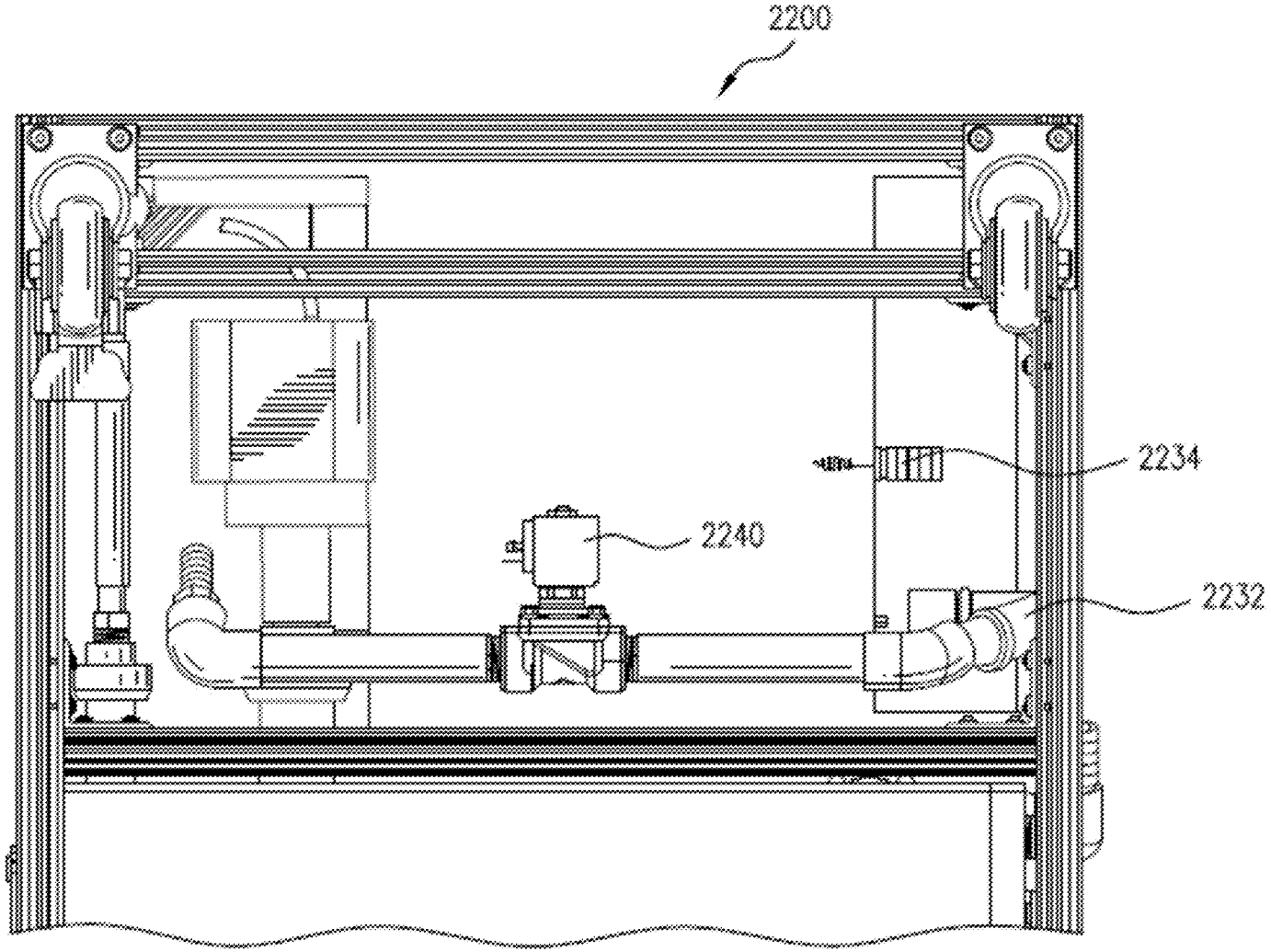
FIG. 19B is a bottom perspective view of a chassis for a cooling chest according to an embodiment of the present invention.
Figure 19C:
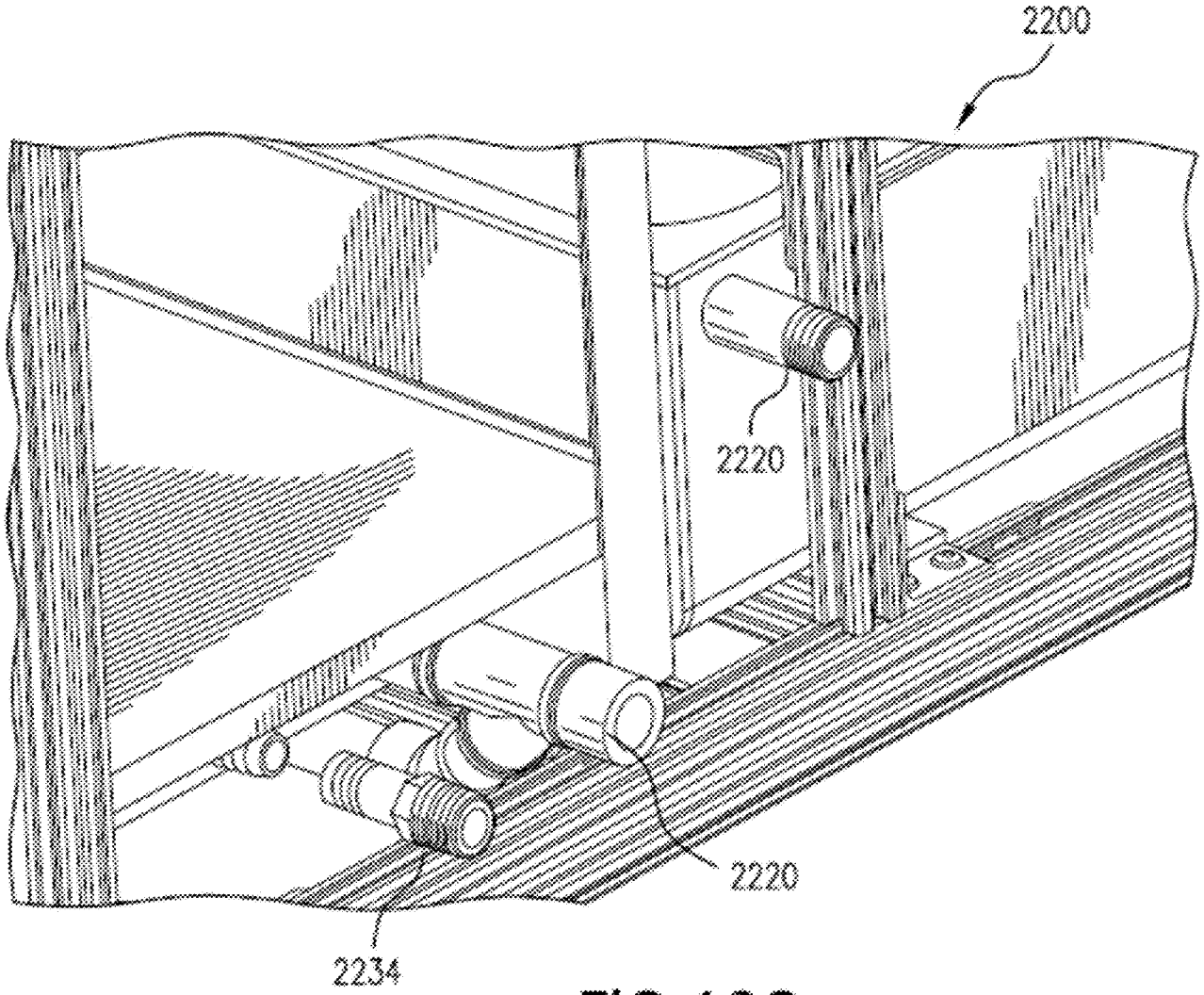
FIG. 19C is another side perspective view of a chassis for a cooling chest according to an embodiment of the present invention.

A portable or movable beverage thermally insulated cooler can be made by combining one or more pods that further includes a source of chilled fluid, whether that include one or more of (i) a tank that can receive ice from an outside source, (ii) a cooling coil, (ii) an ice maker and the like. Insulation in preformed segments can be placed between adjacent PODs. Alternatively, one or more PODs can be provided as a permanent appliance in a kitchen, bar, butler's pantry, or elsewhere and be hooked into stationary plumbing and be provided with a stationary quench tank. As illustrated in FIG. 17, in either application, the PODs can be received into a chassis. In some embodiments the chassis may include 'plumbing' fixtures for providing circulation of water between the PODS, the quench tank and the chilled water source (in either open or close loop mode). FIG. 19A is a side perspective view of a chassis 2200 that includes a water pump 2202, a water inlet port 2204 to a quench tank 2210, a water outlet port 2208 for water flow out of the quench tank 2010, and a quench tank water level sensor 2220 (which may be equipped with a hose, shown in outline). FIG. 19B shows a bottom view of chassis 2200 in which an inlet port 2232 for an external or on-board chilled water source is shown at the edge of the chassis. On the same side of the chassis 2200 a drain 2234 for an ice maker (which may be installed in the region above) is positioned. An electronically-controlled quench tank fill valve 2240 is positioned in a conduit so as to be able to permit or interrupt flow from the inlet port 2232 to the quench tank. FIG. 19C shows a view of the opposite side of the chassis shown in FIG. 19A. This side of the chassis 2200 includes a quench tank drain 2242, an inlet port 2246 for an ice maker and the ice maker drain 2234. Using fixtures such those shown in FIGS. 19A-19C, the cooling chest of the present invention can be set-up for operation quickly using readily-available components such as garden hoses. Additionally, a number of the components, such as the ice maker (or other chilled water source), may be modular and provided separately from the cooling chest.

In accordance with further aspects, the POD can include RGB strip lighting with a controller and be programmed with a lighting protocol that interacts with a smart phone or other device that mimics the lighting pattern. For example, during a quench cycle the strip light and smart phone app graphical user interface (GUI) can flash red until quenched or can fade from red to blue. During a transient event such as a forced unlock and drain event during a quench cycle, the lighting and software GUI can flash yellow or fade from red to green and, then unlock. A drawer open condition can be provided such as by a bright white visibility light. The lighting strip and GUI can provide a blue indicator when the drinks are quenched, and a red or other color when not fully quenched. A quench cycle can be configured to initiate every time a drawer is closed, and/or can be configured to initiate in response to a load monitor in the drawer configured to determine whether any drinks have been added. For example, if all the beverages are quenched and a user opens the drawer, removes a drink, and closes the drawer without adding any drinks, the drawer can be configured to remain in the "blue LED" quenched mode. In another embodiment, the PODs can be provided with a cleaning mode, as with an ice maker. If desired, the POD or chassis can be provided with forced air circulation to further enhance cooling. The POD can be programmed to operate in a variety of manners, such as to produce ice during off-peak energy hours and use that ice capacity to air cool during the day and when not in quench cycle.

The quench tank can be configured to be filled with water by the system until full, and excess water (such as that displaced by the introduction of ice) can be diverted to a drain. If an ice maker is provided in the chassis, the system can be configured to fill the quench tank ice reservoir section until it is detected as being full. At this point, if so configured, an ice diverter mechanism, if provided, can be activated to divert ice production to a user's ice bucket, or it can stop ice production. When the level in the quench tank then drops, the ice diverter can then divert ice back to the tank immediately.

Test of Device Operation

For purposes of testing, a prototype made from a modified Fisher and Paykel DD24D dish washer and an Ice-O-Matic GEMD270A ice maker was created. The device further included a Lifegard™ Quiet One™ Model 4000 fluid pump for circulating cooling fluid that was in fluid communication with one inch diameter (nominal) fluid lines and a 25 gallon tank for holding an ice water bath. The ice maker built an ice stockpile before the test over a six hour period and maintained the stockpile through the test. The pump delivered cold water from the ice water bath to the drawer of the dishwasher, wherein the drawer divider directed water flow around the drawer. An outlet in fluid communication with an ice bath via a vertical exit conduit that maintained the water in the drawer at a predetermined level. A plurality of temperature sensors in the form of thermocouples (in this case, six) were located at each of (i) a location for measuring ambient temperature, (ii) the ice bath, (iii) the drawer inlet, (iv) the drawer outlet, (v) an aluminum can containing a beverage under pressure, and (vi) a glass bottle also containing a beverage under pressure. Table 1 below (taken from http://craftbeertemple.com/videoblog/serving-beer) presents a chart that was used for estimated cooling times of different types of beer in different container types that was referred to herein for comparison purposes.

TABLE 1

| Zone | Range | Temp (F.) | Beer Type | Can (cooling time in min.) | Glass (cooling time in min.) | Plastic (cooling time in min.) |
|---|---|---|---|---|---|---|
| 1 | 35-40 | 35-40 | American Lagers, Malt Liquors, Light Beers | 3-5 | 10 | 35 |
| 2 | 40-45 | 40-45 | Pilsners, Ligh-bodies Lagers, Kolsch, Belgium Wit, Hefeweizen, Berliner Weisse, American Wheat | 1.5-3 | 6-10 | 17-35 |
| 3 | 45-50 | 45-50 | American Pale Ales, Medium-bodied Lagers, IPA, Porters, Alt, Irish Stouts, Sweet Stout | <1-1.5 | 4-6 | 14-17 |
| 4 | 50-55 | 50-55 | Sour Ales, Lambic/Gueuze, English Bitter, Strong Ales, Bocks, Scotch Ales, Baltic Porters, Belgium and Trappist Ales | <1 | 3-4 | 7-9 |
| 5 | 55-60 | 55-60 | Imperial Stouts, Belgian Quads, Belgian Strong Ales, Barley Wines, Old Ales, Dopplebock, Elsbock | <1 | 2-3 | 4-7 |

Comparative data was also obtained from Episode 29 of the 2005 season of the television show "Mythbusters®" titled "Cooling a Six-Pack". Table 2 presents the prototype cooler results against Mythbuster performance results for various cooling modes.

TABLE 2

| Thermally Insulated Cooler | Cooling results after 5 minutes (° F.) | Time to cool to 38-39° F. (min.) |
|---|---|---|
| Refrigerator | 60 | Over 40 |
| Ice | 57 | 30 |
| Freezer | 55 | 25 |
| Ice Water | 44 | 15 |
| Salt Water | 36 | 5 |
| Blue Quench Pull Out Drawer Chest | 38 | 4-5 |

Figure 20A:
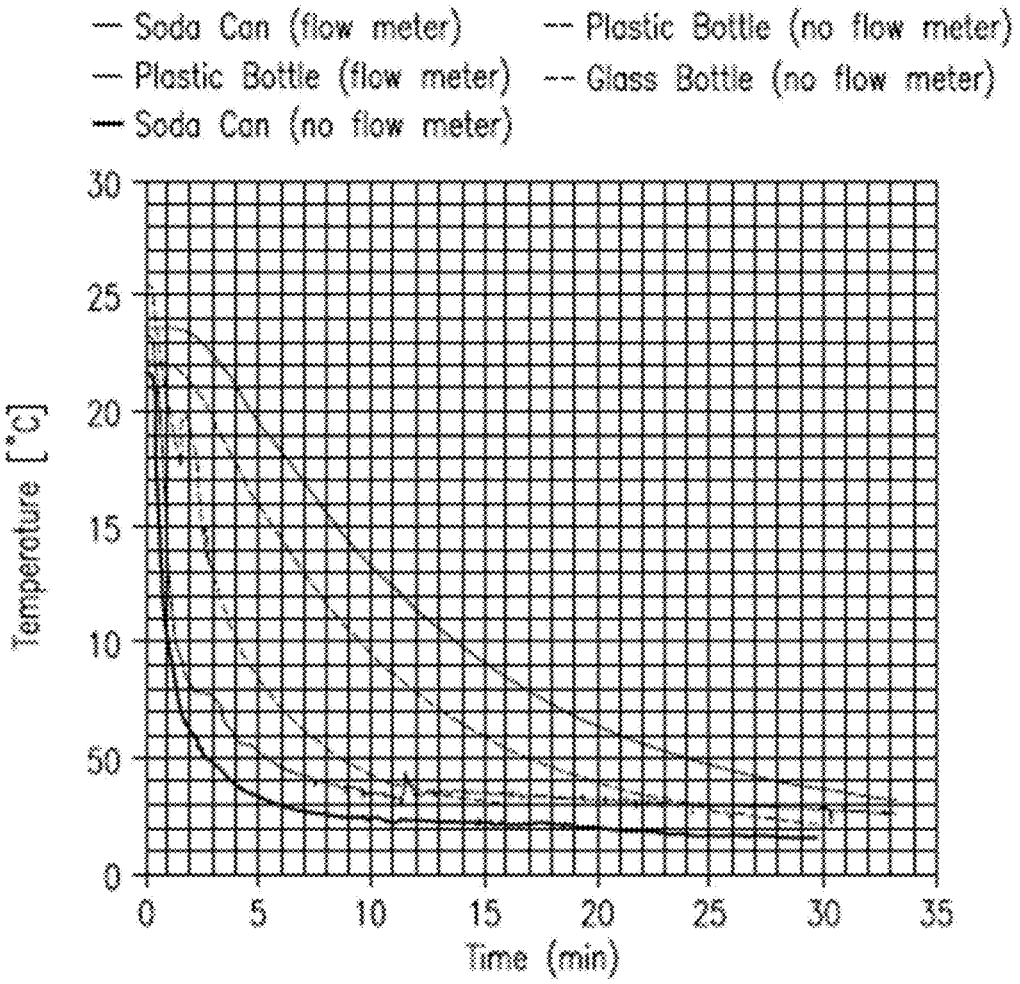
FIGS. 20A and 20B are graphs showing cooling speeds for various beverages over time obtained during a test of a cooling chest according to an embodiment of the present invention.
Figure 20B:
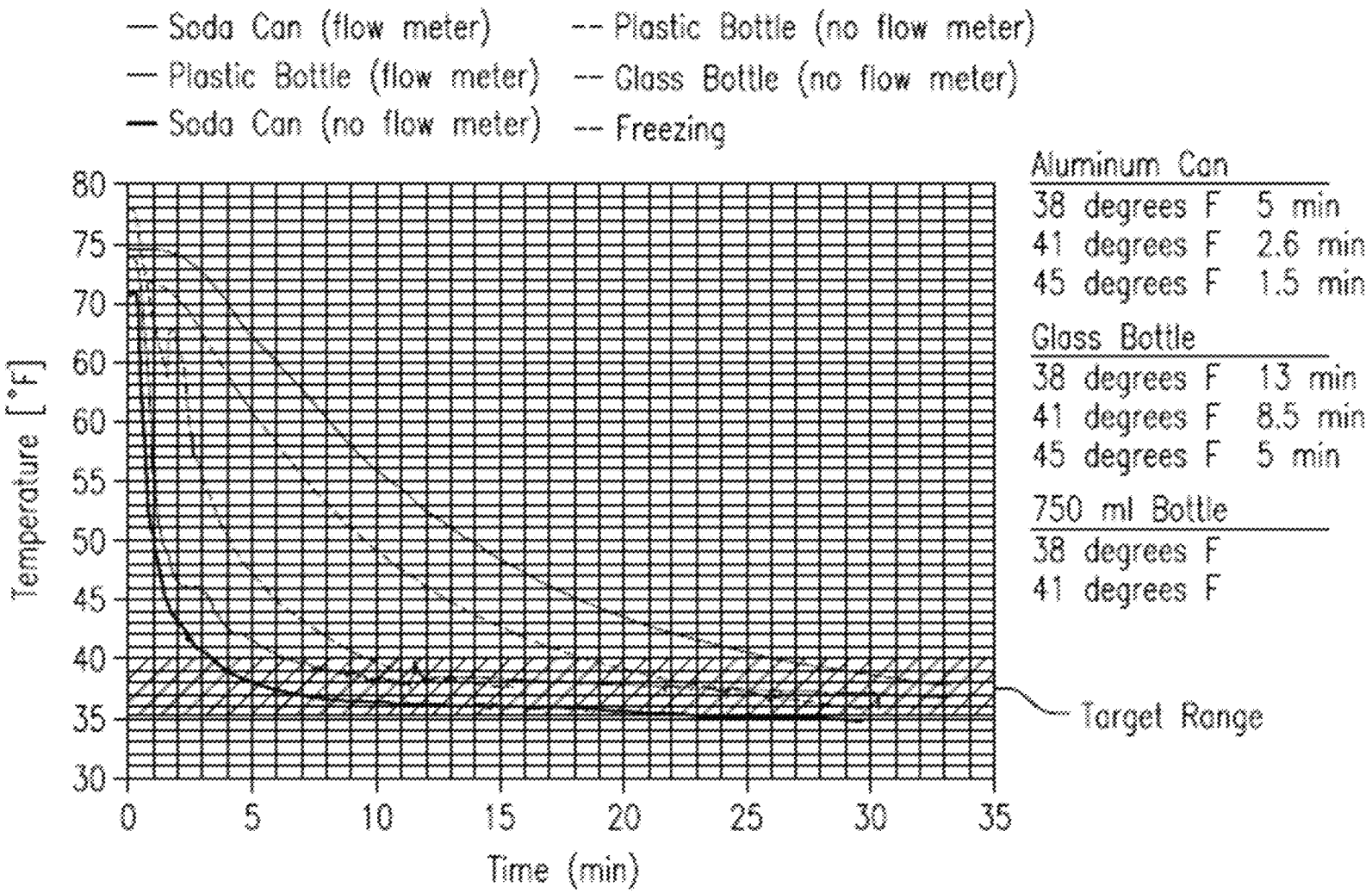

Impressively, the prototype substantially met or exceeded the performance of every cooling method reported by Mythbusters. Cooling speeds achieved for different types of beverages and containers are illustrated in FIGS. 20A-20B in accordance with the test. In particular, data are presented for each of (i) a soda can with and without a flow meter (to account for the effect of the flow meter), (ii) a plastic bottle with and without a flow meter and (iii) a glass bottle without a flow meter. The icewater bath maintained a steady temperature of about 35° F. As can be seen, the disclosed technique has proved very effective at cooling filled beverage containers quickly.

Exemplary Computer Controlled Cooling Chest Systemization

An exemplary control system is depicted in FIG. 12 for operating cooling chest 10 as described herein. An operator interface and control console 250 (FIG. 1) including a controller 255 can be provided on the cooling chests 10 if desired, such as via a touch screen operated programmable controller that can operate the ice maker 68 and pumps 202, 204, 206 (FIG. 10) to selectively deliver chilled water to each cooling tray via conduits 140, 150, 160 as well as a water input connected to a source (not shown) via a solenoid in response to various inputs, such as beverage temperature, cooling water temperature, beverage quantity, and desired cooling time.

Preferably, pumps 202, 204, 206 operate at a desired flow rate (continuously or intermittently, as desired) until a predetermined (e.g., preset) temperature is achieved in each drawer. Sensors 212, 214, 216 (FIG. 10) can be mounted in any suitable location on, in or proximate each cooling tray to monitor the temperature of the beverages. When the desired temperature is reached for one of the trays, the controller 255 can shut off the pump cooling the particular tray, and an indicator light, buzzer or the like (e.g., on control panel 250 or on or near the particular tray) can be actuated indicating that the desired temperature in a drawer has been achieved.

If desired, in addition or alternatively, cooling chest 10 can be operated, monitored and controlled remotely via a mobile device 200, such as a smart phone or remote computer terminal via a server 300. Instructions can be input by a user via the remote/mobile device via a server that is in communication with a controller onboard the cooling chest 10 to operate the cooling chest in any desired manner, such as via wireless network and the like, as described below. When a desired cooling temperature is reached, the controller 255 can send a signal via a network to the mobile device 200 indicating that the temperature has been reached. Cooling curves can similarly be graphically represented on the user interface of the mobile device 300 (and/or on control panel 250) as desired.

Modular Retrofit Quench Unit

Figure 21:
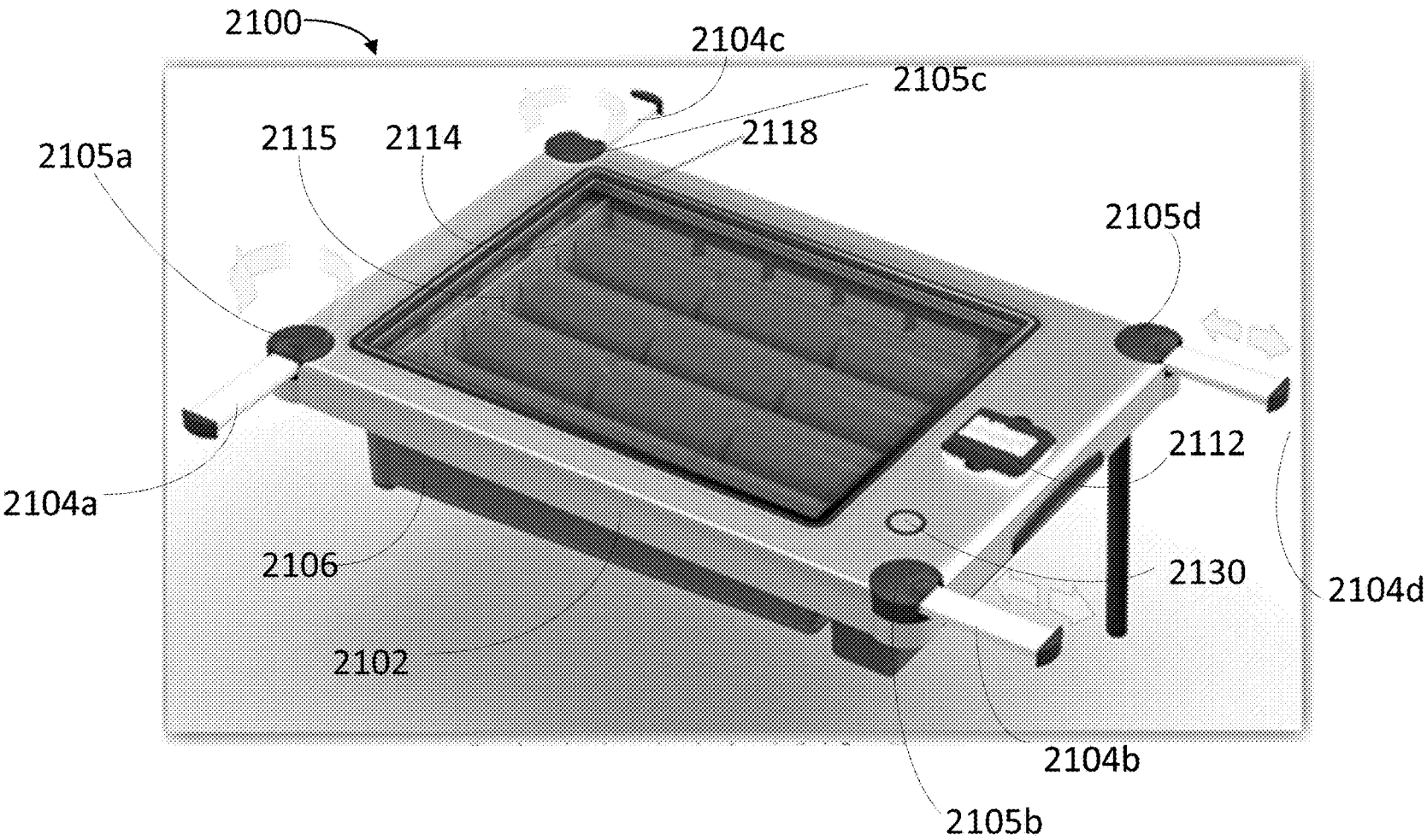
FIG. 21 is an illustration of an exemplary modular retrofit cooling insert in accordance with the disclosure.
Figure 22:
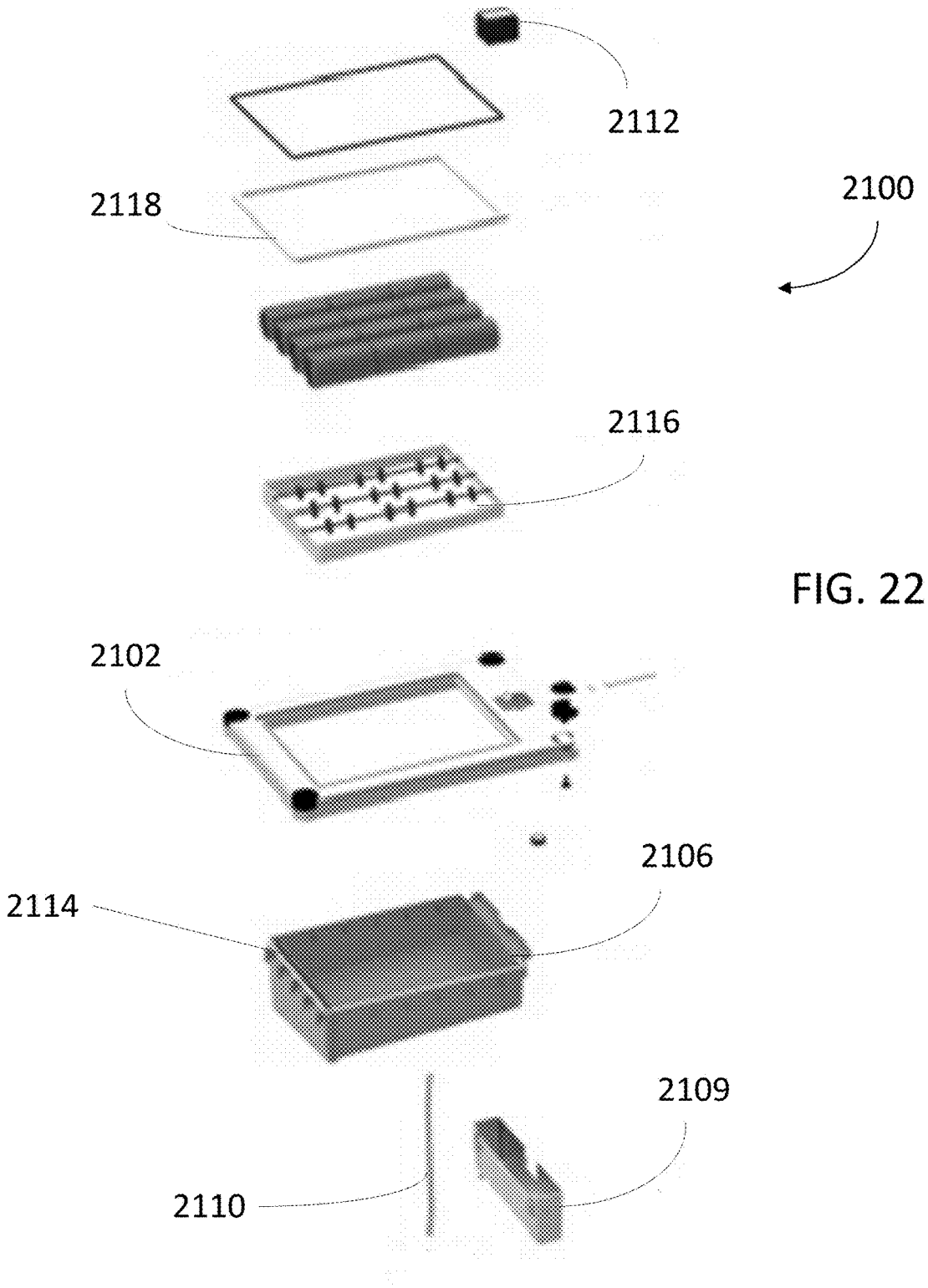
FIG. 22 is an exploded view of the embodiment of FIG. 21.

In another embodiment of the present invention, a modular quench unit, or insert, that may be fitted or inserted into any adequately sized thermally insulated cooler (e.g., an insulated thermal beverage cooler) is provided. FIG. 21 is a perspective view of an exemplary embodiment of a modular quench unit 2100 according to the present invention, and FIG. 22 is an exploded view showing components of the modular quench unit. The quench unit 2100 includes a top platform 2102 having mounting pegs 2104*a,b,c,d* which extended linearly from edge of the platform. As shown, the pegs 2104*a-d* may be coupled to the platform via respective swivel joints 2105*a-d* that enable the pegs to rotate in the plane of the platform 2102. The swivel joints 2105*a-d* enable the quench unit 2100 to be inserted at first and second perpendicular orientations (i.e., 0 and 90 degrees, for example) depending on the cooler size and configuration. Preferably, a cooler is used that has at least a partial internal peripheral lip near the top of the cooler that the legs can rest on top of to support the weight of the modular quench unit 2100 with beverages. If desired, the pegs 2104*a-d* may be linearly extendable and retractable toward and away from the platform 2102, and in some embodiments, may actually retract at least partially into the platform 2102. Taken together, these features of the mounting pegs 2104*a-d* permit the quench unit to be adjustably fitted onto surfaces or features (e.g., lips, supports) of existing coolers. In some embodiments, the mounting pegs 2104*a-d* may be spring loaded and include cleats having a surface made at least in part from a resilient material (e.g., rubber) to enhance grippability and thus to ensure a firm and stable grip between the quench unit 2100 and the cooler. In another embodiment, the mounting pegs may have abrasive surfaces that grip against and/or slightly bite into the wall of the cooler. Accordingly, the mounting pegs 2104*a-d* may hold the quench unit in place even if the cooler is moved, opened or otherwise disturbed. The modular quench unit 2100 can also include one or more control elements and indicators (e.g., buttons, and lights).

It will be appreciated that, while movable pegs 2104 may be used, any desired configuration or accessories can be used to make the unit 2100 adjustable in size. For example, the unit 2100 may have an expandable perimeter frame that can be locked in position that can increase in length and/or width. Similarly, the unit 2100 can be provided in different sizes to accommodate different sized coolers.

Figure 23:
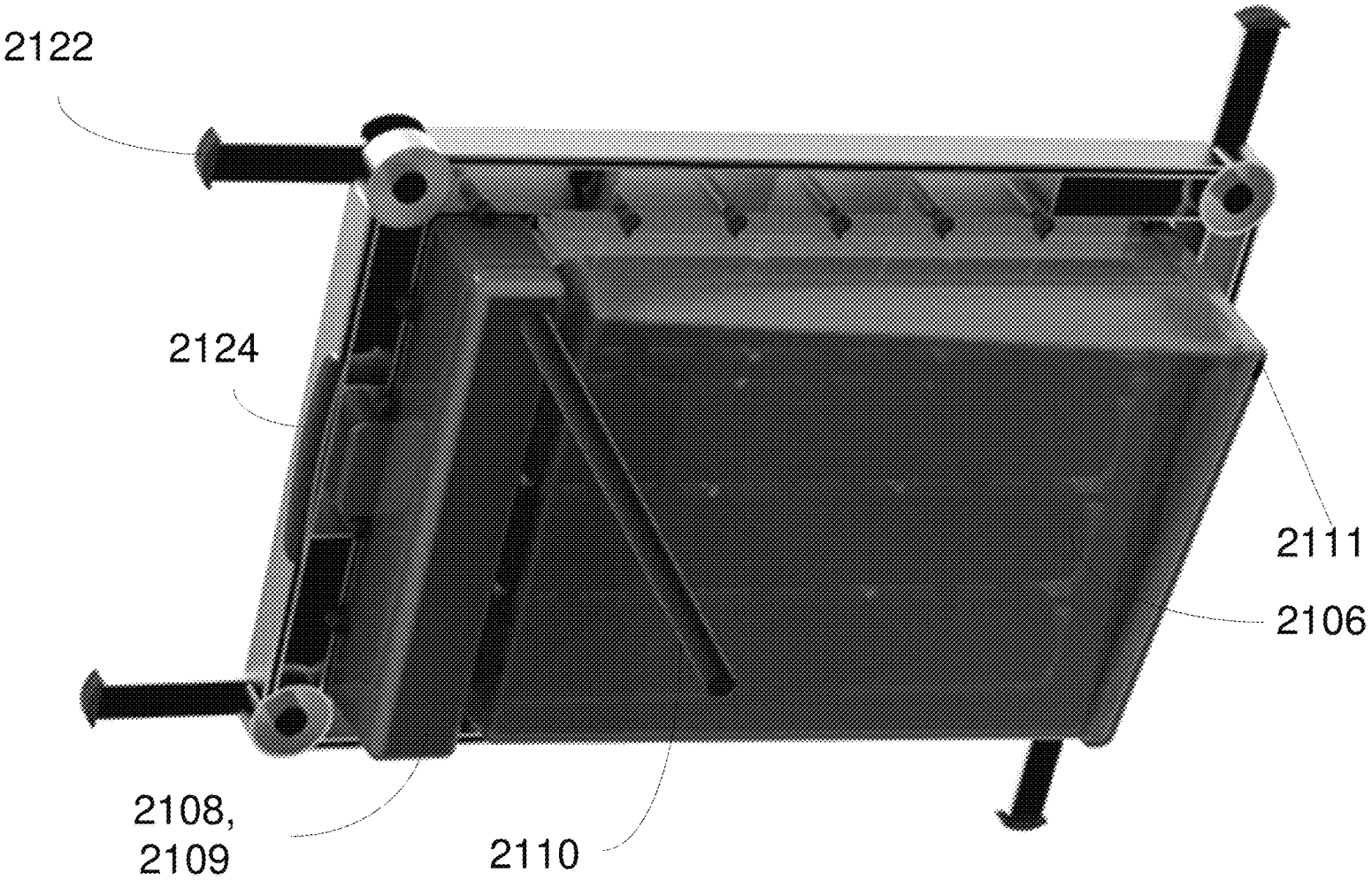
FIG. 23 is an underneath, perspective view of the embodiment of FIG. 21.

Referring to the exploded view of FIG. 22, the modular quench unit 2100 includes a main housing basin 2106 used to hold beverages to be cooled (quenched). In some embodiments, the housing basin is dimensioned so as to hold 12 standard aluminum cans or 8 longneck bottles, but those of skill in the art will appreciate that this can vary. In one embodiment, the length of the basin 2106 can be, for example, approximately 22 inches and the width can be, for example, approximately 14 inches. However, these dimensions are exemplary and should not be viewed as limiting in any way. The quench unit 2100 also includes a pump 2108 and electronics housing 2109 (as shown in FIG. 23 and that may be removable or modular) that is situated adjacent to the basin 2106. The pump 2108 is coupled to and receives cooled water from the cooler in which the retrofit kit is mounted via an inlet hose 2110. The cooler in which the quench unit 2100 is adapted to be fitted may include a cooling (energy) source (e.g., a refrigeration coil) and/or simply an ice-water bath. The modular quench unit 2100 is designed to take advantage of the existing source of cooled water by locating the hose 2110 at or near the bottom of the ice water bath in the cooler and drawing the cooled water through the hose by means of the pump 2108 into the basin 2106 and the beverages contained therein. In some embodiments, the hose 2110 may include a filter or screen to keep out small ice particles and debris and one or more extensions that extend outwardly into the cooling bath to ensure an adequate cooling fluid flow. For example, the filter can be a quick connect/disconnect filter that attaches to an end of the hose 2110. Preferably, the pump, hose and filter can collectively manage a flow rate of up to 10 GPM.

The pump 2108 may produce a flow rate, for example, from 0.25 to about 10 gallons per minute (GPM), or any increment therebetween of about 0.25 GPM, to maximize the beverage cooling rate, although other flow rates may also be used. Power for the pump is preferably provided by a (preferably rechargeable lithium ion) battery 2112 which may be included in the quench unit 2100 within the electronics housing 2109. An external charging dock or charger (not shown) can be provided with the system. Preferably, the battery is removeable and/or rechargeable. In an alternative aspect, a solar panel (not illustrated) may be provided that is attached to the top of the cooler to power the pump to eliminate the need for a battery, and/or to act as a backup to the battery.

The pump 2108 directs water into the basin 2106 in a manner similar to a "water fall" from a first end proximate to the pump to a second end which includes weir plate 2114 that allows the cooled water above a fixed height level to drain back into the cooler via gravity after passing over and/or through the beverage containers. The weir height is set at a level high enough to force the water level in the basin 2106 to rise to the top of any beverages contained in the basin, but low enough to enable water to drain at a sufficient rate over the weir. In some embodiments, as shown in FIG. 21, the weir may include orifices or slots 2115 to further promote rapid water flow thorugh the weir and drainige to enhance water currents alongside the beverage containers. Moreover, while the weir plate 2114 is illustrated in a vertical orientation, it may be tilted slightly in the direction of the flow to help provide a uniform flow that minimizes secondary flows. Preferably, cooling fluid flow through the unit 2100 is generally laminar, but it may also be optimized to generate turbulence in locations that will enhance thermal mixing. To facilitate flow through the unit and out through an exit port 2111 (as depicted in FIG. 23), the base plate of the basin 2106 may be sloped at several degrees toward the exit port 2111. Exit port 2111 may simply be an orifice, or may include an exit flow channel, as desired.

FIG. 23, which illustrates an underside perspective iew of the modular quench unit 2100, illustrates a sloped bottom floor of the basin 2106 that connects to an upwardly extending peripheral wall of the basin, and further illustrates exemplary placement and positioning of the electronics housing 2109 and hose 2110. This view also clearly illustrtates cleats (e.g., 2122) which may be formed on the ends of the mounting pegs for gripping side walls of the cooler, and side grips or handles (e.g., 2124) which may be used to move the quench unit onto and off of the cooler.

Figure 24:
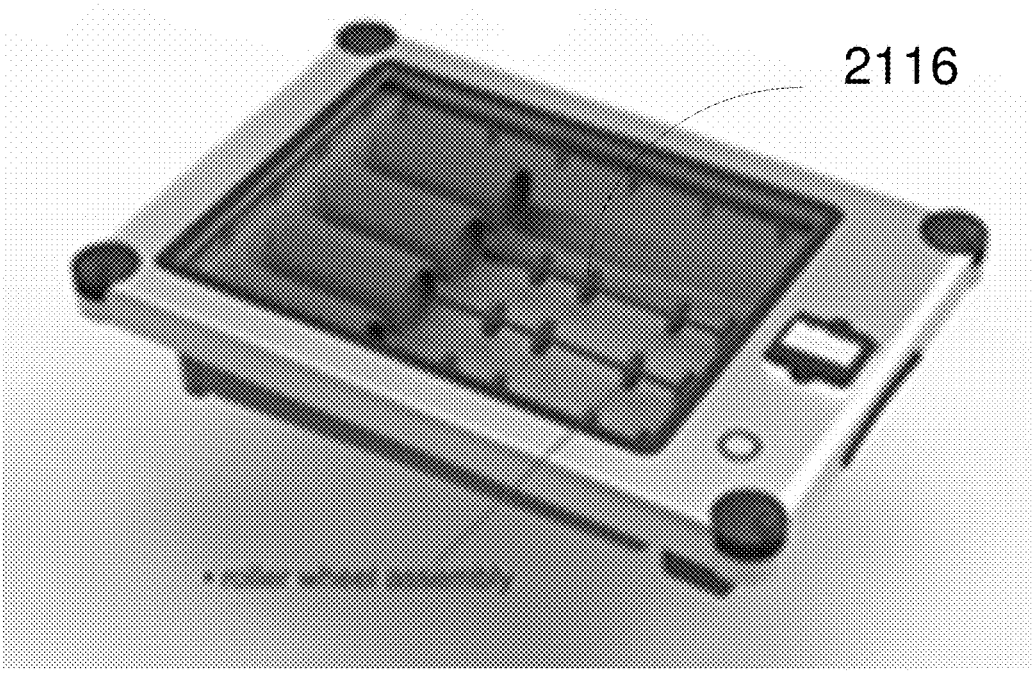
FIG. 24 is a top perspective view of the embodiment of FIG. 21 illustrating a beverage rotation system.
Figure 26:
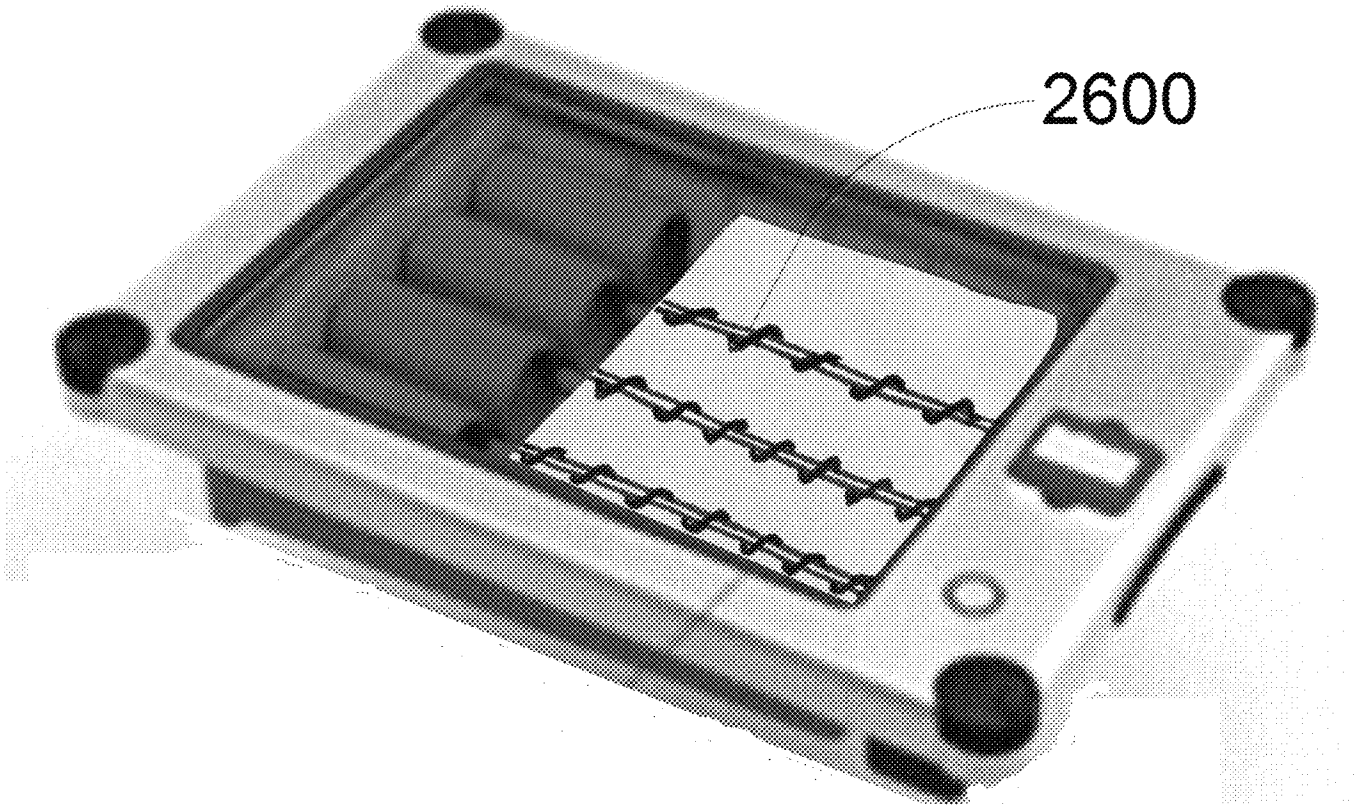
FIG. 26 depicts an alternative beverage rotation system in accordance with the disclosure.

Referring to FIG. 24, the basin 2106 may also contain a removable roller wheel assembly 2116 which may by action of the rolling wheels, cause the beverages to rotate around their longitudinal axes to enhance removal of heat from the beverage containers. The wheel assembly 2116 may mechanically couple to a drive port that is connected to an electric motor within the electronics housing 2109. In another embodiment, instead of wheels on axles, as depicted in FIG. 26, helical screws 2600 can be mounted on the axles that traverse the length of the unit that have a sufficient diameter, pitch, and surface friction to both cause drinks to rotate that are situated parallel to the screws, but also to permit drinks to be rotated that are disposed across the screws, in a manner similar to which a worm gear causes an intermeshed gear to rotate.

Figure 25A:
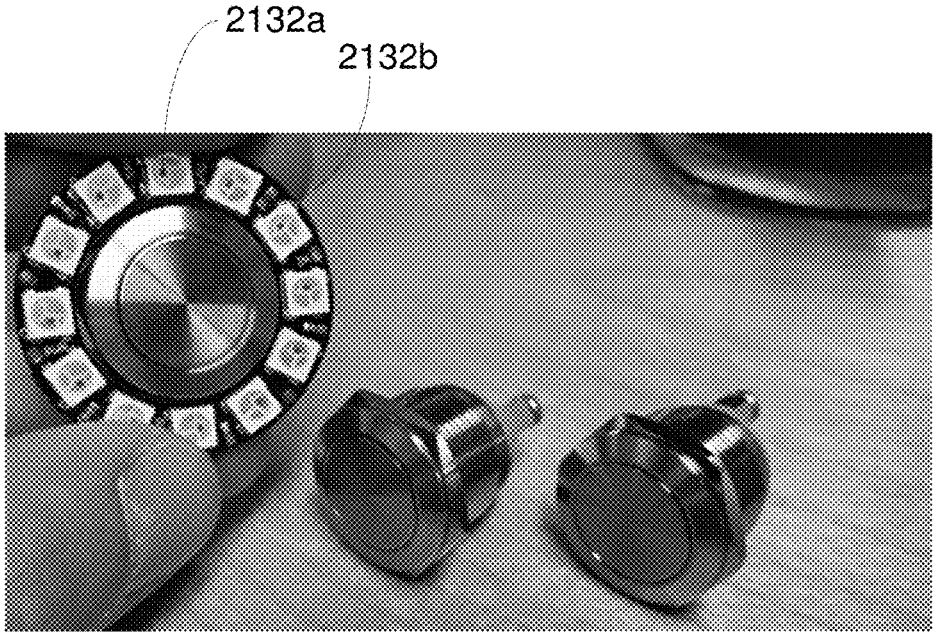
FIGS. 25A-25D are various views of an illustrative control button in accordance with the present disclosure.
Figure 25B:
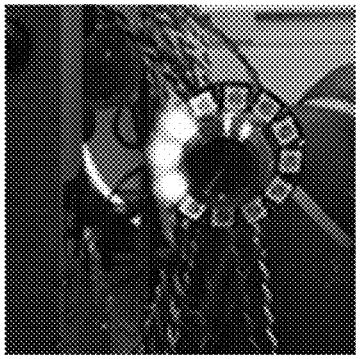
Figure 25C:
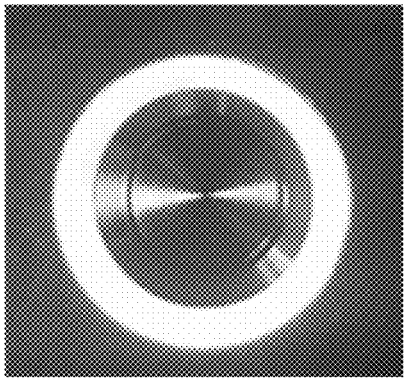
Figure 25D:
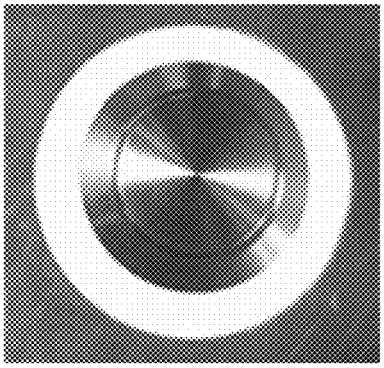

To illustrate to a user of the system that the beverages are sufficiently cooled, the quench unit 2100 also includes lighting elements, such as an LED bezel 2118 that wraps around all or a portion of the top of the basin 2106. The LED bezel 2018 may be illuminated based on current conditions. For example, in some embodiments, the LED bezel 2018 may emit a red flashing light when it is determined that the pump 2018 is not functioning properly, or to indicate a condition of the beverages not being cooled. Referring to FIG. 21, the quench unit also includes an activation button 2130 positioned on the platform 2102 of the unit that includes a set of LED elements (e.g., 2132*a*, 2132*b*) positioned circumferentially around the rim of the button. In some embodiments, the button 2130 includes 12 LED elements, although a different number of elements may be used. During operation of the modular quench unit, when warm drinks are inserted into the quench unit, the operator presses the activation button to start a quench cycle. During the quench cycle, the LEDs are activated to progressively illuminate in series as the quench cycle progresses, such that the number of the LEDs flashing blue out of the total number of LED elements indicates the fraction of the quench cycle that has been completed. For example, when 50% of the quench cycle is complete, six of the LED elements, positioned, for example, from 1:00 to 6:00 on the button, would be lighted solid blue, while LED elements positioned from 7:00 to 12:00 may be configured to flash another color, such as yellow. FIG. 25B shows an example of such fractional illumination in which three LED elements are illuminated. The flashing rate may be set at on one second, off one second, although other rates may be used. Once the entire quench cycle is completed, all 12 LED elements are configured to illuminate solid blue, as shown in FIG. 25C. In this manner, the lighting elements, which can be viewed from a distance, indicate the degree to which the beverages in the quench unit have been cooler, and how much longer it will take to cool them to an optimal temperature, for example 39 degree Fahrenheit. If the operator opens the quench unit before the quench cycle is completed, the LEDs may be configured to flash a color indicative of an interruption, such as red, as shown in FIG. 25D. It will be appreciated that the disclosed button with surrounding LEDs can be used in combination with any cooling system disclosed herein, and that its application is not limited to the modular retrofit unit 2100.

Moreover, if desired, a photodetector can be provided and located behind a hole or small window in the frame 2102 (or simply on or within the frame 2102) that can detect when a top of the cooler is opened. A signal can be sent from the photodetector to a controller within the electronics housing 2109 that then stops the pump and rotation of the beverages, if desired, and energizes one or more LEDs in the bezel 2118 indicating the condition of the beverages. If desired, the LED ring surrounding the pushbutton 2130 can flash red or another color when the photodetector is activated upon opening the cooler.

Furthermore, any control system aspects described elsewhere herein can be adapted to the modular retrofit unit 2100. If desired, the control system can advantageously be implemented using an Ardunio or Raspberry Pi-based platform. The system can be controlled remotely, for example, by way of a bluetooth connection to a smartphone. Among other variables, a bluetooth connection to a mobile app can communicate one or more of (i) the current state of the unit, such as whether the quench cycle is operating or complete, interrupted, or idle (ii) the remaining quench time (if in a quench cycle), (iii) a default quench time that may be adjustable via the smartphone app, and (iv) the percent of battery life remaining. In addition, a level sensor can be incorporated into the electronics housing 2109 that can detect when the system is at an unacceptable slant for purposes of operation.

Figure 27A:
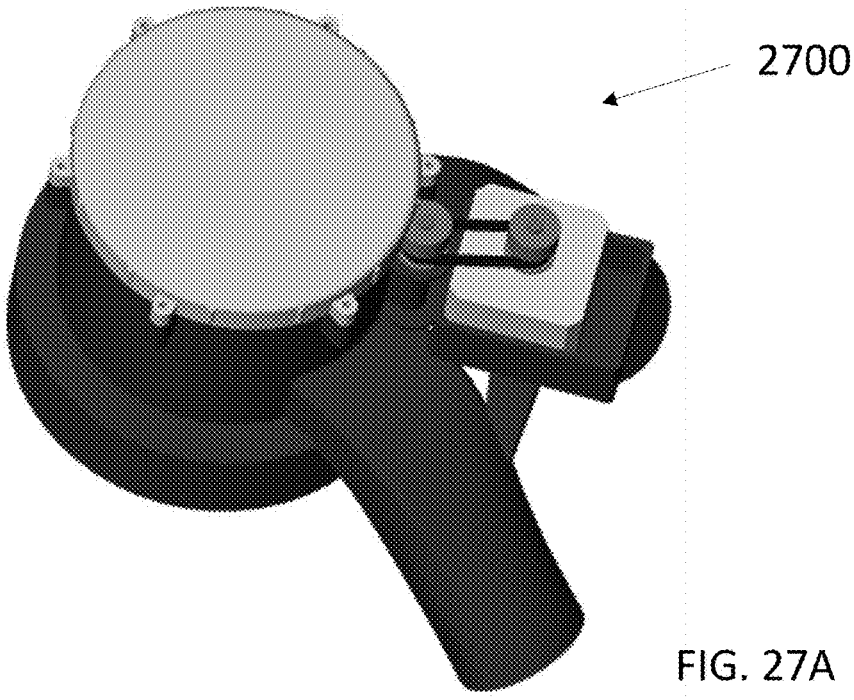
Figure 27B:
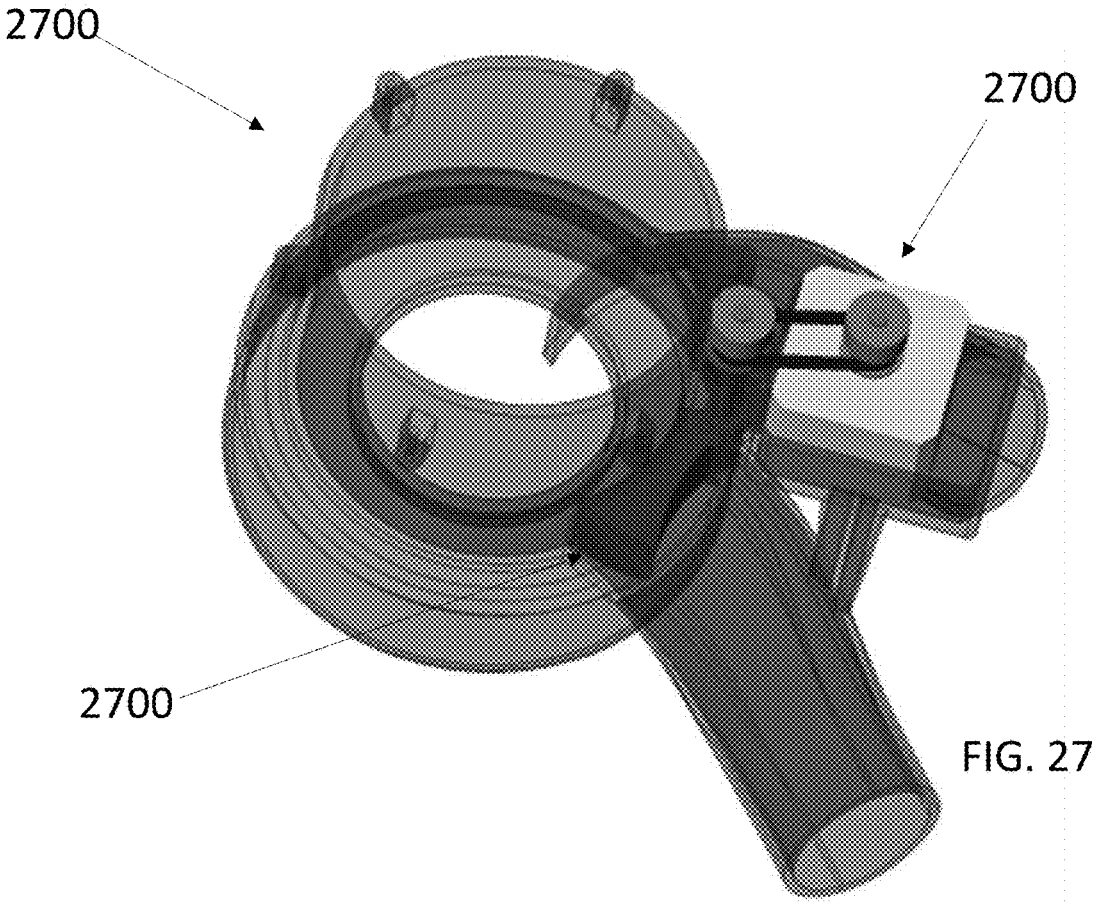

In further accordance with the disclosure, FIGS. 27A-27E illustrate an exemplary embodiment of an ice diverter 2600 in accordance with the disclosure. FIG. 27A is an external view of the diverter mechanism, and FIGS. 27B-27D are schematic perspective views of the diverter 2700. In operation, the diverter is fitted onto an output chute of an ice maker, wherein ice from the ice maker passes through an entrance port in the middle of the diverter 2700. A pivotable gate 2710 is provided that may be swung about an axle to block one of two output chutes that the ice may pass through. The gate can be manually operated, but is preferably movable by a motor driven belt and pulley mechanism to alter the position of the gate in response to feedback from one or more sensors that detect the ice level in reservoirs or containers to which each chute leads. In a first position, as illustrated in FIG. 27B, the gate 2710 covers one ice chute, permitting the other to pass ice therethrough. In a second position after rotation, the gate 2710 covers the other chute as shown in FIG. 27D. Both positions of the gate are shown in FIG. 27C. and FIG. 27E illustrates the gate 2710 midway between each position. The diverter 2700 can be used in combination with any device set forth herein having an icemaker, or may generally be integrated or attachable to any desired ice maker.

In one embodiment, a cooling chest in accordance with the present disclosure may be provided including an ice maker and a diverter 2700 that can be operated in two different diverter modes. When the gate 2710 covers a first chute, ice can travel down a second chute to an ice bucket, or simply along a path out of the cooling chest if ice is desired. When the gate 2710 is moved to the second position, the second chute is covered and the first chute is exposed, permitting ice to be directed to a cooling tank in the cooler as set forth in some of the embodiments above. For example, if a user does not need accumulated ice to absorb thermal energy from drinks that need to be quenched, they can select the "ice only" mode of operation. On the other hand, if the user wishes to use the cooler to also quench beverages, the following logic can apply to operate the motor to operate the gate 2710 via a controller (e.g., as set forth elsewhere herein). If the "quench tank" needs ice (determined, for example, by way of an electric eye, mechanical limit or other suitable sensor), the quench mode has priority, and the gate 2710 will divert the ice to the quench tank via a first chute while blocking a second chute. If the quench tank is full (or the user runs in "ice-only" mode), the gate 2710 will close off the first chute, allowing ice to flow down the second chute, for example, to a holding bin or other storage area. If the ice storage area supplied by the second chute is full, then the ice-machine's ice-making ability can be suspended until ice is called for from either the ice storage area or the quench tank.

Figure 28:
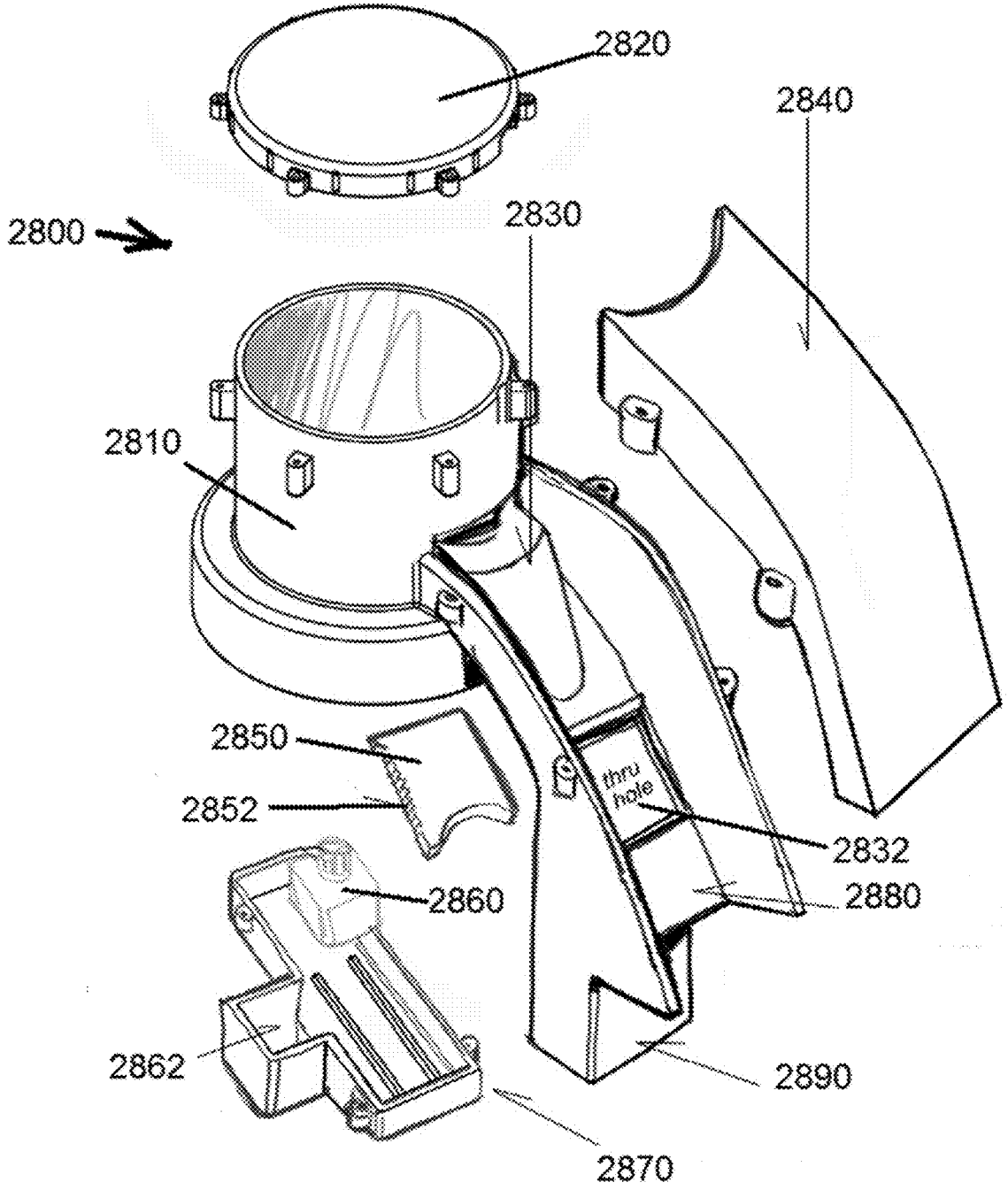
FIG. 28 is an exploded view of a further embodiment of an ice diverter in accordance with the disclosure.

FIG. 28 presents a further embodiment of an ice diverter 2800 including a linearly displaceable motor activated gate in accordance with the disclosure. Diverter 2800 includes a generally cylindrical body 2810 including a removable top 2820. Body 2810 is attached to an ice output chute 2830 that can be covered by a cover 2840. Chute 2830 defines an opening 2832 therethrough that can be selectively blocked and unblocked by a linearly displaceable gate 2850 that is linearly displaceable along a track disposed along the underside of chute 2830. When gate 2850 is in an open condition, ice that exits the body 2810 proceeds down chute 2830 and falls into opening 2832 and down through lower chute exit 2890 to a first location, such as a quench tank including a mixture of ice and water. When gate 2850 is closed however, ice proceeds all the way down chute 2830, and through chute exit 2880 to a second location, such as an ice bucket. Gate 2850 as illustrated includes an integral gear rack 2852 along a linear edge of the gate. Rack 2852 engages with a sprocket on a motor 2860 disposed in a motor compartment 2862 of a motor housing tray 2870. In any event, any of the disclosed diverters can be actuated by a solenoid through a linkage. The solenoid can move the gate from a first position to a second position when the solenoid is energized. When the solenoid is de-energized the gate can return to the first position.

Figure 29A:
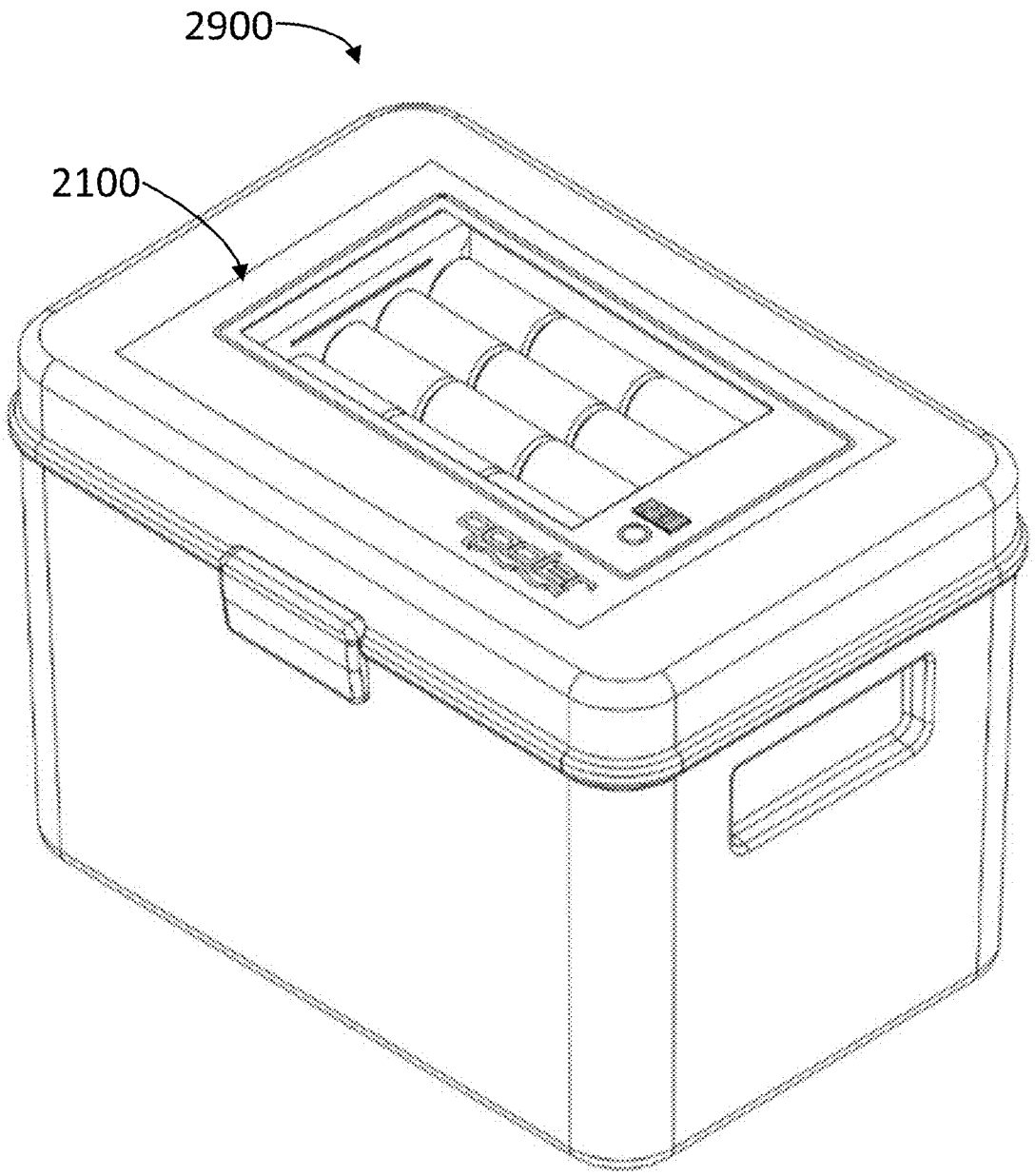
FIGS. 29A-29C are first and second perspective views and a top plan view of an illustrative cooler in accordance with the disclosure that incorporates an active cooling unit in the lid thereof similar in form and function to the embodiment of FIG. 21.
Figure 29B:
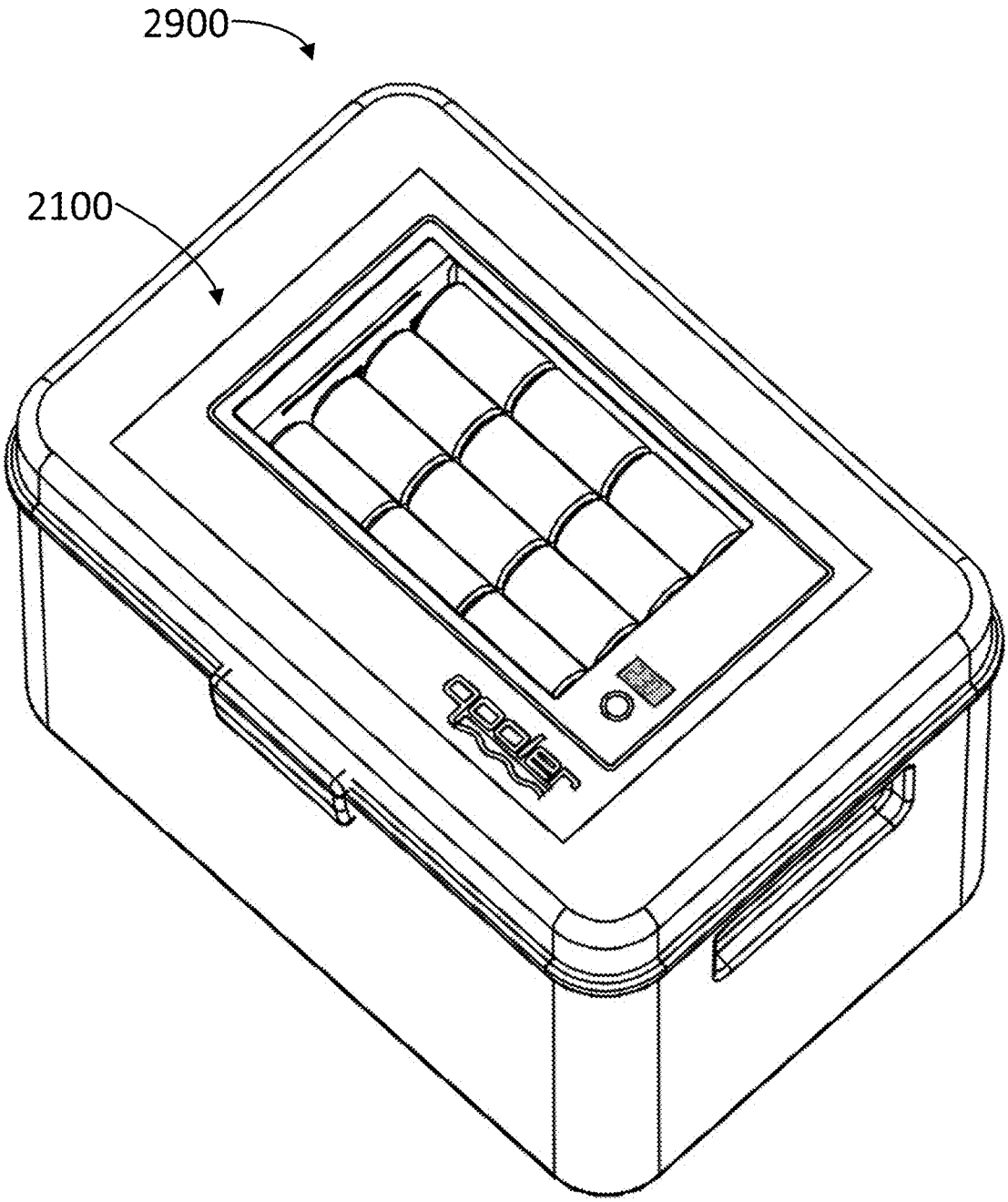
Figure 29C:
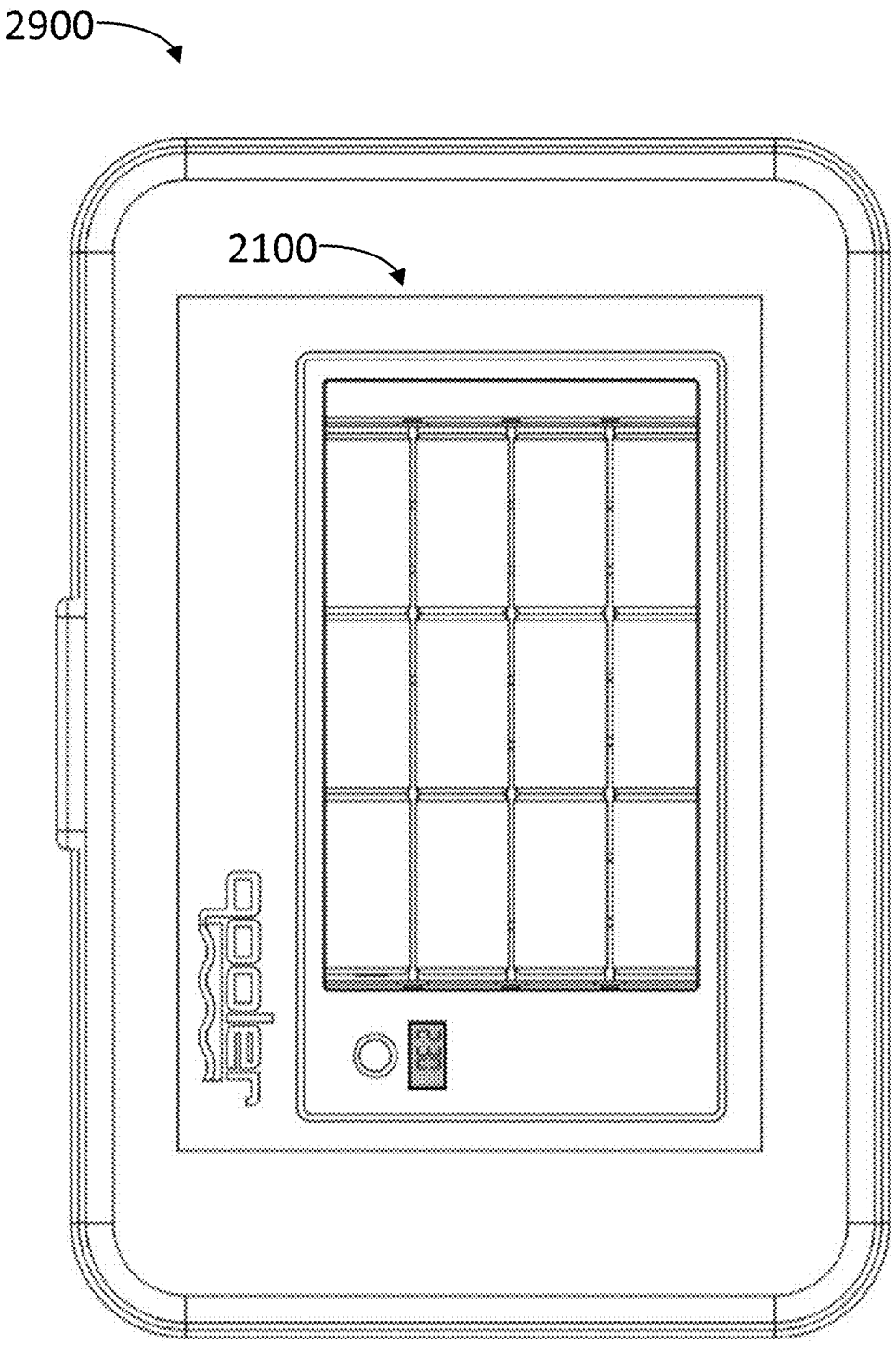

FIGS. 29A-29C, are first and second perspective views and a top plan view of an illustrative cooler 2900 in accordance with the disclosure that incorporates an active cooling unit in the lid thereof similar in form and function to the embodiment 2100 of FIG. 21. The cooler design that is illustrated is similar in external appearance to those sold by the Yeti Company (Austin, Tex.), and it is used for illustrative purposes only. It will be appreciated that the lid of the cooler can be configured to use a unit 2100 that is adapted to be integrated into the lid. That is to say, the unit can drop into an opening of the lid of the cooler, or it can be wholly integrated into the lid of the cooler. If desired, the quench container housing the beverage containers can be covered with a lid, such as a transparent plastic lid, if desired, or it may be kept open.

Example—BQ™ Controller

FIG. 13 illustrates inventive aspects of a BQ™ controller 601 for controlling a system such as that illustrated in FIG. 12 implementing some of the embodiments disclosed herein. In this embodiment, the BQ™ controller 601 may serve to aggregate, process, store, search, serve, identify, instruct, generate, match, and/or facilitate interactions with a computer through various technologies, and/or other related data.

Typically, a user or users, e.g., 633*a*, which may be people or groups of users and/or other systems, may engage information technology systems (e.g., computers) to facilitate operation of the system and information processing. In turn, computers employ processors to process information; such processors 603 may be referred to as central processing units (CPU). One form of processor is referred to as a microprocessor. CPUs use communicative circuits to pass binary encoded signals acting as instructions to enable various operations. These instructions may be operational and/or data instructions containing and/or referencing other instructions and data in various processor accessible and operable areas of memory 629 (e.g., registers, cache memory, random access memory, etc.). Such communicative instructions may be stored and/or transmitted in batches (e.g., batches of instructions) as programs and/or data components to facilitate desired operations. These stored instruction codes, e.g., programs, may engage the CPU circuit components and other motherboard and/or system components to perform desired operations. One type of program is a computer operating system, which, may be executed by CPU on a computer; the operating system enables and facilitates users to access and operate computer information technology and resources. Some resources that may be employed in information technology systems include: input and output mechanisms through which data may pass into and out of a computer; memory storage into which data may be saved; and processors by which information may be processed. These information technology systems may be used to collect data for later retrieval, analysis, and manipulation, which may be facilitated through a database program. These information technology systems provide interfaces that allow users to access and operate various system components.

In one embodiment, the BQ™ controller 601 may be connected to and/or communicate with entities such as, but not limited to: one or more users from user input devices 611; peripheral devices 612, components of the cooling chest 10; an optional cryptographic processor device 628; and/or a communications network 613. For example, the BQ™ controller 601 may be connected to and/or communicate with users, e.g., 633*a*, operating client device(s), e.g., 633*b*, including, but not limited to, personal computer(s), server(s) and/or various mobile device(s) including, but not limited to, cellular telephone(s), smartphone(s) (e.g., iPhone®, Blackberry®, Android OS-based phones etc.), tablet computer(s) (e.g., Apple iPad™, HP Slate™, Motorola Xoom™, etc.), eBook reader(s) (e.g., Amazon Kindle™, Barnes and Noble's Nook™ eReader, etc.), laptop computer(s), notebook(s), netbook(s), gaming console(s) (e.g., XBOX Live™ Nintendo® DS, Sony Play Station® Portable, etc.), portable scanner(s) and/or the like.

Networks are commonly thought to comprise the interconnection and interoperation of clients, servers, and intermediary nodes in a graph topology. It should be noted that the term "server" as used throughout this application refers generally to a computer, other device, program, or combination thereof that processes and responds to the requests of remote users across a communications network. Servers serve their information to requesting "clients." The term "client" as used herein refers generally to a computer, program, other device, user and/or combination thereof that is capable of processing and making requests and obtaining and processing any responses from servers across a communications network. A computer, other device, program, or combination thereof that facilitates, processes information and requests, and/or furthers the passage of information from a source user to a destination user is commonly referred to as a "node." Networks are generally thought to facilitate the transfer of information from source points to destinations. A node specifically tasked with furthering the passage of information from a source to a destination is commonly called a "router." There are many forms of networks such as Local Area Networks (LANs), Pico networks, Wide Area Networks (WANs), Wireless Networks (WLANs), etc. For example, the Internet is generally accepted as being an interconnection of a multitude of networks whereby remote clients and servers may access and interoperate with one another.

The BQ™ controller 601 may be based on computer systems that may comprise, but are not limited to, components such as: a computer systemization 602 connected to memory 629.

Computer Systemization

A computer systemization 602 may comprise a clock 630, central processing unit ("CPU(s)" and/or "processor(s)" (these terms are used interchangeable throughout the disclosure unless noted to the contrary)) 603, a memory 629 (e.g., a read only memory (ROM) 606, a random access memory (RAM) 605, etc.), and/or an interface bus 607, and most frequently, although not necessarily, are all interconnected and/or communicating through a system bus 604 on one or more (mother)board(s) 602 having conductive and/or otherwise transportive circuit pathways through which instructions (e.g., binary encoded signals) may travel to effect communications, operations, storage, etc. Optionally, the computer systemization may be connected to an internal power source 686; e.g., optionally the power source may be internal. Optionally, a cryptographic processor 626 and/or transceivers (e.g., ICs) 674 may be connected to the system bus. In another embodiment, the cryptographic processor and/or transceivers may be connected as either internal and/or external peripheral devices 612 via the interface bus I/O. In turn, the transceivers may be connected to antenna(s) 675, thereby effectuating wireless transmission and reception of various communication and/or sensor protocols; for example the antenna(s) may connect to: a Texas Instruments WiLink WL1283 transceiver chip (e.g., providing 802.11n, Bluetooth 3.0, FM, global positioning system (GPS) (thereby allowing BQ™ controller to determine its location)); Broadcom BCM4329FKUBG transceiver chip (e.g., providing 802.11n, Bluetooth 2.1+EDR, FM, etc.); a Broadcom BCM4750IUB8 receiver chip (e.g., GPS); an Infineon Technologies X-Gold 618-PMB9800 (e.g., providing 2G/3G HSDPA/HSUPA communications); and/or the like. The system clock typically has a crystal oscillator and generates a base signal through the computer systemization's circuit pathways. The clock is typically coupled to the system bus and various clock multipliers that will increase or decrease the base operating frequency for other components interconnected in the computer systemization. The clock and various components in a computer systemization drive signals embodying information throughout the system. Such transmission and reception of instructions embodying information throughout a computer systemization may be commonly referred to as communications. These communicative instructions may further be transmitted, received, and the cause of return and/or reply communications beyond the instant computer systemization to: communications networks, input devices, other computer systemizations, peripheral devices, and/or the like. Of course, any of the above components may be connected directly to one another, connected to the CPU, and/or organized in numerous variations employed as exemplified by various computer systems.

The CPU comprises at least one high-speed data processor adequate to execute program components for executing user and/or system-generated requests. Often, the processors themselves will incorporate various specialized processing units, such as, but not limited to: integrated system (bus) controllers, memory management control units, floating point units, and even specialized processing sub-units like graphics processing units, digital signal processing units, and/or the like. Additionally, processors may include internal fast access addressable memory, and be capable of mapping and addressing memory 629 beyond the processor itself; internal memory may include, but is not limited to: fast registers, various levels of cache memory (e.g., level 1, 2, 3, etc.), RAM, etc. The processor may access this memory through the use of a memory address space that is accessible via instruction address, which the processor can construct and decode allowing it to access a circuit path to a specific memory address space having a memory state. The CPU may be a microprocessor such as: AMD's Athlon, Duron and/or Opteron; ARM's application, embedded and secure processors; IBM and/or Motorola's DragonBall and PowerPC; IBM's and Sony's Cell processor; Intel's Celeron, Core (2) Duo, Itanium, Pentium, Xeon, and/or XScale; and/or the like processor(s). The CPU interacts with memory through instruction passing through conductive and/or transportive conduits (e.g., (printed) electronic and/or optic circuits) to execute stored instructions (i.e., program code) according to conventional data processing techniques. Such instruction passing facilitates communication within the BQ™ controller and beyond through various interfaces. Should processing requirements dictate a greater amount speed and/or capacity, distributed processors (e.g., Distributed BQ™ embodiments), mainframe, multi-core, parallel, and/or super-computer architectures may similarly be employed. Alternatively, should deployment requirements dictate greater portability, smaller Personal Digital Assistants (PDAs) may be employed.

Depending on the particular implementation, features of the BQ™ implementations may be achieved by implementing a microcontroller such as CAST's R8051XC2 microcontroller; Intel's MCS 51 (i.e., 8051 microcontroller); and/or the like. Also, to implement certain features of the BQ™ embodiments, some feature implementations may rely on embedded components, such as: Application-Specific Integrated Circuit ("ASIC"), Digital Signal Processing ("DSP"), Field Programmable Gate Array ("FPGA"), and/or the like embedded technology. For example, any of the BQ™ component collection (distributed or otherwise) and/ or features may be implemented via the microprocessor and/or via embedded components; e.g., via ASIC, coprocessor, DSP, FPGA, and/or the like. Alternately, some implementations of the BQ™ may be implemented with embedded components that are configured and used to achieve a variety of features or signal processing.

Depending on the particular implementation, the embedded components may include software solutions, hardware solutions, and/or some combination of both hardware/software solutions. For example, BQ™ features discussed herein may be achieved through implementing FPGAs, which are a semiconductor devices containing programmable logic components called "logic blocks", and programmable interconnects, such as the high performance FPGA Virtex series and/or the low cost Spartan series manufactured by Xilinx. Logic blocks and interconnects can be programmed by the customer or designer, after the FPGA is manufactured, to implement any of the BQ™ features. A hierarchy of programmable interconnects allow logic blocks to be interconnected as needed by the BQ™ system designer/administrator, somewhat like a one-chip programmable breadboard. An FPGA's logic blocks can be programmed to perform the function of basic logic gates such as AND, and XOR, or more complex combinational functions such as decoders or simple mathematical functions. In most FPGAs, the logic blocks also include memory elements, which may be simple flip-flops or more complete blocks of memory. In some circumstances, the BQ™ may be developed on regular FPGAs and then migrated into a fixed version that more resembles ASIC implementations. Alternate or coordinating implementations may migrate BQ™ controller features to a final ASIC instead of or in addition to FPGAs. Depending on the implementation all of the aforementioned embedded components and microprocessors may be considered the "CPU" and/or "processor" for the BQ™.

Power Source

The power source 686 may be of any standard form for powering small electronic circuit board devices such as the following power cells: alkaline, lithium hydride, lithium ion, lithium polymer, nickel cadmium, solar cells, and/or the like. Other types of AC or DC power sources may be used as well. In the case of solar cells, in one embodiment, the case provides an aperture through which the solar cell may capture photonic energy. The power cell 686 is connected to at least one of the interconnected subsequent components of the BQ™ thereby providing an electric current to all subsequent components. In one example, the power source 686 is connected to the system bus component 604. In an alternative embodiment, an outside power source 686 is provided through a connection across the I/O 608 interface. For example, a USB and/or IEEE 1394 connection carries both data and power across the connection and is therefore a suitable source of power.

Interface Adapters

Interface bus(ses) 607 may accept, connect, and/or communicate to a number of interface adapters, conventionally although not necessarily in the form of adapter cards, such as but not limited to: input output interfaces (I/O) 608, storage interfaces 609, network interfaces 610, and/or the like. Optionally, cryptographic processor interfaces 627 similarly may be connected to the interface bus. The interface bus provides for the communications of interface adapters with one another as well as with other components of the computer systemization. Interface adapters are adapted for a compatible interface bus. Interface adapters conventionally connect to the interface bus via a slot architecture. Conventional slot architectures may be employed, such as, but not limited to: Accelerated Graphics Port (AGP), Card Bus, (Extended) Industry Standard Architecture ((E)ISA), Micro Channel Architecture (MCA), NuBus, Peripheral Component Interconnect (Extended) (PCI(X)), PCI Express, Personal Computer Memory Card International Association (PCMCIA), and/or the like.

Storage interfaces 609 may accept, communicate, and/or connect to a number of storage devices such as, but not limited to: storage devices 614, removable disc devices, and/or the like. Storage interfaces may employ connection protocols such as, but not limited to: (Ultra) (Serial) Advanced Technology Attachment (Packet Interface) ((Ultra) (Serial) ATA(PI)), (Enhanced) Integrated Drive Electronics ((E)IDE), Institute of Electrical and Electronics Engineers (IEEE) 1394, fiber channel, Small Computer Systems Interface (SCSI), Universal Serial Bus (USB), and/or the like.

Network interfaces 610 may accept, communicate, and/or connect to a communications network 613. Through a communications network 613, the BQ™ controller is accessible through remote clients 633*b* (e.g., computers with web browsers) by users 633*a*. Network interfaces may employ connection protocols such as, but not limited to: direct connect, Ethernet (thick, thin, twisted pair 10/100/1000 Base T, and/or the like), Token Ring, wireless connection such as IEEE 802.11a-x, and/or the like. Should processing requirements dictate a greater amount speed and/or capacity, distributed network controllers (e.g., Distributed BQ™), architectures may similarly be employed to pool, load balance, and/or otherwise increase the communicative bandwidth required by the BQ™ controller. A communications network may be any one and/or the combination of the following: a direct interconnection; the Internet; a Local Area Network (LAN); a Metropolitan Area Network (MAN); an Operating Missions as Nodes on the Internet (OMNI); a secured custom connection; a Wide Area Network (WAN); a wireless network (e.g., employing protocols such as, but not limited to a Wireless Application Protocol (WAP), I-mode, and/or the like); and/or the like. A network interface may be regarded as a specialized form of an input output interface. Further, multiple network interfaces 610 may be used to engage with various communications network types 613. For example, multiple network interfaces may be employed to allow for the communication over broadcast, multicast, and/or unicast networks.

Input Output interfaces (I/O) 608 may accept, communicate, and/or connect to user input devices 611, peripheral devices 612, cryptographic processor devices 628, and/or the like. I/O may employ connection protocols such as, but not limited to: audio: analog, digital, monaural, RCA, stereo, and/or the like; data: Apple Desktop Bus (ADB), IEEE 1394a-b, serial, universal serial bus (USB); infrared; joystick; keyboard; midi; optical; PC AT; PS/2; parallel; radio; video interface: Apple Desktop Connector (ADC), BNC, coaxial, component, composite, digital, Digital Visual Interface (DVI), high-definition multimedia interface (HDMI), RCA, RF antennae, S-Video, VGA, and/or the like; wireless transceivers: 802.11a/b/g/n/x; Bluetooth; cellular (e.g., code division multiple access (CDMA), high speed packet access (HSPA(+)), high-speed downlink packet access (HSDPA), global system for mobile communications (GSM), long term evolution (LTE), WiMax, etc.); and/or the like. One typical output device may include a video display, which typically comprises a Cathode Ray Tube (CRT) or Liquid Crystal Display (LCD) based monitor with an interface (e.g., DVI circuitry and cable) that accepts signals from a video interface, may be used. The video interface composites information generated by a computer systemization and generates video signals based on the composited information in a video memory frame. Another output device is a television set, which accepts signals from a video interface. Typically, the video interface provides the composited video information through a video connection interface that accepts a video display interface (e.g., an RCA composite video connector accepting an RCA composite video cable; a DVI connector accepting a DVI display cable, etc.).

User input devices 611 often are a type of peripheral device 612 (see below) and may include: card readers, dongles, finger print readers, gloves, graphics tablets, joysticks, keyboards, microphones, mouse (mice), remote controls, retina readers, touch screens (e.g., capacitive, resistive, etc.), trackballs, trackpads, sensors (e.g., accelerometers, ambient light, GPS, gyroscopes, proximity, etc.), styluses, and/or the like.

Peripheral devices 612, such as other components of the cooling chest system 10, including temperature sensors, ice dispensers (if provided) and the like may be connected and/or communicate to I/O and/or other facilities of the like such as network interfaces, storage interfaces, directly to the interface bus, system bus, the CPU, and/or the like. Peripheral devices may be external, internal and/or part of the BQ™ controller. Peripheral devices may also include, for example, an antenna, audio devices (e.g., line-in, line-out, microphone input, speakers, etc.), cameras (e.g., still, video, webcam, etc.), drive motors, ice maker 68, lighting, video monitors and/or the like.

Cryptographic units such as, but not limited to, microcontrollers, processors 626, interfaces 627, and/or devices 628 may be attached, and/or communicate with the BQ™ controller. A MC68HC16 microcontroller, manufactured by Motorola Inc., may be used for and/or within cryptographic units. The MC68HC16 microcontroller utilizes a 16-bit multiply-and-accumulate instruction in the 16 MHz configuration and requires less than one second to perform a 512-bit RSA private key operation. Cryptographic units support the authentication of communications from interacting agents, as well as allowing for anonymous transactions. Cryptographic units may also be configured as part of CPU. Equivalent microcontrollers and/or processors may also be used. Other commercially available specialized cryptographic processors include: the Broadcom's CryptoNetX and other Security Processors; nCipher's nShield, SafeNet's Luna PCI (e.g., 7100) series; Semaphore Communications' 40 MHz Roadrunner 184; Sun's Cryptographic Accelerators (e.g., Accelerator 6000 PCIe Board, Accelerator 500 Daughtercard); Via Nano Processor (e.g., L2100, L2200, U2400) line, which is capable of performing 500+MB/s of cryptographic instructions; VLSI Technology's 33 MHz 6868; and/or the like.

Memory

Generally, any mechanization and/or embodiment allowing a processor to affect the storage and/or retrieval of information is regarded as memory 629 (or 68, 72, etc.). However, memory is a fungible technology and resource, thus, any number of memory embodiments may be employed in lieu of or in concert with one another. It is to be understood that the BQ™ controller and/or a computer systemization may employ various forms of memory 629. For example, a computer systemization may be configured wherein the functionality of on-chip CPU memory (e.g., registers), RAM, ROM, and any other storage devices are provided by a paper punch tape or paper punch card mechanism; of course such an embodiment would result in an extremely slow rate of operation. In a typical configuration, memory 629 will include ROM 606, RAM 605, and a storage device 614. A storage device 614 may be any conventional computer system storage. Storage devices may include a drum; a (fixed and/or removable) magnetic disk drive; a magneto-optical drive; an optical drive (i.e., Blueray, CD ROM/RAM/Recordable (R)/ReWritable (RW), DVD R/RW, HD DVD R/RW etc.); an array of devices (e.g., Redundant Array of Independent Disks (RAID)); solid state memory devices (USB memory, solid state drives (SSD), etc.); other processor-readable storage mediums; and/or other devices of the like. Thus, a computer systemization generally requires and makes use of memory.

Component Collection

The memory 629 may contain a collection of program and/or database components and/or data such as, but not limited to: operating system component(s) 615 (operating system); information server component(s) 616 (information server); user interface component(s) 617 (user interface); Web browser component(s) 618 (Web browser); database(s) 619; mail server component(s) 621; mail client component(s) 622; cryptographic server component(s) 620 (cryptographic server) and/or the like (i.e., collectively a component collection). These components may be stored and accessed from the storage devices and/or from storage devices accessible through an interface bus. Although non-conventional program components such as those in the component collection, typically, are stored in a local storage device 614, they may also be loaded and/or stored in memory such as: peripheral devices, RAM, remote storage facilities through a communications network, ROM, various forms of memory, and/or the like.

Operating System

The operating system component 615 is an executable program component facilitating the operation of the BQ™ controller. Typically, the operating system facilitates access of I/O, network interfaces, peripheral devices, storage devices, and/or the like. The operating system may be a highly fault tolerant, scalable, and secure system such as: Apple Macintosh OS X (Server); AT&T Plan 9; Be OS; Unix and Unix-like system distributions (such as AT&T's UNIX; Berkley Software Distribution (BSD) variations such as FreeBSD, NetBSD, OpenBSD, and/or the like; Linux distributions such as Red Hat, Ubuntu, and/or the like); and/or the like operating systems. However, more limited and/or less secure operating systems also may be employed such as Apple Macintosh OS, IBM OS/2, Microsoft DOS, Microsoft Windows 2000/2003/3.1/95/98/CE/Millenium/NT/Vista/XP (Server), Palm OS, and/or the like. An operating system may communicate to and/or with other components in a component collection, including itself, and/or the like. Most frequently, the operating system communicates with other program components, user interfaces, and/or the like. For example, the operating system may contain, communicate, generate, obtain, and/or provide program component, system, user, and/or data communications, requests, and/or responses. The operating system, once executed by the CPU, may enable the interaction with communications networks, data, I/O, peripheral devices, program components, memory, user input devices, and/or the like. The operating system may provide communications protocols that allow the BQ™ controller to communicate with other entities through a communications network 613. Various communication protocols may be used by the BQ™ controller as a subcarrier transport mechanism for interaction, such as, but not limited to: multicast, TCP/IP, UDP, unicast, and/or the like.

Information Server

An information server component 616 is a stored program component that is executed by a CPU. The information server may be a conventional Internet information server such as, but not limited to Apache Software Foundation's Apache, Microsoft's Internet Information Server, and/or the like. The information server may allow for the execution of program components through facilities such as Active Server Page (ASP), ActiveX, (ANSI) (Objective-) C (++), C# and/or .NET, Common Gateway Interface (CGI) scripts, dynamic (D) hypertext markup language (HTML), FLASH, Java, JavaScript, Practical Extraction Report Language (PERL), Hypertext Pre-Processor (PHP), pipes, Python, wireless application protocol (WAP), WebObjects, and/or the like. The information server may support secure communications protocols such as, but not limited to, File Transfer Protocol (FTP); HyperText Transfer Protocol (HTTP); Secure Hypertext Transfer Protocol (HTTPS), Secure Socket Layer (SSL), messaging protocols (e.g., America Online (AOL) Instant Messenger (AIM), Application Exchange (APEX), ICQ, Internet Relay Chat (IRC), Microsoft Network (MSN) Messenger Service, Presence and Instant Messaging Protocol (PRIM), Internet Engineering Task Force's (IETF's) Session Initiation Protocol (SIP), SIP for Instant Messaging and Presence Leveraging Extensions (SIMPLE), open XML-based Extensible Messaging and Presence Protocol (XMPP) (i.e., Jabber or Open Mobile Alliance's (OMA's) Instant Messaging and Presence Service (IMPS)), Yahoo! Instant Messenger Service, and/or the like. The information server provides results in the form of Web pages to Web browsers, and allows for the manipulated generation of the Web pages through interaction with other program components. After a Domain Name System (DNS) resolution portion of an HTTP request is resolved to a particular information server, the information server resolves requests for information at specified locations on the BQ™ controller based on the remainder of the HTTP request. For example, a request such as http://123.124.125.126/myInformation.html might have the IP portion of the request "123.124.125.126" resolved by a DNS server to an information server at that IP address; that information server might in turn further parse the http request for the "/myInformation.html" portion of the request and resolve it to a location in memory containing the information "myInformation.html." Additionally, other information serving protocols may be employed across various ports, e.g., FTP communications across port 21, and/or the like. An information server may communicate to and/or with other components in a component collection, including itself, and/or facilities of the like. Most frequently, the information server communicates with the BQ™ database 619, operating systems, other program components, user interfaces, Web browsers, and/or the like.

Access to the BQ™ database may be achieved through a number of database bridge mechanisms such as through scripting languages as enumerated below (e.g., CGI) and through inter-application communication channels as enumerated below (e.g., CORBA, WebObjects, etc.). Any data requests through a Web browser are parsed through the bridge mechanism into appropriate grammars as required by the BQ™. In one embodiment, the information server would provide a Web form accessible by a Web browser. Entries made into supplied fields in the Web form are tagged as having been entered into the particular fields, and parsed as such. The entered terms are then passed along with the field tags, which act to instruct the parser to generate queries directed to appropriate tables and/or fields. In one embodiment, the parser may generate queries in standard SQL by instantiating a search string with the proper join/select commands based on the tagged text entries, wherein the resulting command is provided over the bridge mechanism to the BQ™ as a query. Upon generating query results from the query, the results are passed over the bridge mechanism, and may be parsed for formatting and generation of a new results Web page by the bridge mechanism. Such a new results Web page is then provided to the information server, which may supply it to the requesting Web browser.

Also, an information server may contain, communicate, generate, obtain, and/or provide program component, system, user, and/or data communications, requests, and/or responses.

User Interface

Computer interfaces in some respects are similar to automobile operation interfaces. Automobile operation interface elements such as steering wheels, gearshifts, and speedometers facilitate the access, operation, and display of automobile resources, and status. Computer interaction interface elements such as check boxes, cursors, menus, scrollers, and windows (collectively and commonly referred to as widgets) similarly facilitate the access, capabilities, operation, and display of data and computer hardware and operating system resources, and status. Operation interfaces are commonly called user interfaces. Graphical user interfaces (GUIs) such as the Apple Macintosh Operating System's Aqua, IBM's OS/2, Microsoft's Windows 2000/2003/3.1/95/98/CE/Millenium/NT/XP/Vista/7 (i.e., Aero), Unix's X-Windows (e.g., which may include additional Unix graphic interface libraries and layers such as K Desktop Environment (KDE), mythTV and GNU Network Object Model Environment (GNOME)), web interface libraries (e.g., ActiveX, AJAX, (D)HTML, FLASH, Java, JavaScript, etc. interface libraries such as, but not limited to, Dojo, jQuery(UI), MooTools, Prototype, script.aculo.us, SWFObject, Yahoo! User Interface, any of which may be used and) provide a baseline and means of accessing and displaying information graphically to users.

A user interface component 617 is a stored program component that is executed by a CPU. The user interface may be a conventional graphic user interface as provided by, with, and/or atop operating systems and/or operating environments such as already discussed. The user interface may allow for the display, execution, interaction, manipulation, and/or operation of program components and/or system facilities through textual and/or graphical facilities. The user interface provides a facility through which users may affect, interact, and/or operate a computer system. A user interface may communicate to and/or with other components in a component collection, including itself, and/or facilities of the like. Most frequently, the user interface communicates with operating systems, other program components, and/or the like. The user interface may contain, communicate, generate, obtain, and/or provide program component, system, user, and/or data communications, requests, and/or responses.

Web Browser

A Web browser component 618 is a stored program component that is executed by a CPU. The Web browser may be a conventional hypertext viewing application such as Microsoft Internet Explorer or Netscape Navigator. Secure Web browsing may be supplied with 128 bit (or greater) encryption by way of HTTPS, SSL, and/or the like. Web browsers allowing for the execution of program components through facilities such as ActiveX, AJAX, (D)HTML, FLASH, Java, JavaScript, web browser plug-in APIs (e.g., FireFox, Safari Plug-in, and/or the like APIs), and/or the like. Web browsers and like information access tools may be integrated into PDAs, cellular telephones, and/or other mobile devices. A Web browser may communicate to and/or with other components in a component collection, including itself, and/or facilities of the like. Most frequently, the Web browser communicates with information servers, operating systems, integrated program components (e.g., plug-ins), and/or the like; e.g., it may contain, communicate, generate, obtain, and/or provide program component, system, user, and/or data communications, requests, and/or responses. Of course, in place of a Web browser and information server, a combined application may be developed to perform similar functions of both. The combined application would similarly affect the obtaining and the provision of information to users, user agents, and/or the like from the BQ™ enabled nodes. The combined application may be nugatory on systems employing standard Web browsers.

Mail Server

A mail server component 621 is a stored program component that is executed by a CPU 603. The mail server may be a conventional Internet mail server such as, but not limited to sendmail, Microsoft Exchange, and/or the like. The mail server may allow for the execution of program components through facilities such as ASP, ActiveX, (ANSI) (Objective-) C (++), C# and/or .NET, CGI scripts, Java, JavaScript, PERL, PHP, pipes, Python, WebObjects, and/or the like. The mail server may support communications protocols such as, but not limited to: Internet message access protocol (IMAP), Messaging Application Programming Interface (MAPI)/Microsoft Exchange, post office protocol (POP3), simple mail transfer protocol (SMTP), and/or the like. The mail server can route, forward, and process incoming and outgoing mail messages that have been sent, relayed and/or otherwise traversing through and/or to the BQ™.

Access to the BQ™ mail may be achieved through a number of APIs offered by the individual Web server components and/or the operating system.

Also, a mail server may contain, communicate, generate, obtain, and/or provide program component, system, user, and/or data communications, requests, information, and/or responses.

Mail Client

A mail client component 622 is a stored program component that is executed by a CPU 603. The mail client may be a conventional mail viewing application such as Apple Mail, Microsoft Entourage, Microsoft Outlook, Microsoft Outlook Express, Mozilla, Thunderbird, and/or the like. Mail clients may support a number of transfer protocols, such as: IMAP, Microsoft Exchange, POP3, SMTP, and/or the like. A mail client may communicate to and/or with other components in a component collection, including itself, and/or facilities of the like. Most frequently, the mail client communicates with mail servers, operating systems, other mail clients, and/or the like; e.g., it may contain, communicate, generate, obtain, and/or provide program component, system, user, and/or data communications, requests, information, and/or responses. Generally, the mail client provides a facility to compose and transmit electronic mail messages.

Cryptographic Server

A cryptographic server component 620 is a stored program component that is executed by a CPU 603, cryptographic processor 626, cryptographic processor interface 627, cryptographic processor device 628, and/or the like. Cryptographic processor interfaces will allow for expedition of encryption and/or decryption requests by the cryptographic component; however, the cryptographic component, alternatively, may run on a conventional CPU. The cryptographic component allows for the encryption and/or decryption of provided data. The cryptographic component allows for both symmetric and asymmetric (e.g., Pretty Good Protection (PGP)) encryption and/or decryption. The cryptographic component may employ cryptographic techniques such as, but not limited to: digital certificates (e.g., X.509 authentication framework), digital signatures, dual signatures, enveloping, password access protection, public key management, and/or the like. The cryptographic component will facilitate numerous (encryption and/or decryption) security protocols such as, but not limited to: checksum, Data Encryption Standard (DES), Elliptical Curve Encryption (ECC), International Data Encryption Algorithm (IDEA), Message Digest 5 (MD5, which is a one way hash function), passwords, Rivest Cipher (RCS), Rijndael, RSA (which is an Internet encryption and authentication system that uses an algorithm developed in 1977 by Ron Rivest, Adi Shamir, and Leonard Adleman), Secure Hash Algorithm (SHA), Secure Socket Layer (SSL), Secure Hypertext Transfer Protocol (HTTPS), and/or the like. Employing such encryption security protocols, the BQ™ may encrypt all incoming and/or outgoing communications and may serve as node within a virtual private network (VPN) with a wider communications network. The cryptographic component facilitates the process of "security authorization" whereby access to a resource is inhibited by a security protocol wherein the cryptographic component effects authorized access to the secured resource. In addition, the cryptographic component may provide unique identifiers of content, e.g., employing and MD5 hash to obtain a unique signature for a digital audio file. A cryptographic component may communicate to and/or with other components in a component collection, including itself, and/or facilities of the like. The cryptographic component supports encryption schemes allowing for the secure transmission of information across a communications network to enable the BQ™ component to engage in secure transactions if so desired. The cryptographic component facilitates the secure accessing of resources on the BQ™ and facilitates the access of secured resources on remote systems; i.e., it may act as a client and/or server of secured resources. Most frequently, the cryptographic component communicates with information servers, operating systems, other program components, and/or the like. The cryptographic component may contain, communicate, generate, obtain, and/or provide program component, system, user, and/or data communications, requests, and/or responses.

The BQ™ Database

The BQ™ database component 619 may be embodied in a database and its stored data. The database is a stored program component, which is executed by the CPU; the stored program component portion configuring the CPU to process the stored data. The database may be a conventional, fault tolerant, relational, scalable, secure database such as Oracle or Sybase. Relational databases are an extension of a flat file. Relational databases consist of a series of related tables. The tables are interconnected via a key field. Use of the key field allows the combination of the tables by indexing against the key field; i.e., the key fields act as dimensional pivot points for combining information from various tables. Relationships generally identify links maintained between tables by matching primary keys. Primary keys represent fields that uniquely identify the rows of a table in a relational database. More precisely, they uniquely identify rows of a table on the "one" side of a one-to-many relationship.

Alternatively, the BQ™ database may be implemented using various standard data-structures, such as an array, hash, (linked) list, struct, structured text file (e.g., XML), table, and/or the like. Such data-structures may be stored in memory and/or in (structured) files. In another alternative, an object-oriented database may be used, such as Frontier, ObjectStore, Poet, Zope, and/or the like. Object databases can include a number of object collections that are grouped and/or linked together by common attributes; they may be related to other object collections by some common attributes. Object-oriented databases perform similarly to relational databases with the exception that objects are not just pieces of data but may have other types of functionality encapsulated within a given object. If the BQ™ database is implemented as a data-structure, the use of the BQ™ database 619 may be integrated into another component such as the BQ™ component 635. Also, the database may be implemented as a mix of data structures, objects, and relational structures. Databases may be consolidated and/or distributed in countless variations through standard data processing techniques. Portions of databases, e.g., tables, may be exported and/or imported and thus decentralized and/or integrated.

In one embodiment, the database component 619 includes several tables 619*a-n*. A Users (e.g., operators and physicians) table 619*a* may include fields such as, but not limited to: user_id, ssn, dob, first name, last name, age, state, address_firstline, address_secondline, zipcode, devices_list, contact_info, contact_type, alt_contact_info, alt_contact_type, and/or the like to refer to any type of enterable data or selections discussed herein. The Users table may support and/or track multiple entity accounts. A Clients table 619*b* may include fields such as, but not limited to: user_id, client_id, client_ip, client_type, client_model, operating_system, os_version, app_installed_flag, and/or the like. An Apps table 619*c* may include fields such as, but not limited to: app_ID, app_name, app type, OS compatibilities_list, version, timestamp, developer_ID, and/or the like. A beverages table 619*d* including, for example, heat capacities and other useful parameters of different beverages, such as depending on size beverage_name, beverage_size, desired_coolingtemp, cooling_time, favorite_drinker, number_of_beverages, current_beverage_temperature, current_ambient_temperature, and/or the like. An Parameter table 619*e* may include fields including the foregoing fields, or additional ones such as cool_start_time, cool_preset, cooling_rate, and/or the like. A Cool Routines table 619*f* may include a plurality of cooling sequences may include fields such as, but not limited to: sequence_type, sequence_id, flow_rate, avg_water_temp, cooling_time, pump_setting, pump_speed, pump_pressure, power_level, temperature_sensor_id_number, temperature_sensor_location, and/or the like.

In one embodiment, user programs may contain various user interface primitives, which may serve to update the BQ™ platform. Also, various accounts may require custom database tables depending upon the environments and the types of clients the BQ™ system may need to serve. It should be noted that any unique fields may be designated as a key field throughout. In an alternative embodiment, these tables have been decentralized into their own databases and their respective database controllers (i.e., individual database controllers for each of the above tables). Employing standard data processing techniques, one may further distribute the databases over several computer systemizations and/or storage devices. Similarly, configurations of the decentralized database controllers may be varied by consolidating and/or distributing the various database components 619*a-n*. The BQ™ system may be configured to keep track of various settings, inputs, and parameters via database controllers.

The BQ™ database may communicate to and/or with other components in a component collection, including itself, and/or facilities of the like. Most frequently, the BQ™ database communicates with the BQ™ component, other program components, and/or the like. The database may contain, retain, and provide information regarding other nodes and data.

The BQ™ Components

The BQ™ component 635 is a stored program component that is executed by a CPU. In one embodiment, the BQ™ component incorporates any and/or all combinations of the aspects of the BQ™ systems discussed in the previous figures. As such, the BQ™ component affects accessing, obtaining and the provision of information, services, transactions, and/or the like across various communications networks.

The BQ™ component may transform data collected by the cooling chest 10 or input signals received, e.g., from a mobile device, into commands for operating the cooler 10.

The BQ™ component enabling access of information between nodes may be developed by employing standard development tools and languages such as, but not limited to: Apache components, Assembly, ActiveX, binary executables, (ANSI) (Objective-) C (++), C# and/or .NET, database adapters, CGI scripts, Java, JavaScript, mapping tools, procedural and object oriented development tools, PERL, PHP, Python, shell scripts, SQL commands, web application server extensions, web development environments and libraries (e.g., Microsoft's ActiveX; Adobe AIR, FLEX & FLASH; AJAX; (D)HTML; Dojo, Java; JavaScript; jQuery(UI); MooTools; Prototype; script.aculo.us; Simple Object Access Protocol (SOAP); SWFObject; Yahoo! User Interface; and/or the like), WebObjects, and/or the like. In one embodiment, the BQ™ server employs a cryptographic server to encrypt and decrypt communications. The BQ™ component may communicate to and/or with other components in a component collection, including itself, and/or facilities of the like. Most frequently, the BQ™ component communicates with the BQ™ database, operating systems, other program components, and/or the like. The BQ™ may contain, communicate, generate, obtain, and/or provide program component, system, user, and/or data communications, requests, and/or responses.

Distributed BQ™ Embodiments

The structure and/or operation of any of the BQ™ node controller components may be combined, consolidated, and/or distributed in any number of ways to facilitate development and/or deployment. Similarly, the component collection may be combined in any number of ways to facilitate deployment and/or development. To accomplish this, one may integrate the components into a common code base or in a facility that can dynamically load the components on demand in an integrated fashion.

The component collection may be consolidated and/or distributed in countless variations through standard data processing and/or development techniques. Multiple instances of any one of the program components in the program component collection may be instantiated on a single node, and/or across numerous nodes to improve performance through load-balancing and/or data-processing techniques. Furthermore, single instances may also be distributed across multiple controllers and/or storage devices; e.g., databases. All program component instances and controllers working in concert may do so through standard data processing communication techniques.

The configuration of the BQ™ controller will depend on the context of system deployment. Factors such as, but not limited to, the budget, capacity, location, and/or use of the underlying hardware resources may affect deployment requirements and configuration. Regardless of if the configuration results in more consolidated and/or integrated program components, results in a more distributed series of program components, and/or results in some combination between a consolidated and distributed configuration, data may be communicated, obtained, and/or provided. Instances of components consolidated into a common code base from the program component collection may communicate, obtain, and/or provide data. This may be accomplished through intra-application data processing communication techniques such as, but not limited to: data referencing (e.g., pointers), internal messaging, object instance variable communication, shared memory space, variable passing, and/or the like.

If component collection components are discrete, separate, and/or external to one another, then communicating, obtaining, and/or providing data with and/or to other component components may be accomplished through inter-application data processing communication techniques such as, but not limited to: Application Program Interfaces (API) information passage; (distributed) Component Object Model ((D)COM), (Distributed) Object Linking and Embedding ((D)OLE), and/or the like), Common Object Request Broker Architecture (CORBA), Jini local and remote application program interfaces, JavaScript Object Notation (JSON), Remote Method Invocation (RMI), SOAP, process pipes, shared files, and/or the like. Messages sent between discrete component components for inter-application communication or within memory spaces of a singular component for intra-application communication may be facilitated through the creation and parsing of a grammar. A grammar may be developed by using development tools such as lex, yacc, XML, and/or the like, which allow for grammar generation and parsing capabilities, which in turn may form the basis of communication messages within and between components.

For example, a grammar may be arranged to recognize the tokens of an HTTP post command, e.g.:

w3c-post http:// . . . Value1 where Value1 is discerned as being a parameter because "http://" is part of the grammar syntax, and what follows is considered part of the post value. Similarly, with such a grammar, a variable "Value1" may be inserted into an "http://" post command and then sent. The grammar syntax itself may be presented as structured data that is interpreted and/or otherwise used to generate the parsing mechanism (e.g., a syntax description text file as processed by lex, yacc, etc.). Also, once the parsing mechanism is generated and/or instantiated, it itself may process and/or parse structured data such as, but not limited to: character (e.g., tab) delineated text, HTML, structured text streams, XML, and/or the like structured data. In another embodiment, inter-application data processing protocols themselves may have integrated and/or readily available parsers (e.g., JSON, SOAP, and/or like parsers) that may be employed to parse (e.g., communications) data. Further, the parsing grammar may be used beyond message parsing, but may also be used to parse: databases, data collections, data stores, structured data, and/or the like. Again, the desired configuration will depend upon the context, environment, and requirements of system deployment.

For example, in some implementations, the BQ™ controller may be executing a PHP script implementing a Secure Sockets Layer ("SSL") socket server via the information server, which listens to incoming communications on a server port to which a client may send data, e.g., data encoded in JSON format. Upon identifying an incoming communication, the PHP script may read the incoming message from the client device, parse the received JSON-encoded text data to extract information from the JSON-encoded text data into PHP script variables, and store the data (e.g., client identifying information, etc.) and/or extracted information in a relational database accessible using the Structured Query Language ("SQL"). An exemplary listing, written substantially in the form of PHP/SQL commands, to accept JSON-encoded input data from a client device via a SSL connection, parse the data to extract variables, and store the data to a database, is provided below:

```
<?PHP
header('Content-Type: text/plain');
// set ip address and port to listen to for incoming data
$address = '192.168.0.100';
$port = 255;
// create a server-side SSL socket, listen for/accept incoming
communication
$sock = socket_create(AF_INET, SOCK_STREAM, 0);
socket_bind($sock, $address, $port) or die('Could not bind to address');
socket_listen($sock);
$client = socket_accept($sock);
// read input data from client device in 1024 byte blocks until end of
message
do {
  $input = "";
  $input = socket_read($client, 1024);
  $data .= $input;
} while($input != "");
// parse data to extract variables
$obj = json_decode($data, true);
// store input data in a database
mysql_connect("201.408.185.132",$DBserver,$password); // access
database server
mysql_select("CLIENT_DB.SQL"); // select database to append
mysql_query("INSERT INTO UserTable (transmission)
VALUES ($data)"); // add data to UserTable table in a CLIENT database
mysql_close("CLIENT_DB.SQL"); // close connection to database
?>
```

Also, the following resources may be used to provide example embodiments regarding SOAP parser implementation:

http://www.xav.com/perl/site/lib/SOAP/Parser.html
http://publib.boulder.ibm.com/infocenter/tivihelp/v2r1/index.jsp?topic=/com.ibm.IBMDI.doc/referenceguide295.htm and other parser implementations:

http://publib.boulder.ibm.com/infocenter/tivihelp/v2r1/index.jsp?topic=/com.ibm.IBMDI. doc/referenceguide259.htm all of which are hereby expressly incorporated by reference.

In order to address various issues and advance the art, the entirety of this application (including the Cover Page, Title, Headings, Field, Background, Summary, Brief Description of the Drawings, Detailed Description, Claims, Abstract, Figures, Appendices and/or otherwise) shows by way of illustration various embodiments in which the claimed inventions may be practiced. The advantages and features of the application are of a representative sample of embodiments only, and are not exhaustive and/or exclusive. They are presented only to assist in understanding and teach the claimed principles. It should be understood that they are not representative of all disclosed embodiments. As such, certain aspects of the disclosure have not been discussed herein. That alternate embodiments may not have been presented for a specific portion of the invention or that further undescribed alternate embodiments may be available for a portion is not to be considered a disclaimer of those alternate embodiments. It will be appreciated that many of those undescribed embodiments incorporate the same principles of the invention and others are equivalent. Thus, it is to be understood that other embodiments may be utilized and functional, logical, organizational, structural and/or topological modifications may be made without departing from the scope and/or spirit of the disclosure. As such, all examples and/or embodiments are deemed to be non-limiting throughout this disclosure. Also, no inference should be drawn regarding those embodiments discussed herein relative to those not discussed herein other than it is as such for purposes of reducing space and repetition. For instance, it is to be understood that the logical and/or topological structure of any combination of any program components (a component collection), other components and/or any present feature sets as described in the figures and/or throughout are not limited to a fixed operating order and/or arrangement, but rather, any disclosed order is exemplary and all equivalents, regardless of order, are contemplated by the disclosure. Furthermore, it is to be understood that such features are not limited to serial execution, but rather, any number of threads, processes, services, servers, and/or the like that may execute asynchronously, concurrently, in parallel, simultaneously, synchronously, and/or the like are contemplated by the disclosure. As such, some of these features may be mutually contradictory, in that they cannot be simultaneously present in a single embodiment. Similarly, some features are applicable to one aspect of the invention, and inapplicable to others. In addition, the disclosure includes other inventions not presently claimed. Applicant reserves all rights in those presently unclaimed inventions including the right to claim such inventions, file additional applications, continuations, continuations in part, divisions, and/or the like thereof. As such, it should be understood that advantages, embodiments, examples, functional, features, logical, organizational, structural, topological, and/or other aspects of the disclosure are not to be considered limitations on the disclosure as defined by the claims or limitations on equivalents to the claims. It is to be understood that, depending on the particular needs and/or characteristics of a BQ™ individual and/or enterprise user, database configuration and/or relational model, data type, data transmission and/or network framework, syntax structure, and/or the like, various embodiments of the BQ™ may be implemented that enable a great deal of flexibility and customization.

All statements herein reciting principles, aspects, and embodiments of the disclosure, as well as specific examples thereof, are intended to encompass both structural and functional equivalents thereof. Additionally, it is intended that such equivalents include both currently known equivalents as well as equivalents developed in the future, i.e., any elements developed that perform the same function, regardless of structure.

Descriptions herein of circuitry and method steps and computer programs represent conceptual embodiments of illustrative circuitry and software embodying the principles of the disclosed embodiments. Thus the functions of the various elements shown and described herein may be provided through the use of dedicated hardware as well as hardware capable of executing software in association with appropriate software as set forth herein.

Terms to exemplify orientation, such as upper/lower, left/right, top/bottom and above/below, may be used herein to refer to relative positions of elements as shown in the figures. It should be understood that the terminology is used for notational convenience only and that in actual use the disclosed structures may be oriented different from the orientation shown in the figures. Thus, the terms should not be construed in a limiting manner.

In the disclosure hereof any element expressed as a means for performing a specified function is intended to encompass any way of performing that function including, for example, a) a combination of circuit elements and associated hardware which perform that function or b) software in any form, including, therefore, firmware, microcode or the like as set forth herein, combined with appropriate circuitry for executing that software to perform the function. Applicants thus regard any means which can provide those functionalities as equivalent to those shown herein.

Similarly, it will be appreciated that the system and process flows described herein represent various processes which may be substantially represented in computer-readable media and so executed by a computer or processor, whether or not such computer or processor is explicitly shown. Moreover, the various processes can be understood as representing not only processing and/or other functions but, alternatively, as blocks of program code that carry out such processing or functions.

As examples, the Specification describes and/or illustrates aspects useful for implementing the claimed disclosure by way of various circuits or circuitry which may be illustrated as or using terms such as blocks, modules, device, system, unit, controller, and/or other circuit-type depictions. Such circuits or circuitry are used together with other elements to exemplify how certain embodiments may be carried out in the form or structures, steps, functions, operations, activities, etc. In certain embodiments, such illustrated items represent one or more computer circuitry (e.g., microcomputer or other CPU) which is understood to include memory circuitry that stores code (program to be executed as a set/sets of instructions) for performing an algorithm. The specification may also make reference to an adjective that does not connote any attribute of the structure ("first [type of structure]" and "second [type of structure]") in which case the adjective is merely used for English-language antecedence to differentiate one such similarly-named structure from another similarly-named structure (e.g., "first circuit configured to convert . . . " is interpreted as "circuit configured to convert . . . "). On the other hand, specification may make reference to an adjective that is intended to connote an attribute of the structure (e.g., monitor server), in which case the adjective (e.g., monitor) modifies to refer to at least a portion of the named structure (e.g., server) is configured to have/perform that attribute (e.g., monitor server refers to at least a portion of a server that includes/performs the attribute of monitoring.

The methods, systems, computer programs and mobile devices of the present disclosure, as described above and shown in the drawings, among other things, provide for improved beverage cooling methods, systems and machine readable programs for carrying out the same. It will be apparent to those skilled in the art that various modifications and variations can be made in the devices, methods, software programs and mobile devices of the present disclosure without departing from the spirit or scope of the disclosure.

Thus, it is intended that the present disclosure include modifications and variations that are within the scope of the subject disclosure and equivalents.

What is claimed is:

1. A device for quenching at least one beverage, comprising:

a quench container adapted and configured to be positioned at least partially within an external lid of a thermally insulated cooler, the thermally insulated cooler having a cooled water bath therein, the quench container including at least one space configured for holding at least one beverage container;

a pump coupled to the quench container; and a conduit coupled so as to be in fluid communication with the quench container, the pump, and the cooled water bath of the thermally insulated cooler;

wherein activation of the pump is operative to draw water from the water level of the cooled water bath of the thermally insulated cooler into the quench container and direct the cooled water over the at least one beverage container disposed in the quench container.

2. The device of claim 1, further comprising:

a lighting device operative to emit a color corresponding to a state of a quench cycle determined by how much time has elapsed during device operation.

3. The device of claim 1, wherein the quench container includes a weir operative to set a predetermined water level in the quench container, the weir defining at least one opening therethrough to promote continuous water flow through the quench container during a quench cycle.

4. The device of claim 1, wherein the pump is operably coupled to an electronics assembly module that includes a removable battery, the electronics assembly module also being removable with the quench container and pump as the single unit.

5. The device of claim 4, wherein the electronics assembly module includes an electric motor drive that is coupled to at least one drive axle for causing the at least one beverage to rotate.

6. The device of claim 5, wherein the at least one drive axle includes a plurality of wheels for engaging the at least one beverage to cause the at least one beverage to rotate while being cooled with cooling water from the bath.

7. The device of claim 5, wherein the at least one drive axle includes a helical member for causing rotation of the at least one beverage that is placed parallel or perpendicular to the at least one drive axle.

8. The device of claim 1, further comprising at least one support that can be selectively adjusted to alter the overall dimensions of the device to fit thermally insulated coolers of different dimensions.

9. The device of claim 1, wherein the quench container is defined by a generally vertical peripheral wall with a sloped base plate, the sloped base plate having a drain orifice in a lower portion thereof.

10. The device of claim 1, wherein the quench container is configured to hold a plurality of beverages.

11. The device of claim 1, further comprising at least one level sensor operably coupled to the pump, wherein the device is configured to shut off the pump in response to an input from the at least one level sensor.

12. The device of claim 1, further comprising at least one photodetector configured and arranged to be selectively exposed to light originating from outside the thermally insulated cooler, and a controller operably coupled to the pump and to the photodetector, the controller being configured to shut off the pump in response to receiving a signal from the at least one photodetector.

13. A thermally insulated cooler, comprising:

a thermally insulated exterior housing defining a reservoir therein configured to contain a cooled water bath, the thermally insulated exterior housing including an external lid that is configured and arranged to be opened by a user to access the reservoir;

at least one liquid pump;

at least one liquid conduit; and at least one quench container disposed at least partially within the lid of the thermally insulated exterior housing, the at least one quench container being configured and arranged to be in fluid communication with the liquid pump and the at least one conduit, the at least one quench container being disposed above the reservoir, the at least one quench container defining at least one beverage container space therein for holding and cooling at least one beverage container, wherein activation of the pump causes water to be drawn from the cooled water bath of the reservoir and directed through the at least one conduit into the at least one quench container, the at least one quench container being further configured and arranged to direct the water from the cooled water bath via the pump over the at least one beverage container in the at least one beverage container space to enhance cooling of a beverage in the at least one beverage container.

14. The thermally insulated cooler of claim 13, further comprising at least one drive axle including at least one drive wheel disposed thereon for engaging the at least one beverage container to cause the at least one beverage container to rotate while being cooled with water from the cooled water bath.

15. The thermally insulated cooler of claim 13, further comprising at least one level sensor configured and arranged to detect the physical orientation of the thermally insulated cooler.

16. The thermally insulated cooler of claim 15, further comprising a controller operably coupled to the pump and to the level sensor, the controller being configured to shut off the pump in response to a signal from the at least one level sensor.

17. The thermally insulated cooler of claim 14, wherein the at least one beverage container space includes at least one of said drive wheels for causing rotation of the at least one beverage container about a central axis of the at least one beverage container while cooling water is being directed over the at least one beverage container.

18. The thermally insulated cooler of claim 17, wherein the at least one beverage container space is configured to permit the at least one beverage container to lay horizontally while it is being rotated and cooled.

19. The thermally insulated cooler of claim 13, wherein the at least one quench container is defined by a generally vertical peripheral wall with a sloped base plate, the sloped base plate having a drain orifice in a lower portion thereof.

20. The thermally insulated cooler of claim 13, wherein the pump is operably coupled to an electronics assembly that includes a removable battery.

21. The thermally insulated cooler of claim 13, wherein the at least one quench container is configured and arranged to drop into an opening defined in the lid.

22. The thermally insulated cooler of claim 13, wherein the at least one quench container is integrated into the lid of the cooler.

23. The thermally insulated cooler of claim 13, wherein the at least one quench container is configured to be covered with a second lid.

* * * * *